US008863445B2

(12) United States Patent
Zhong

(10) Patent No.: US 8,863,445 B2
(45) Date of Patent: Oct. 21, 2014

(54) REINFORCED CONCRETE DENSE COLUMN STRUCTURE SYSTEMS

(75) Inventor: Hai Zhong, Shanghai (CN)

(73) Assignee: Empire Technology Development LLC, Wilmington, DE (US)

( * ) Notice: Subject to any disclaimer, the term of this patent is extended or adjusted under 35 U.S.C. 154(b) by 0 days.

(21) Appl. No.: 13/202,988

(22) PCT Filed: Aug. 24, 2010

(86) PCT No.: PCT/CN2010/001275

§ 371 (c)(1),
(2), (4) Date: Aug. 24, 2011

(87) PCT Pub. No.: WO2012/024814

PCT Pub. Date: Mar. 1, 2012

(65) Prior Publication Data

US 2012/0233936 A1 Sep. 20, 2012

(51) Int. Cl.

*E04B 1/16* (2006.01)
*E04B 1/348* (2006.01)
*E04B 2/86* (2006.01)

(52) U.S. Cl.

CPC ..... *E04B 1/165* (2013.01); *E04B 1/34823* (2013.01); *E04B 2/8647* (2013.01)
USPC ..... 52/79.14

(58) Field of Classification Search

USPC ..... 52/414, 236.5, 79.9–79.14, 421, 415, 52/424, 425, 429, 319, 320, 321, 322, 323, 52/324, 325, 326, 327, 328, 329, 330, 331, 52/332, 333, 334, 335, 336, 337, 338, 339, 52/340, 341, 419, 422, 434, 437, 439

See application file for complete search history.

(56) References Cited

U.S. PATENT DOCUMENTS 669,315 A 3/1901 Whitmore
812,006 A 2/1906 Bovee (Continued)

FOREIGN PATENT DOCUMENTS

CN 2319466 A 5/1999
CN 1311840 A 9/2001

(Continued)

OTHER PUBLICATIONS

Notification of Transmittal of the International Search Report and the Written Opinion of the International Searching Authority, International Application No. PCT/CN2010/001277, Jun. 2, 2011.

(Continued)

*Primary Examiner* — William Gilbert
*Assistant Examiner* — Kyle Walraed-Sullivan
(74) *Attorney, Agent, or Firm* — Ren-Sheng International

(57) ABSTRACT

A monolithic reinforced concrete (RC) dense column structure includes RC dense columns along a structure perimeter, RC window structures along the structure perimeter, and a RC beam over the dense columns and the window structures around the structure perimeter. Each window structure includes RC window columns, a RC short window column between the window columns, and a RC window beam between the window columns and over the short window column. The structure further includes prefabricated wall panels having molds that casted the dense columns, the window structures, and the beam.

19 Claims, 60 Drawing Sheets

(56) References Cited

U.S. PATENT DOCUMENTS

| | | | | | |
|---|---|---|---|---|---|
| 813,439 | A | | 2/1906 | Landon | |
| 1,325,051 | A | | 12/1919 | Stahl et al. | |
| 1,461,590 | A | | 7/1923 | Walper | |
| 1,491,205 | A | | 4/1924 | Ford | |
| 1,518,336 | A | | 12/1924 | Makowski | |
| 1,526,776 | A | | 2/1925 | Dalidz | |
| 1,714,987 | A | | 5/1929 | Pedersen | |
| 1,968,189 | A | | 7/1934 | Bartels | |
| 2,520,912 | A | | 9/1950 | Cheney | |
| 2,595,123 | A | | 4/1952 | Callan | |
| 2,653,118 | A | | 9/1953 | Seymour | |
| 2,851,873 | A | | 9/1958 | Wheeler-Nicholson | |
| 3,775,529 | A | | 11/1973 | Steenson et al. | |
| 3,902,287 | A | * | 9/1975 | Livingston | 52/73 |
| 3,942,294 | A | | 3/1976 | Savell, Jr. | |
| 4,068,429 | A | | 1/1978 | Moore | |
| 4,142,815 | A | | 3/1979 | Mitchell | |
| 4,228,623 | A | * | 10/1980 | Menosso | 52/79.3 |
| 4,271,111 | A | | 6/1981 | Sheber | |
| 4,321,024 | A | | 3/1982 | Terraillon | |
| 4,336,675 | A | | 6/1982 | Pereira | |
| 4,408,434 | A | | 10/1983 | Collins | |
| 4,482,126 | A | | 11/1984 | Toffolon | |
| 4,575,978 | A | | 3/1986 | Huhn et al. | |
| 4,628,650 | A | | 12/1986 | Parker | |
| 5,265,390 | A | * | 11/1993 | Tanner | 52/233 |
| 5,335,472 | A | | 8/1994 | Phillips | |
| 5,497,592 | A | | 3/1996 | Boeshart | |
| 5,515,659 | A | | 5/1996 | MacDonald et al. | |
| 5,540,020 | A | | 7/1996 | Santini | |
| 5,547,743 | A | | 8/1996 | Rumiesz, Jr. et al. | |
| 5,561,958 | A | | 10/1996 | Clement et al. | |
| 5,564,243 | A | | 10/1996 | Kroll et al. | |
| 5,598,673 | A | | 2/1997 | Atkins | |
| 5,697,189 | A | * | 12/1997 | Miller et al. | 52/79.9 |
| 5,724,783 | A | | 3/1998 | Mandish | |
| 5,809,725 | A | | 9/1998 | Cretti | |
| 5,899,037 | A | | 5/1999 | Josey | |
| 5,953,883 | A | | 9/1999 | Ojala | |
| 6,003,278 | A | * | 12/1999 | Weaver et al. | 52/414 |
| 6,047,503 | A | * | 4/2000 | Kost | 52/79.9 |
| 6,112,489 | A | | 9/2000 | Zweig | |
| 6,119,432 | A | * | 9/2000 | Niemann | 52/797.1 |
| 6,155,016 | A | | 12/2000 | Wacker et al. | |
| 6,202,375 | B1 | | 3/2001 | Kleinschmidt | |
| 6,223,480 | B1 | | 5/2001 | Khoo | |
| 6,256,955 | B1 | | 7/2001 | Lolley et al. | |
| 6,283,439 | B1 | | 9/2001 | Myers et al. | |
| 6,408,594 | B1 | | 6/2002 | Porter | |
| 6,526,714 | B1 | | 3/2003 | Billings et al. | |
| 6,591,567 | B2 | | 7/2003 | Hota et al. | |
| 6,722,099 | B2 | | 4/2004 | Gilbert et al. | |
| 6,745,531 | B1 | | 6/2004 | Egan | |
| 6,898,908 | B2 | | 5/2005 | Messenger et al. | |
| 6,898,912 | B2 | | 5/2005 | Bravinski | |
| 6,920,728 | B2 | * | 7/2005 | Powers | 52/250 |
| 6,931,806 | B2 | | 8/2005 | Olsen | |
| 6,945,506 | B2 | | 9/2005 | Long | |
| 7,048,530 | B2 | | 5/2006 | Gaillard et al. | |
| 7,421,828 | B2 | * | 9/2008 | Reynolds | 52/745.2 |
| 7,617,640 | B2 | * | 11/2009 | Bradley | 52/127.2 |
| 7,625,827 | B2 | | 12/2009 | Egan et al. | |
| 7,700,505 | B2 | | 4/2010 | Leclercq et al. | |
| 7,807,011 | B2 | | 10/2010 | Dunstan et al. | |
| 7,810,293 | B2 | * | 10/2010 | Gibbar et al. | 52/309.7 |
| 7,902,092 | B2 | | 3/2011 | Egan et al. | |
| 7,926,233 | B2 | | 4/2011 | Schiffmann et al. | |
| 7,926,241 | B2 | | 4/2011 | Schiffmann et al. | |
| 7,930,861 | B2 | | 4/2011 | Schiffmann et al. | |
| 7,934,693 | B2 | | 5/2011 | Bravinski | |
| 7,959,126 | B2 | | 6/2011 | Lee | |
| 8,025,493 | B2 | | 9/2011 | Petrov | |
| 8,082,711 | B2 | | 12/2011 | Schiffmann et al. | |
| 8,266,867 | B2 | | 9/2012 | Schiffmann et al. | |
| 8,291,676 | B2 | | 10/2012 | Hong et al. | |
| 8,322,097 | B2 | | 12/2012 | Schiffmann et al. | |
| 8,322,098 | B2 | | 12/2012 | Schiffmann et al. | |
| 8,393,123 | B2 | | 3/2013 | Schiffmann et al. | |
| 8,555,583 | B2 | | 10/2013 | Ciuperca | |
| 8,590,215 | B2 | | 11/2013 | Damichey | |
| 2002/0000506 | A1 | | 1/2002 | Khoo | |
| 2002/0025224 | A1 | | 2/2002 | Williamson | |
| 2003/0192276 | A1 | | 10/2003 | Heydon | |
| 2004/0020147 | A1 | | 2/2004 | Martella et al. | |
| 2004/0067352 | A1 | | 4/2004 | Hagerman et al. | |
| 2005/0246968 | A1 | * | 11/2005 | Wood | 52/79.12 |
| 2006/0277741 | A1 | | 12/2006 | Anderson | |
| 2007/0028541 | A1 | | 2/2007 | Pasek | |
| 2007/0084984 | A1 | | 4/2007 | Pauley et al. | |
| 2007/0094992 | A1 | | 5/2007 | Antonic | |
| 2007/0125042 | A1 | | 6/2007 | Hughes et al. | |
| 2007/0186497 | A1 | | 8/2007 | Burkett et al. | |
| 2007/0283632 | A1 | | 12/2007 | McInerney et al. | |
| 2008/0034693 | A1 | | 2/2008 | Moore | |
| 2008/0066424 | A1 | | 3/2008 | Schmid | |
| 2009/0151282 | A1 | | 6/2009 | Loayza | |
| 2010/0090088 | A1 | | 4/2010 | Schwoerer | |
| 2011/0030288 | A1 | | 2/2011 | Traulsen et al. | |
| 2011/0088333 | A1 | * | 4/2011 | Damichey | 52/79.11 |
| 2011/0113707 | A1 | * | 5/2011 | Stephens, Jr. | 52/220.2 |
| 2011/0131892 | A1 | | 6/2011 | Del Pino | |
| 2011/0253879 | A1 | | 10/2011 | Sanders | |
| 2012/0047816 | A1 | | 3/2012 | Zhong | |
| 2012/0055102 | A1 | | 3/2012 | Fradera Pellicer | |
| 2012/0174518 | A1 | | 7/2012 | Litaize | |
| 2012/0233936 | A1 | | 9/2012 | Zhong | |
| 2013/0074432 | A1 | | 3/2013 | Ciuperca | |

FOREIGN PATENT DOCUMENTS

| | | | |
|---|---|---|---|
| CN | 2474614 | Y | 1/2002 |
| CN | 2506717 | Y | 8/2002 |
| CN | 2538878 | Y | 3/2003 |
| CN | 1614173 | A | 5/2005 |
| CN | 1715580 | A | 1/2006 |
| CN | 200992767 | A | 12/2007 |
| CN | 101225680 | A | 7/2008 |
| CN | 201184015 | A | 1/2009 |
| CN | 101469559 | A | 7/2009 |
| CN | 201495626 | U | 6/2010 |
| EP | 0136241 | A1 | 4/1985 |
| EP | 0903446 | A1 | 3/1999 |
| EP | 0924359 | A2 | 6/1999 |
| GB | 408955 | A | 4/1934 |
| JP | 2004270200 | A | 9/2004 |
| WO | 9964688 | A1 | 12/1999 |
| WO | 0144594 | A2 | 6/2001 |
| WO | 2004059098 | A1 | 7/2004 |
| WO | WO 2009106735 | A2 * | 9/2009 |

OTHER PUBLICATIONS

Notification of Transmittal of the International Search Report and the Written Opinion of the International Searching Authority, International Application No. PCT/CN2010/001276, May 26, 2011.

* cited by examiner

524

REINFORCED CONCRETE DENSE COLUMN STRUCTURE SYSTEMS

CROSS-REFERENCE TO RELATED APPLICATIONS

The present application is a 371 application of International Application PCT/CN2010/001275, filed on Aug. 24, 2010 and entitled "REINFORCED CONCRETE DENSE COLUMN STRUCTURE SYSTEMS." The International Application, including any appendices or attachments thereof, is incorporated by reference herein in its entirety.

The present application is related to U.S. patent application Ser. No. 13/203,837, entitled "PREFABRICATED WALL PANELS," and U.S. patent application Ser. No. 13/203,977, entitled "WALL RACKS, TRACKS, ROLLER FOR MAKING PREFABRICATED WALL PANELS," which are concurrently filed, commonly assigned, and incorporated by reference herein in their entirety.

BACKGROUND

FIG. 1 shows a perspective view of a conventional reinforced concrete (RC) frame structure 2 for a story in a building. RC refers to concrete incorporated with reinforcement bars ("rebars"), grids, plates, or fibers to strengthen the concrete in tension. Structure 2 consists of frame beams 4 and frame columns 6. For clarity, only some of the elements are labeled.

Frame beams 4 form an orthogonal grid of intersecting beams. Frame columns 6 are joined to frame beams 4 at the beam intersections. Structure 2 is formed monolithically where frame beams 4 and frame columns 6 are cast in a single operation. Masonry infill walls (not shown) may be formed in the spaces under frame beams 4 and between frame columns 6. The masonry infill walls fulfill architectural and other functional requirements, such as forming a large portion of building envelop, partitioning, temperature and sound barriers, and providing compartmentalization against fire hazard. Openings are made in the masonry infill walls to install windows and doors. For additional structural support, RC shear walls (not shown) may be formed under frame beams 4 between frame columns 6. Unlike the masonry infill walls, the shear walls are designed to counter the effects of lateral loads acting on a structure, such as wind and earthquake loads.

SUMMARY

In one or more embodiments of the present disclosure, a monolithic reinforced concrete (RC) dense column structure includes RC dense columns along a structure perimeter, RC window structures along the structure perimeter, and a RC beam over the dense columns and the window structures around the structure perimeter. Each window structure includes RC window columns, a RC short window column between the window columns, and a RC window beam between the window columns and over the short window column. The structure further includes prefabricated wall panels having molds that casted the dense columns, the window structures, and the beam.

The foregoing summary is illustrative only and is not intended to be in any limiting. In addition to the illustrative aspects, embodiments, and features described above, further aspects, embodiments, and features will become apparent by reference to the drawings and the following detailed description.

DETAILED DESCRIPTION

Figure 1:
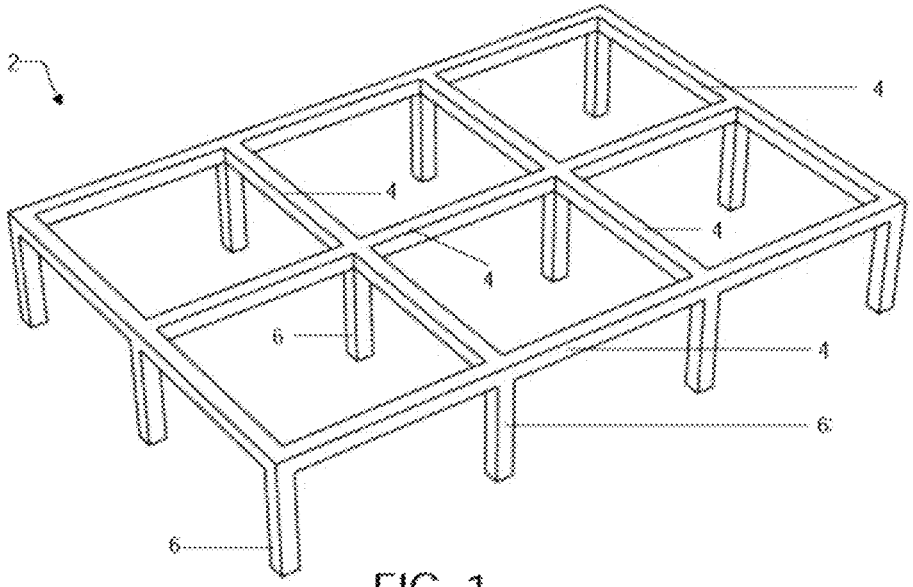
FIG. 1 (Prior Art)
FIG. 1 shows a perspective view of a conventional reinforced concrete (RC) frame structure for a story in a building.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Reinforced Concrete Dense Column Frame Structure

In one or more embodiments of the present disclosure, a monolithic reinforced concrete (RC) dense column frame structure includes, in addition to RC frame beams and RC frame columns, one or more groups of RC dense columns and RC window structures along the structure perimeter. The dense columns and the window structures may bear additional gravity load and provide additional lateral and torsional resistance to the structure. As the structure is monolithic, all the elements can be cast in a single step to save time and money. The structure also does not include shear walls at the structure perimeter, which may otherwise cause cracking in the concrete floors as they thermal cycle under the constraints of such peripheral shear walls.

Figure 2:
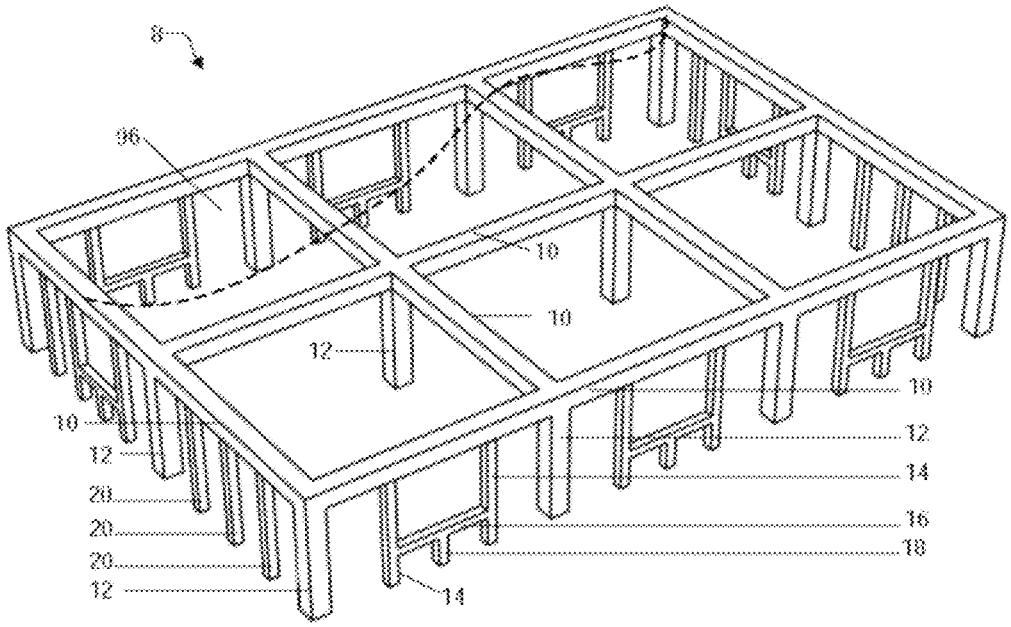
FIG. 2 shows a perspective view of an illustrative embodiment of an RC dense column frame structure for a story in a building.

FIG. 2 shows a perspective view of an illustrative embodiment of a RC dense column frame structure 8 for a story in a single or a multi-story building. Structure 8 includes RC frame beams 10, RC frame columns 12, RC window columns 14, RC window beams 16, RC short window columns 18, RC dense columns 20, and a RC floor slab 96 (shown partially in phantom). For clarity, only some of the elements are labeled in FIG. 2 and the remainder of the drawings.

Frame beams 10 form a grid of intersecting beams. The grid may be orthogonal, angled, or partially orthogonal and partially angled. Frame columns 12 are joined to frame beams 10 at the beam intersections. Frame beam 10 and frame column 12 may have similar square cross-sections and dimensions. Alternative cross-sectional shapes may be used, such as rectangular, circular, L-shaped, T-shaped, and cross-shaped cross-sections.

Groups of dense columns 20 may each be located between any pair of frame columns 12, under primary beam 10, along the structure perimeter. Similarly, window structures 22 may each be located between any pair of frame columns 12, under primary beam 10, along the structure perimeter.

Figure 3:
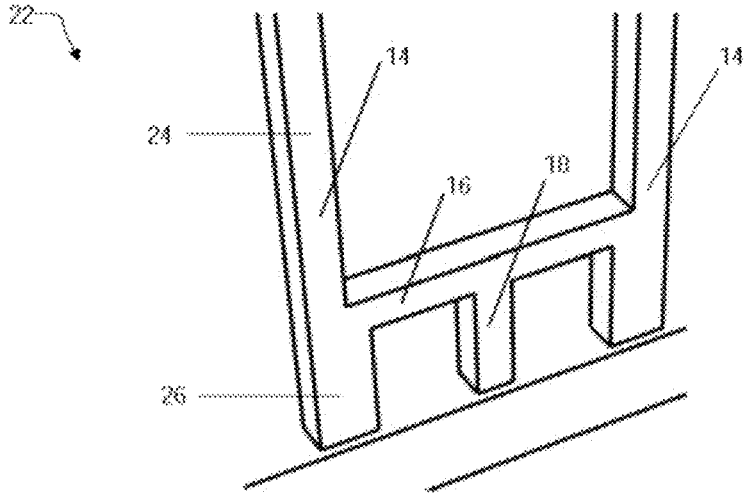
FIG. 3 shows a perspective view of an illustrative embodiment of a window structure in the structure of FIG. 2.

FIG. 3 shows a perspective view of an illustrative embodiment of a window structure 22 in structure 8 of FIG. 2. Window structure 22 includes a pair of window columns 14, a window beam 16, and a short window column 18. Window columns 14 are full height and run from a supporting structure such as, but not limited to, a foundation 50 (FIG. 5) or a floor slab 96 (FIG. 2) up to an overhead frame beam 10 (FIG. 2). Window beam 16 runs between window columns 14. Short window column 18 is less-than-full-height and runs from the supporting structure up to window beam 16. Each window column 14 may include an upper column section 24 above window beam 16, and a lower column section 26 below the window beam that may have a greater cross-section than the upper column section to provide greater strength.

Referring back to FIG. 2, in an example embodiment structure 8 is formed monolithically where frame beams 10, frame columns 12, window columns 14, window beams 16, short window columns 18, dense columns 20, and floor slab 96 are cast in situ at a job site in a single operation.

In one embodiment of the present disclosure, dense columns 20 and window structures 22 may be gravity loadbearing. Window beams 16 and short window columns 18 may also provide additional lateral and torsional resistance to structure 8. Thus, structure 8 may have greater gravity load capacity and lateral and torsional resistance than conventional RC frame structure 2 (FIG. 1) while maintaining the ductility of the conventional RC frame structure. This structure and configuration may provide better earthquake resistance and prevent uneven settlement in.

Structure 8 may provide a better use of space compared to conventional RC frame structure 2 (FIG. 1). For example, dividers walls (not shown) of lighter material may be used to form residences on a floor. Structure 8 is suitable for large scale construction. The single casting of structure 8 shortens construction time and reduces the required manpower. With the addition of dense columns 20 and window structures 22, the rebar quality for frame beams 10 and frame columns 12 may be adjusted to reduce cost.

Structure 8 may be designed to conform to standard safety requirements and regulations for the conventional RC frame structures without considering the additional load capacity provided by dense columns 20 and window structures 22 so the overall factor of safety (FoS) for the structure is increased. Alternatively the FoS may be decreased without compromising safety because structure 8 uses lighter thermal materials for infill walls as dense columns 20 and window structures 22 already increase the FoS.

Figure 4:
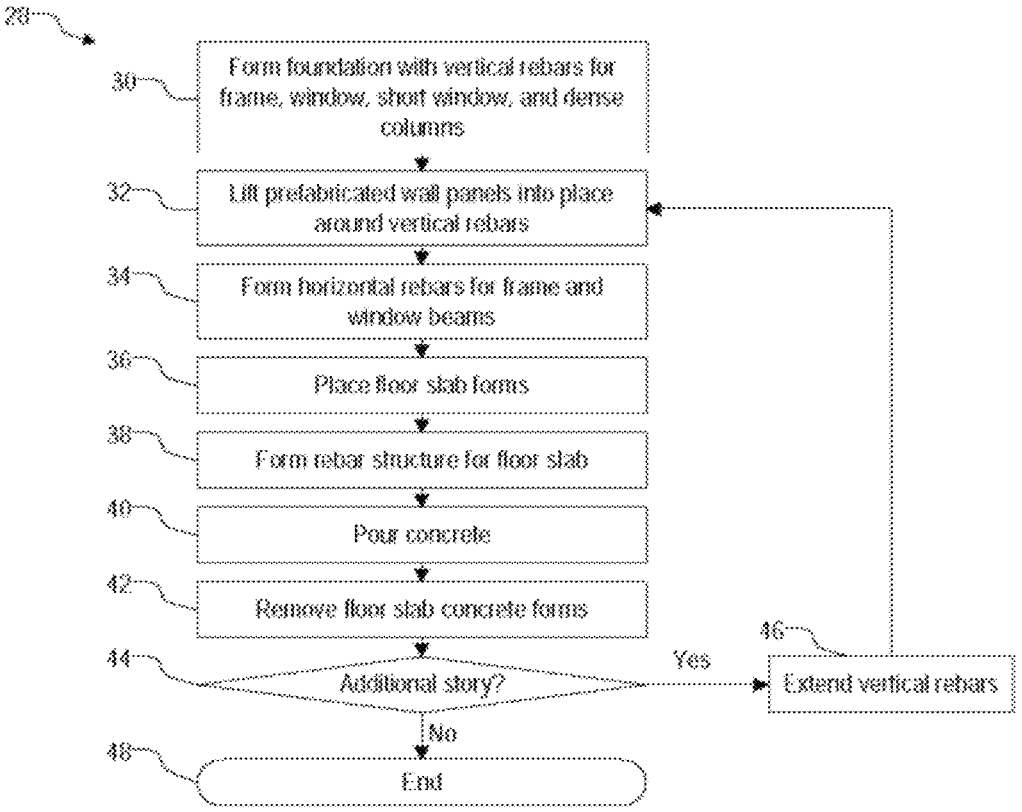
FIG. 4 is a flowchart of an illustrative embodiment of a method for constructing a building with one or more of the structures of FIG. 2.

FIG. 4 is a flowchart of an illustrative embodiment of an example method 28 for constructing a building with one or more of structures 8. Method 28 may include one or more operations, functions or actions as illustrated by one or more of blocks 30, 32, 34, 36, 38, 40, 42, 44, 46, and 48. Although the blocks are illustrated in a sequential order, these blocks may also be performed in parallel, and/or in a different order than those described herein. Also, the various blocks may be combined into fewer blocks, divided into additional blocks, and/or eliminated based upon the desired implementation.

Processing for the method 28 may begin at block 30, "Form foundation with vertical rebars for frame, window, short window, and dense columns." Block 30 may be followed by block 32, "Lift prefabricated wall panels into place around vertical rebars." Block 32 may be followed by block 34, "Form horizontal rebars for frame and window beams." Block 34 may be followed by block 36, "Place floor slab forms." Block 36 may be followed by block 38, "Form rebar structure for floor slab." Block 38 may be followed by block 40, "Pour concrete." Block 40 may be followed by block 42, "Remove floor slab concrete forms." Block 42 may be followed by decision block 44, "Additional story?". When there is an additional story, block 44 may be followed by block 46, "Extend vertical rebars." When there is not an additional story, block 44 may be followed by block 48, "End."

Figure 5:
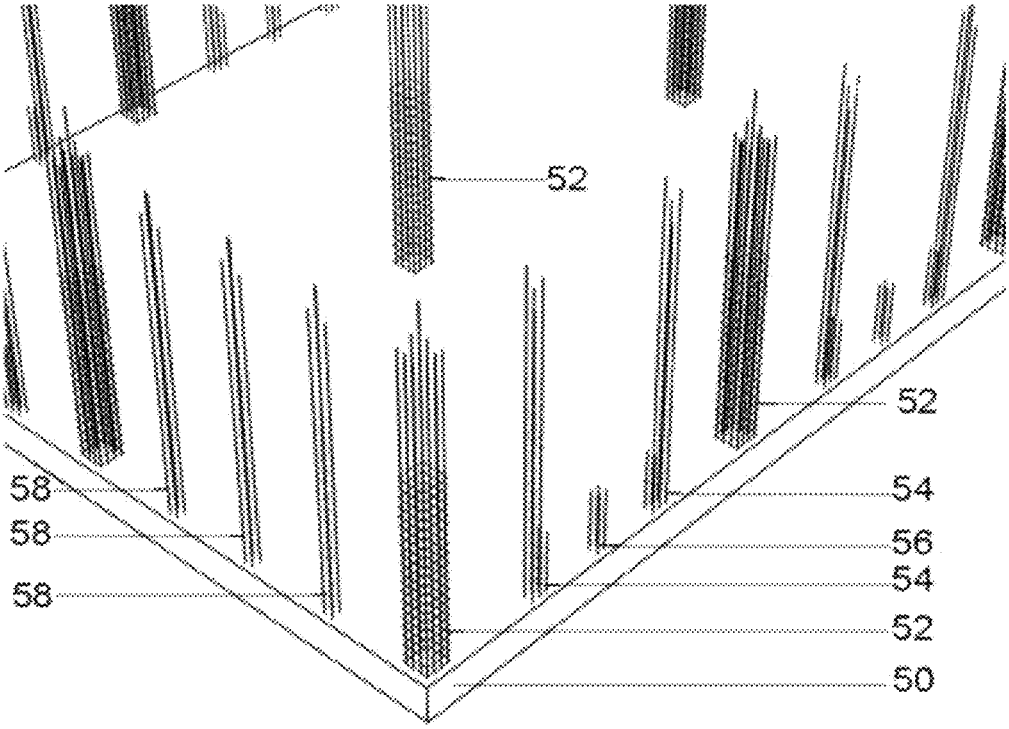
FIG. 5 shows a perspective view of an illustrative embodiment for forming a foundation of the structure of FIG. 2 as described in a block in the method of FIG. 4.

In block 30 as illustrated in FIG. 5, a foundation 50 is formed with vertically protruding frame column rebar structures 52, window column rebar structures 54, short window column rebar structures 56, and dense column rebar structures 58.

Figure 6:
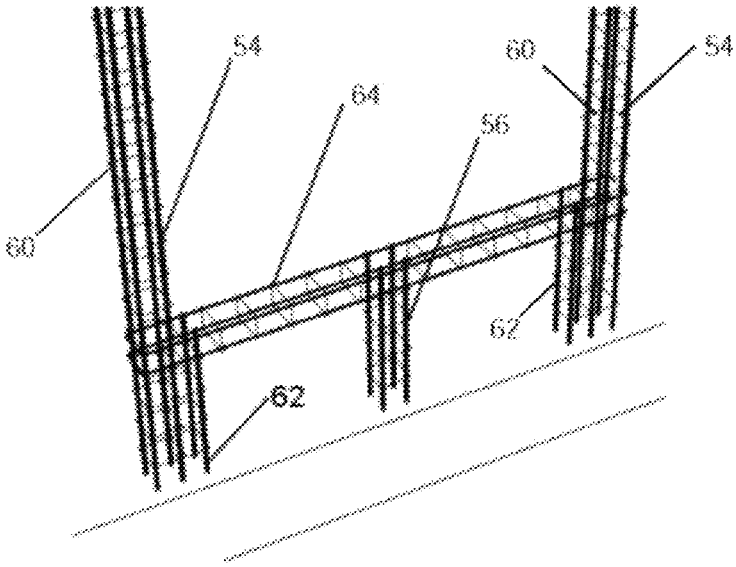
FIG. 6 shows a close-up view of an illustrative embodiment of rebar structures for the window structure of FIG. 3.

FIG. 6 shows a close-up view of an illustrative embodiment of window column rebar structures 54, short window column rebar structure 56, and a window beam rebar structure 64 used to form window structure 22 (FIG. 3). Each window column rebar structure 54 includes a tall rebar cage 60 and a short rebar cage 62, which is connected by wires, welding, or another means to the full-height rebar cage. Tall rebar cage 60 is at full-height while short rebar cage 62 is at less-than-full-height. Together tall rebar cage 60 and short rebar cage 62 are used to form window column 14 (FIG. 3) with upper column section 24 (FIG. 3) and lower column section 26 (FIG. 3). Window beam rebar structure 64, which is later used to form window beam 16 (FIG. 3), may be connected by wires, welding, or another means at its ends to window column rebar structures 54 and at or near its middle to short window column rebar structure 56. The resulting window structure 22 forms a stronger connection with neighboring walls.

Figure 7:
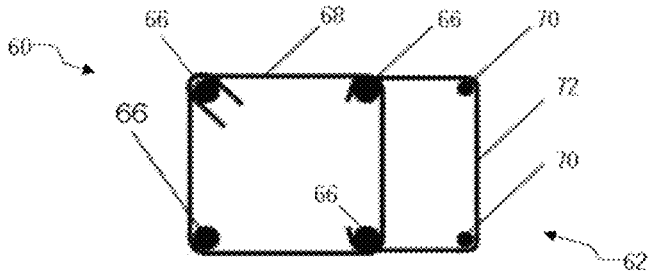
FIG. 7 shows a cross-sectional view of an illustrative embodiment of tall and short rebar cages of FIG. 6.

FIG. 7 shows a cross-sectional view of an illustrative embodiment of tall rebar cage 60 and short rebar cage 62. Tall rebar cage 60 includes four vertical rebars 66 and a rectangular stirrup 68 connected by wires, welding, or another means to the vertical rebars at its four corners. Short rebar cage 62 includes two vertical rebars 70 and a U-shaped stirrup 72 connected by wires, welding, or another means to vertical rebars 66 and 70 at its four corners. Vertical rebars 70 may have smaller cross-sections than vertical rebars 66.

Figure 8:
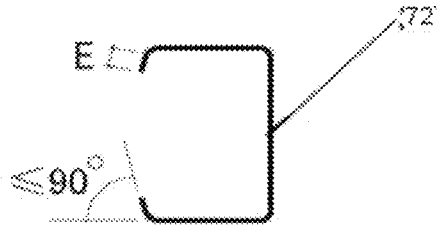
FIG. 8 shows a cross-sectional view of an illustrative embodiment of a stirrup of FIG. 7.

FIG. 8 shows a cross-sectional view of an illustrative embodiment of stirrup 72. Stirrup 72 has two ends bent at less than or equal to 90 degrees, and in an example embodiment a length "E" of the bent ends are less than or equal to four times the diameter of vertical rods 70.

Figure 9:
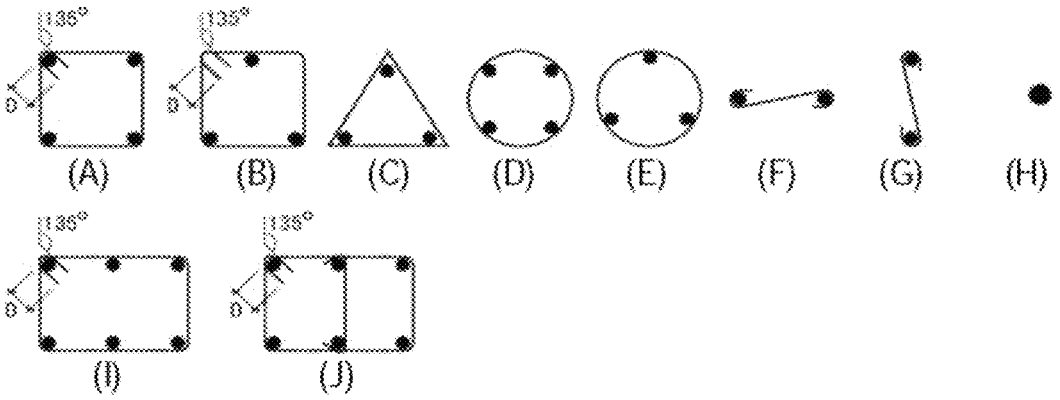
FIG. 9 shows cross-sectional views of illustrative rebar structures for window beams, short window columns, and secondary columns in the structure of FIG. 2.
Figure 96:
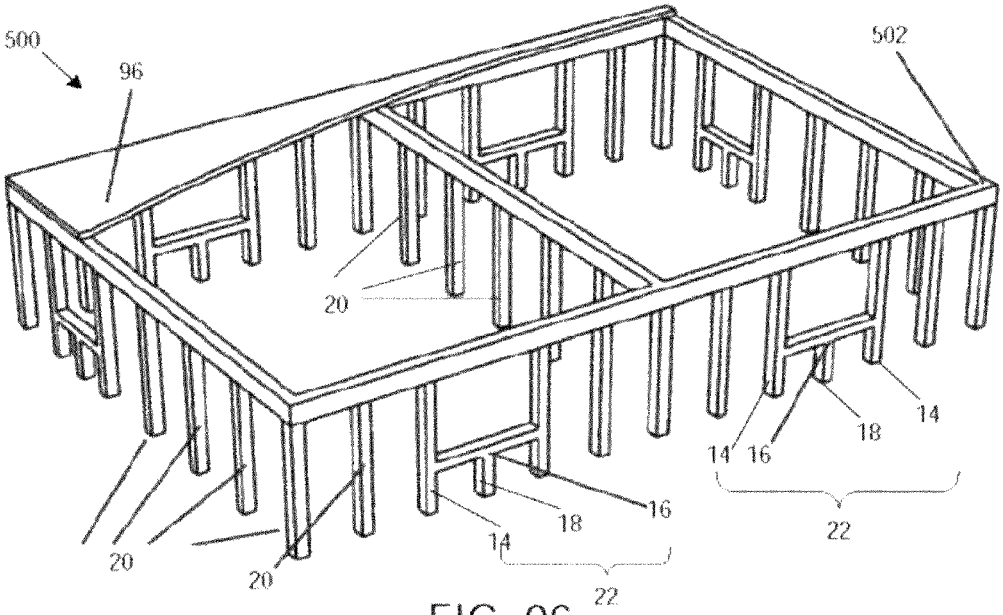
FIG. 96 shows a perspective view of an illustrative embodiment of a RC dense column structure for a story in a building.

FIG. 9 shows cross-sectional views of illustrative rebar structures for window columns 14, window beams 16, short window columns 18, and dense columns 20 in structure 8 (FIG. 2) and for a ring beam 502 in a structure 500 (FIG. 96).

FIG. 9A shows an example embodiment of a rectangular rebar cage with four vertical rebars connected by wire, welding, or another means to a rectangular stirrup. The vertical rebars are located at the four corners of the rectangular cage/stirrup. The stirrup may have two ends bent at about 135 degrees, and a length "D" of the bent ends are less than or equal to five times the diameter of the vertical rebars.

FIG. 9B shows an example embodiment of a rectangular rebar cage with three vertical rebars connected by wire, welding, or another means to a rectangular stirrup. Two vertical rebars are located at adjacent corners of the rectangular cage/stirrup, and one vertical rebar is located at the middle of the opposite side of the rectangular cage/stirrup. The stirrup may have two ends bent at about 135 degrees, and length "D" of the bent ends are less than or equal to five times the diameter of the vertical rebars.

FIG. 9C shows an example embodiment of a triangular rebar cage with three vertical rebars connected by wire, welding, or another means to a triangular stirrup. The vertical rebars are located at the three corners of the rectangular cage/stirrup.

FIG. 9D shows an example embodiment of a circular rebar cage with four vertical rebars connected by wire, welding, or another means to a circular or helical stirrup. The vertical rebars are spaced equally around the circular cage/stirrup.

FIG. 9E shows an example embodiment of a circular cage with three vertical rebars connected by wire, welding, or another means to a circular or helical stirrup. The vertical rebars are spaced equally around the circular cage/stirrup.

FIG. 9F shows an example embodiment of an S-shaped rebar cage with two vertical rebars connected by wire, welding, or another means to a horizontal S-shaped stirrup. The vertical rebars are located at the bent ends of the horizontal S-shaped stirrup.

FIG. 9G shows an example embodiment of an S-shaped rebar cage with two vertical rebars connected by wire, welding, or another means to a vertical S-shaped stirrup. The vertical rebars are located at the bent ends of the vertical S-shaped stirrup.

FIG. 9H shows an example embodiment of a single vertical rebar. The vertical rebar is centered in a mold to form the corresponding RC beam or column.

FIG. 9I shows an example embodiment of a rectangular rebar cage with six vertical rebars connected by wire, welding, or another means to a rectangular stirrup. The vertical rebars are located at the four corners of the rectangular cage/stirrup, and near the middle of the longer two sides of the cage. The stirrup may have two ends bent at about 135 degrees, and a length "D" of the bent ends are less than or equal to five times the diameter of the vertical rebars.

FIG. 9J shows an example embodiment of a rectangular rebar cage with six vertical rebars connected by wire, welding, or another means to a rectangular stirrup and a straight stirrup. This rectangular rebar cage is similar to the cage in FIG. 9I but further includes a straight stirrup connecting the two vertical rebars near the middle of the longer two sides of the cage.

Referring to FIG. 4, in block 32, prefabricated wall panels with predefined molds for casting RC columns and beams are hoisted onto corresponding rebar structures. Prefabricated wall panels are factory-built units produced in a controlled environment. Prefabricated wall panels include full-height straight and L-shaped corner panels, and less-than-full-height upper and lower panels that fit between two full-height panels.

Figure 10:
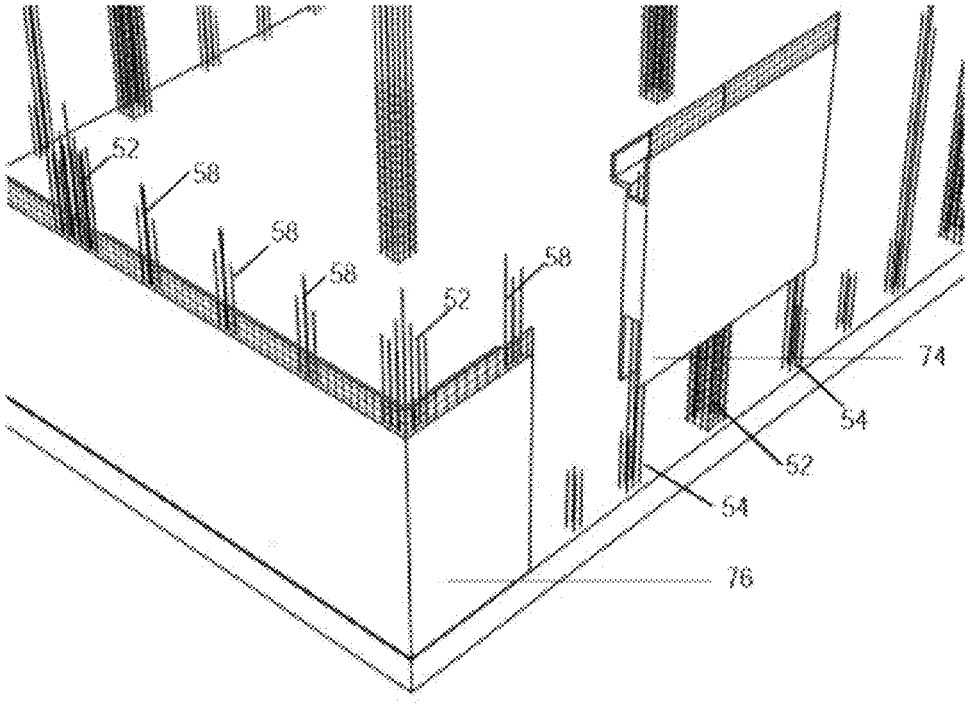
FIG. 10 shows a perspective view of an illustrative embodiment for installing straight and corner prefabricated wall panels as described in a block in the method of FIG. 4.

FIG. 10 shows a perspective view of an illustrative embodiment for installing full-height straight prefabricated wall panels 74 and full-height corner prefabricated wall panels 76. Prefabricated wall panels 74 and 76 are hoisted onto frame column rebar structures 52, tall window rebar structures 54, and dense column rebar structures 58. Prefabricated wall panels 74 are placed along straight peripheral sections of structure 8 (FIG. 2) while prefabricated wall panels 76 are placed at peripheral corners of the structure. Adjacent full-height prefabricated wall panels may be horizontally spaced apart to receive less-than-full height prefabricated wall panels.

Figure 13:
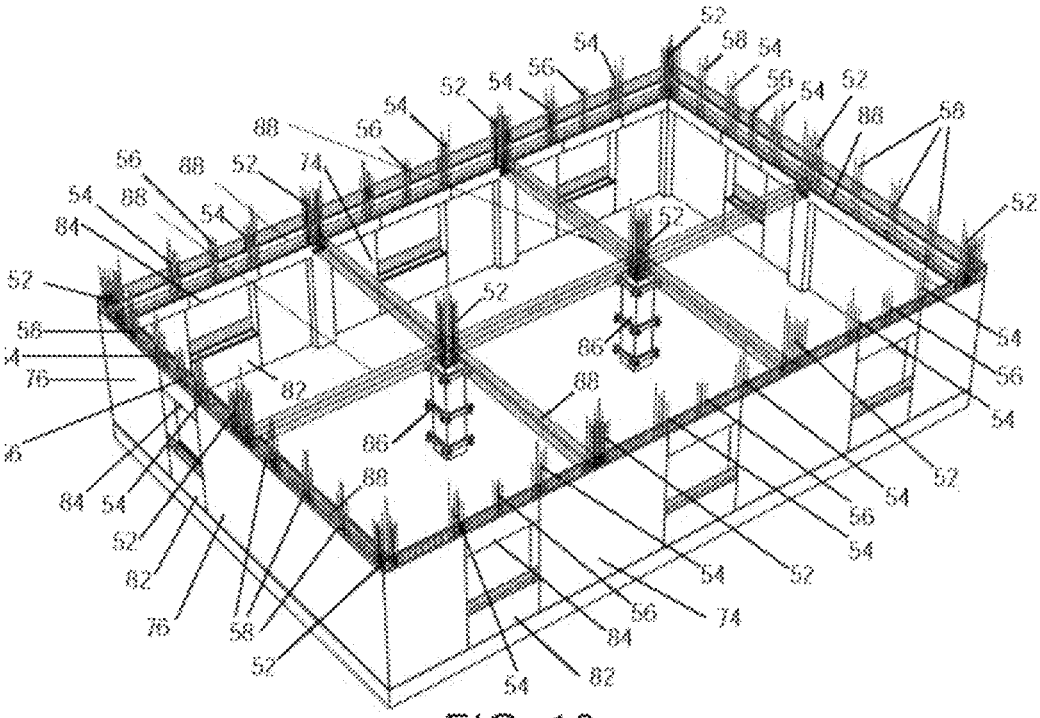
FIG. 13 shows a perspective view of an illustrative embodiment for installing rebar structures for frame beams as described in a block in the method of FIG. 4.

Prefabricated wall panels 74 and 76 define frame column molds 78 (FIG. 43) for casting frame columns 12 (FIG. 2) around frame column rebar structures 52, window column molds 235 (FIG. 43) for casting window columns 14 (FIG. 2) around window column rebar structures 54, and dense column molds 80 (FIG. 43) for casting dense columns 20 (FIG. 2) around dense column rebar structures 58. The top of prefabricated wall panels 74 and 76 define molds 218 (FIG. 42) for casting frame beams 10 (FIG. 2) around frame beam rebar structures 88 (FIG. 13).

Figure 11:
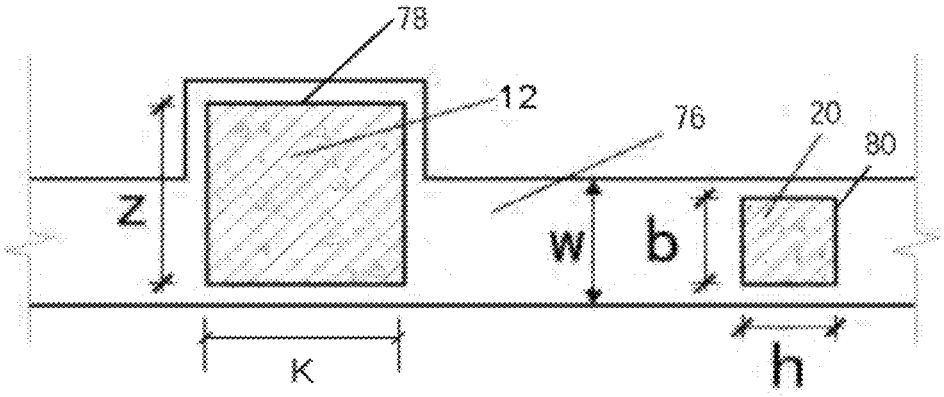
FIG. 11 shows a top cross-sectional view of an illustrative embodiment of a prefabricated wall panel of FIG. 10.

FIG. 11 shows a top cross-sectional view of an illustrative embodiment of a full-height prefabricated wall panel, such as prefabricated wall panel 76. Prefabricated wall panel 76 has a depth "w" and includes a frame column mold 78 and a dense column mold 80 for forming a frame column 12 and a dense column 20, respectively. Frame column mold 78 may protrude inward to define a space that accommodates frame column 12 having a width "k" and a depth "z," which is equal to or greater than depth w. Dense column mold 80 defines a space that accommodates dense column 20 having a width "h" and a depth "b," where in an embodiment 100 mm≤b≤300 mm, b<w, and 1≤h/b≤3.

Figure 12:
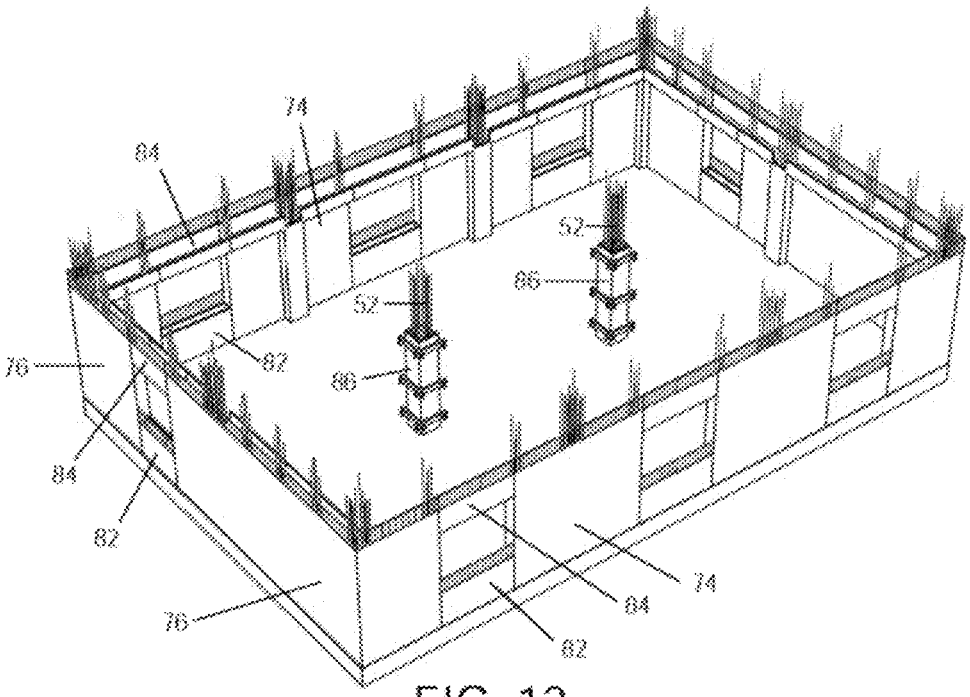
FIG. 12 shows a perspective view of an illustrative embodiment for installing lower and upper prefabricated wall panels as described in a block in the method of FIG. 4.

FIG. 12 shows a perspective view of an illustrative embodiment for installing less-than-full-height lower prefabricated wall panels 82 and less-than-full-height upper prefabricated wall panels 84. Lower prefabricated wall panels 82 and upper prefabricated wall panels 84 are hoisted into place between full-height panels, such as prefabricated wall panels 74 and 76. Lower prefabricated wall panel 82 defines window column molds 312 (FIGS. 66 and 67) for casting parts of lower column sections 26 (FIG. 3) of window columns 14 (FIG. 2) around short rebar cages 62 (FIG. 6), a window beam mold 310 (FIGS. 66 and 67) for casting window beam 16 (FIG. 2) around window beam rebar structure 64 (FIG. 6), a short window column mold 314 (FIGS. 66 and 67) for casting short window column 18 (FIG. 2) around short window column rebar structure 56 (FIG. 6).

Upper prefabricated wall panel 84 is fixed to adjoining full-height prefabricated wall panels above lower prefabricated wall panel 82. The top of upper prefabricated wall panel 84 defines a frame beam mold 218 (FIG. 68) for casting frame beam 10 (FIG. 2) around frame beam rebar structure 88 (FIG. 13) at the structure perimeter.

Concrete forms 86 are formed around frame column rebar structures 52 within structure 8. Concrete forms 86 define molds for casting interior frame columns 12 (FIG. 2) around interior frame column rebar structures 52.

Referring to FIGS. 4 and 13, in block 34, rebar structures 88 for frame beams 102 (FIG. 2) are formed. Frame beam rebar structures 88 along the structure perimeter are located in the molds 218 (FIGS. 42 and 68) provided atop of prefabricated wall panels 74, 76, and 84. Peripheral frame beam rebar structures 88 may be fixed by wires, welding, or another means to frame column rebar structures 52, window column rebar structures 54, and dense column rebar structures 58 along the structure perimeter. Short window column rebar structures 56 for the next story, if any, are formed and connected by wires, welding, or another means to peripheral frame beam rebar structures 88. Interior frame beam rebar structures 88 within the structure perimeter are connected by wires, welding, or another means to frame column rebar structures 52 within the structure perimeter and peripheral frame beam rebar structures 88.

Figure 14:
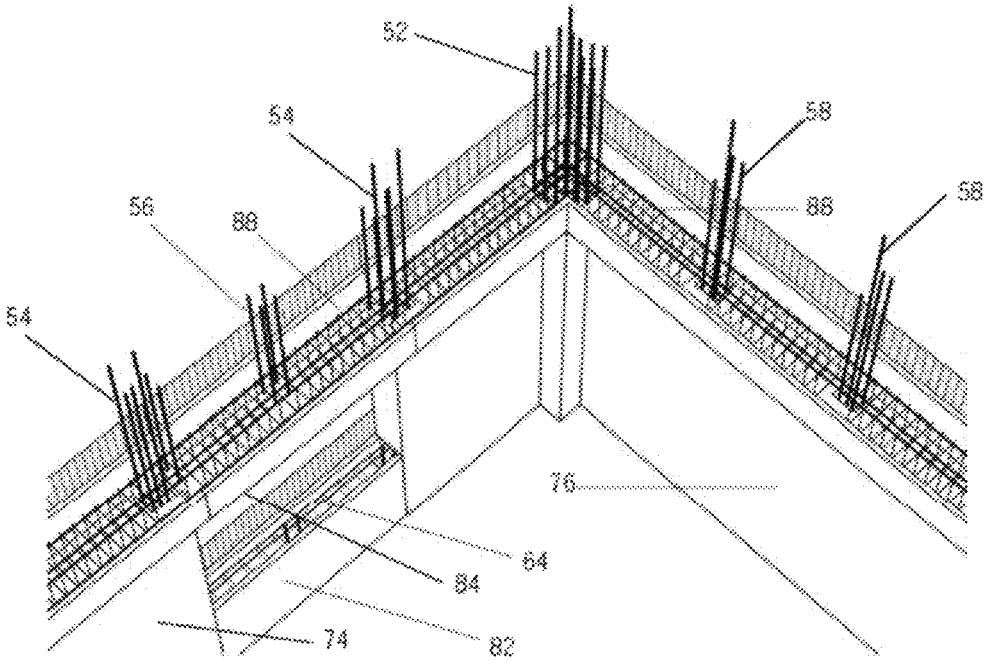
FIG. 14 shows a perspective view of an illustrative embodiment for installing rebar structures for window beams as described in a block in the method of FIG. 4.

Referring to FIG. 14, window beam rebar structures 64 for window beams 16 (FIG. 2) are formed. Window beam rebar structures 64 are located in molds 310 (FIGS. 66 and 67) provided atop of lower prefabricated wall panels 82. As described above in FIG. 6, window beam rebar structure 64 are connected wires, welding, or another means to window column rebar structures 54 and short window column rebar structure 56 (FIG. 6).

Figure 15:
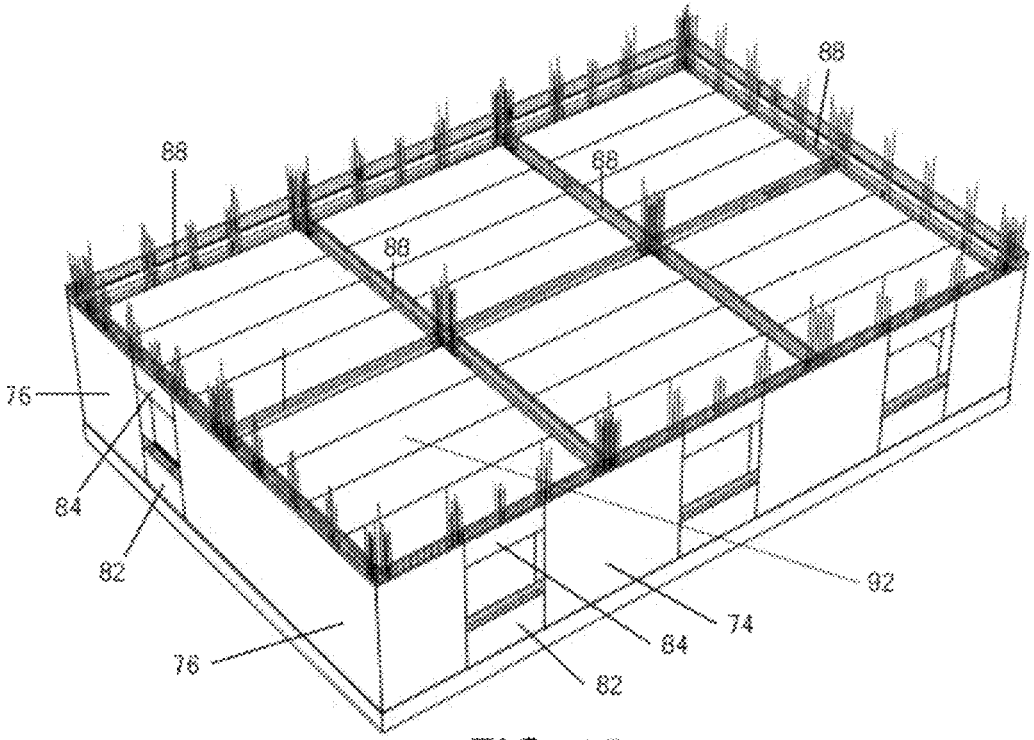
FIG. 15 shows a perspective view of an illustrative embodiment for installing concrete forms for a floor slab as described in a block in the method of FIG. 4.

Referring to FIGS. 4 and 15, in block 36, concrete forms 92 for casting floor slab 96 (FIGS. 2 and 17) are placed over and supported by prefabricated wall panels 74, 76, and 84, and concrete forms 86 (FIG. 12). Concrete forms 92 also define molds for forming frame beams 10 (FIG. 2) around frame beam rebar structures 88 within the structure perimeter.

Figure 16:
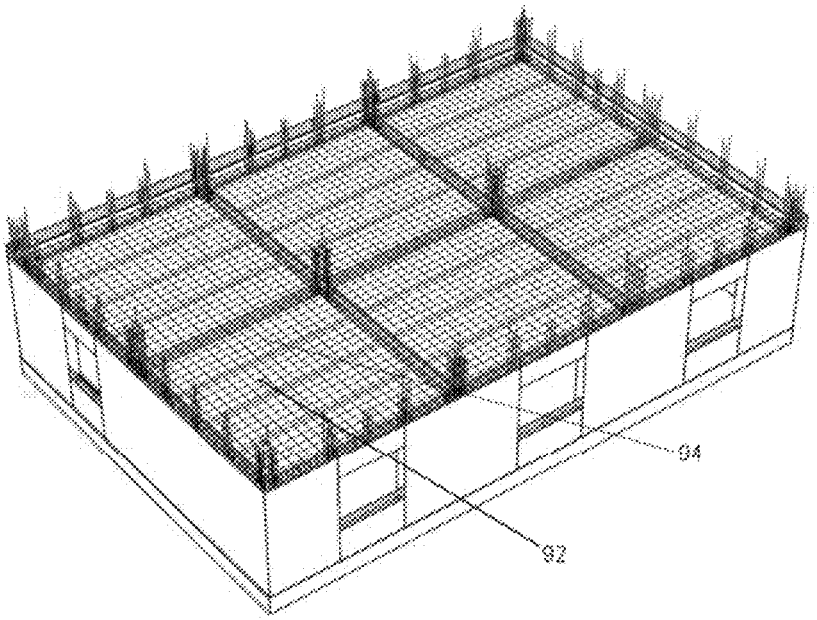
FIG. 16 shows a perspective view of an illustrative embodiment for installing rebar structures for the floor slab as described in a block in the method of FIG. 4.

Referring to FIGS. 4 and 16, in block 38, a floor slab rebar structure 94 is formed and placed over concrete forms 92. Floor slab rebar structure 94 may be a metal mesh. As an alternative to casting in situ, floor slab 96 may be precast and installed onsite after the other elements of structure 8 are cast in situ.

Figure 17:
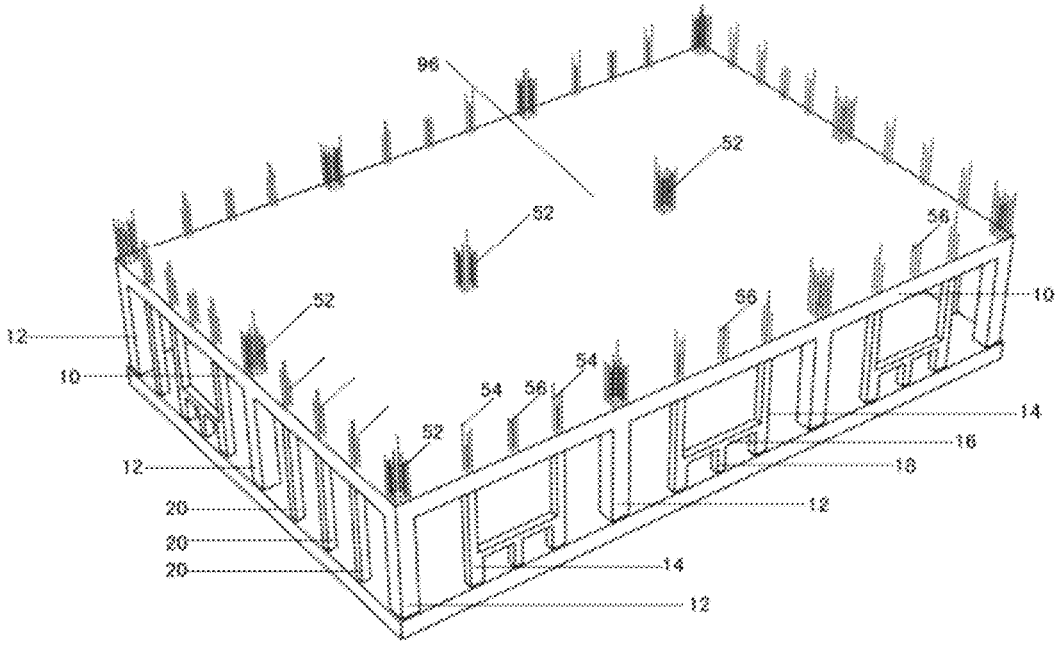
FIG. 17 shows a perspective view of an illustrative embodiment of a RC dense column frame structure, without the prefabricated wall panels, for a story in a building.

Referring to FIGS. 4 and 17, in block 40, concrete is poured into the various molds to form a monolithic RC dense column frame structure 8 including frame beams 10, frame columns 12, window columns 14, window beams 16, short window columns 18, dense columns 20, and floor slab 96 integrated with prefabricated wall panels 74, 76, 82, and 84 (not shown for the sake of clarity).

Referring to FIG. 4, in block 42, concrete forms 86 and 92 may be removed after the concrete dries to form structure 8. Depending if an additional story will be formed, frame column rebar structures 52, window column rebar structures 54, short window column rebar structures 56, and dense column rebar structures 58 may or may not protrude from floor slab 96.

Referring to FIG. 4, in block 44, it is determined whether the building includes another story. If so, block 44 may be followed by block 46. Otherwise block 44 may be followed by block 48 and ends method 28. In block 46, protruding frame column rebar structures 52, tall window rebar structures 54, and dense column rebar structures 58 are vertically extended to form another structure 8 for the next story in the building. Each rebar structure may be vertically extended using rebar splice coupling sleeves, welding, or another means.

Figure 18:
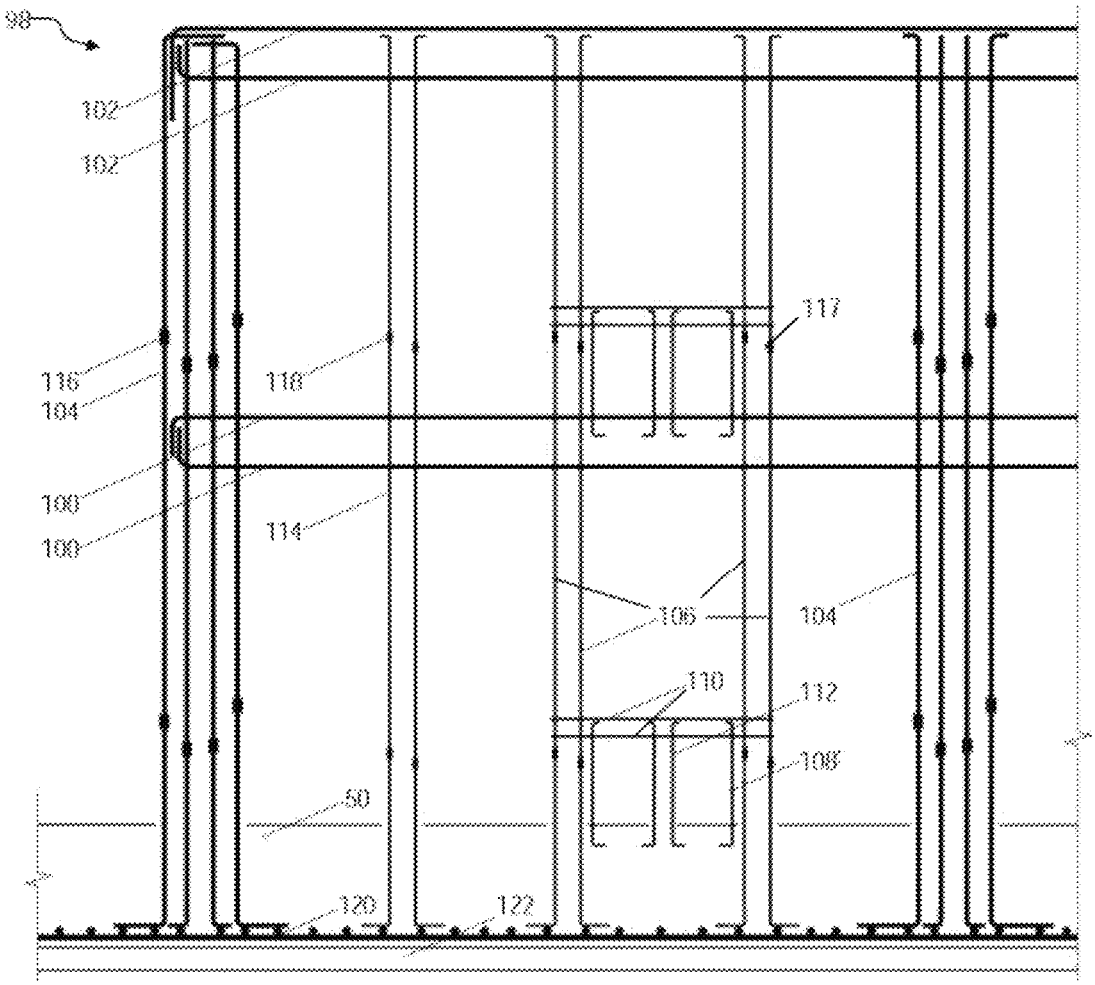
FIG. 18 shows a side view of an illustrative embodiment of rebar structures of multiple structures of FIG. 2 in a building where the dense columns are loadbearing.

FIG. 18 shows a side view of an illustrative embodiment of rebar structures, shown without stirrups, of multiple structures 8 (FIG. 2) for multiple stories in a building 98 where window columns 14 (FIG. 2) and dense columns 20 (FIG. 2) are gravity loadbearing elements. Building 98 includes horizontal rebars 100, 102, and 110, vertical rebars 104, 66, 70, 112, and 114, rebar splice coupling sleeves 116, 117, and 118, foundation 50, a foundation rebar structure 120, and a foundation pad 122.

Vertical rebars 104 are part of frame column rebar structures 52 (FIG. 5) for casting frame columns 12 (FIG. 2). Vertical rebars 66 are part of window column rebar structures 54 (FIG. 5) for casting window columns 14 (FIG. 2). Vertical rebars 114 are part of dense column rebar structures 58 (FIG. 5) for casting dense columns 20 (FIG. 2). Vertical rebars 104, 66, and 114 extend continuously from the bottom of foundation 50, through frame beams 10 (FIG. 2) of the first story, and end near the top of the frame beams 10 (FIG. 2) of the second story. Vertical rebars 104, 66, and 114 may be made up of multiple sections connected by rebar splice coupling sleeves 116, 117, and 118, respectively. Alternatively, the sections may be connected by lap joints, welding, or other conventional methods.

Referring again to FIG. 18, vertical rebars 104, 66, and 114 have bent or hooked lower ends connected by wires, welding, or another means to foundation rebar structure 120, and bent or hooked upper ends connected by wires, welding, or another means to horizontal rebars 102 that are part of frame beam rebar structures 88 (FIG. 13) for casting frame beams 10 (FIG. 2) in the roof. Vertical rebars 104, 66, and 114 may also be connected by wires, welding, or another means to horizontal rebars 100 that are part of frame beam rebar structures 88 for casting frame beams 10 (FIG. 2) in the intermediate story.

In an example embodiment, vertical rebars 70 are connected by wires, welding, or another means to vertical rebars 66 to form window column rebar structures 54 (FIG. 6) for casting window columns 14 (FIG. 2). Horizontal rebars 110 are part of window beam rebar structures 64 (FIG. 6) for casting window beam 16 (FIG. 2). Vertical rebars 112 are part of short window column rebar structure 56 (FIG. 6) for casting short window column 18 (FIG. 2). Where horizontal rebars 110 intersect vertical rebars 66, 70, and 112, they are connected by wires, welding, or another means. On the first story, vertical rebars 70 and 112 have bent or hooked lower extend into foundation 50. On the second story, vertical rebars 70 and 112 have bent or hooked lower ends connected by wires, welding, or another means to horizontal rebars 100.

Figure 19:
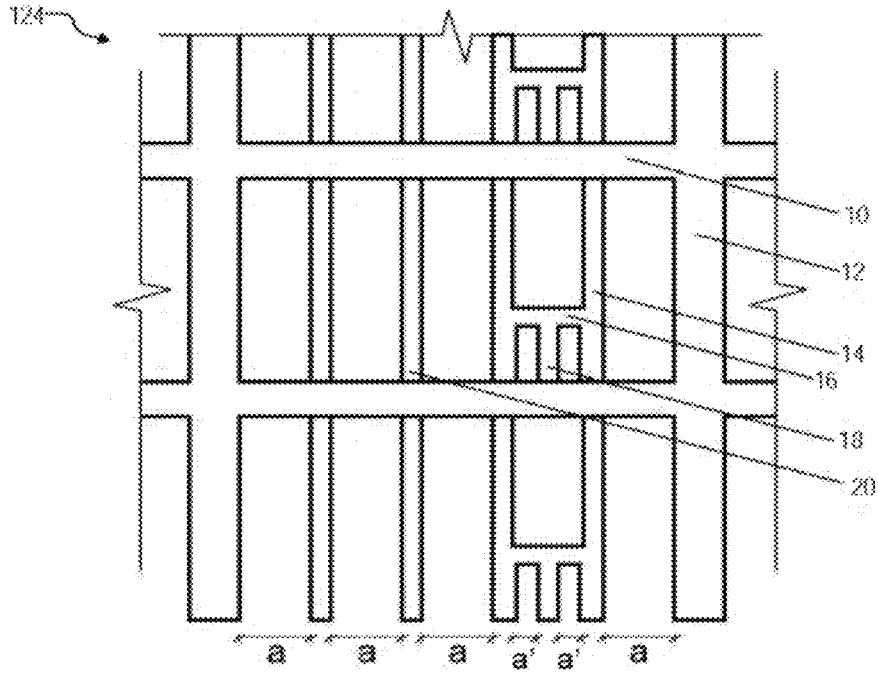
FIG. 19 shows a side view of an illustrative embodiment of multiple structures of FIG. 2 for a building based on the rebar structures of FIG. 18.

FIG. 19 shows a side view of an illustrative embodiment of multiple RC dense column frame structures 8 of a building 124 based on the rebar structures of FIG. 18. Dense columns 20 are vertically aligned and continuous in structures 8 so they are gravity loadbearing. Similarly, window columns 14 are vertically aligned and continuous in structures 8. In one embodiment of the present disclosure, the distance "a" between frame column 12 and dense column 20, between two dense columns 20, between dense column 20 and window column 14, and between window column 14 and frame column 12 may be equal to or less than 1,250 mm. In one embodiment, the distance "a" between window column 14 and short window column 18 may also be equal to or less than 1,250 mm.

Figure 20:
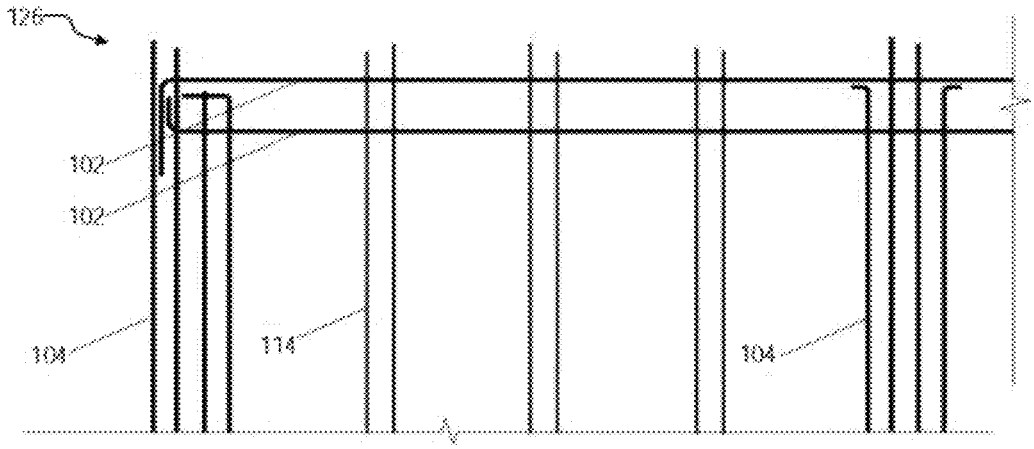
FIG. 20 shows a side view of an illustrative embodiment of rebar structures of a roof in the structure of FIG. 2 of a building.

FIG. 20 shows a side view of an illustrative embodiment of rebar structures, shown without stirrups, of a roof in a RC dense column frame structure 8 of a building 126. In contrast to the roof in building 98 of FIG. 18, some vertical rebars 104 for frame column rebar structures 52 (FIG. 5) and some vertical rebars 114 for dense column rebar structures 58 (FIG. 5) protrude from horizontal rebar 102 for frame beam rebar structures 88 (FIG. 13) of the roof. These protruding vertical rebars 104 and 114 may serve as anchors for additional structures on the roof.

Figure 21:
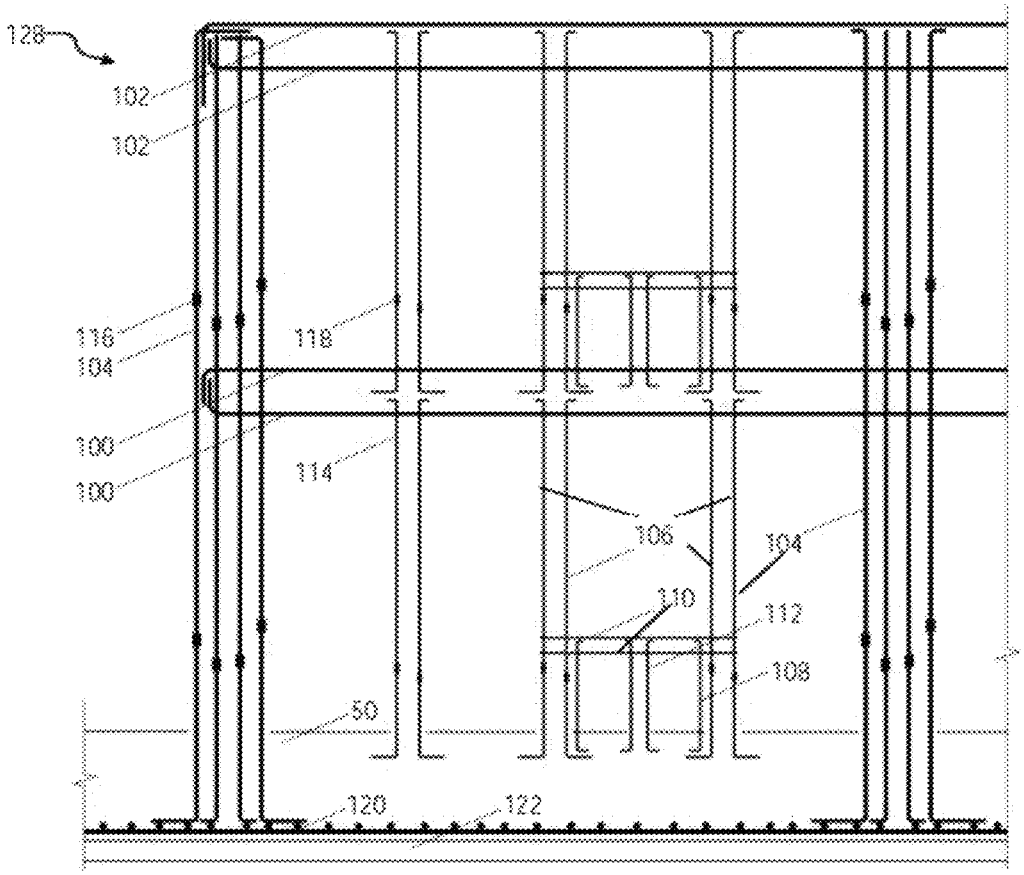
FIG. 21 shows a side view of an illustrative embodiment of rebar structures of multiple structures of FIG. 2 in a building where the dense columns are non-loadbearing.

FIG. 21 shows a side view of an illustrative embodiment of rebar structures in RC dense column frame structures 8 for multiple stories in a building 128 where window columns 14 and dense columns 20 are not gravity loadbearing. In contrast to building 98 in FIG. 18, vertical rebars 66 for window columns 14 (FIG. 2) and vertical rebars 114 for dense columns 20 (FIG. 2) do not run continuously from foundation 50 to horizontal rebars 102 for frame beams 102 (FIG. 2) in the roof. Instead, vertical rebars 66 and 114 extend between two supporting structures (e.g., between foundation 50 and a frame beam 10, between frame beams 10 of two stories, and between frame beams 10 of a story and the roof). Vertical rebars 66 and 114 have bent or hooked ends fixed to the two supporting structures.

Figure 22:
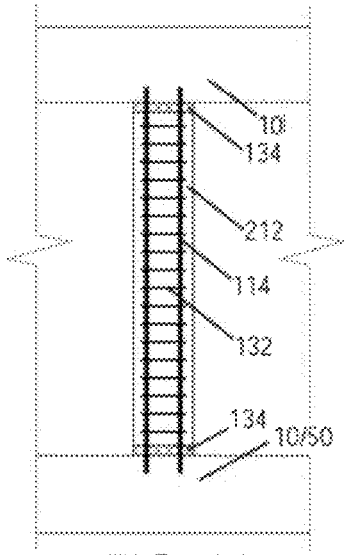
FIG. 22 shows a side view of an illustrative embodiment of a rebar structure for a dense column of FIG. 2.

FIG. 22 shows a side cross-sectional view of an illustrative embodiment of a rebar structure for a dense column 20 that is not loadbearing. Dense column 20 includes vertical rebars 114, stirrups 132, and lower and upper foam boards 134.

The two ends of vertical rebars 114 extend into foundation 50/lower frame beam 10 and upper frame beam 10. Lower foam board 134 is placed at the base of dense column 20 above foundation 50/lower frame beam 10. Concrete is poured to the height of dense column 20 and upper foam board 134 is placed atop of the dense column before concrete is poured again for upper frame beam 10. Lower and upper foam boards 134 may be expanded polystyrene (EPS) boards. This construction method ensures that dense column 20 separates from foundation 50/lower frame beam 10 and upper frame beam 10 and the dense column does not produce any shear forces during an earthquake so the frame structure is the main loadbearing structure and the dense column only serves to provide a solid wall.

Figure 23:
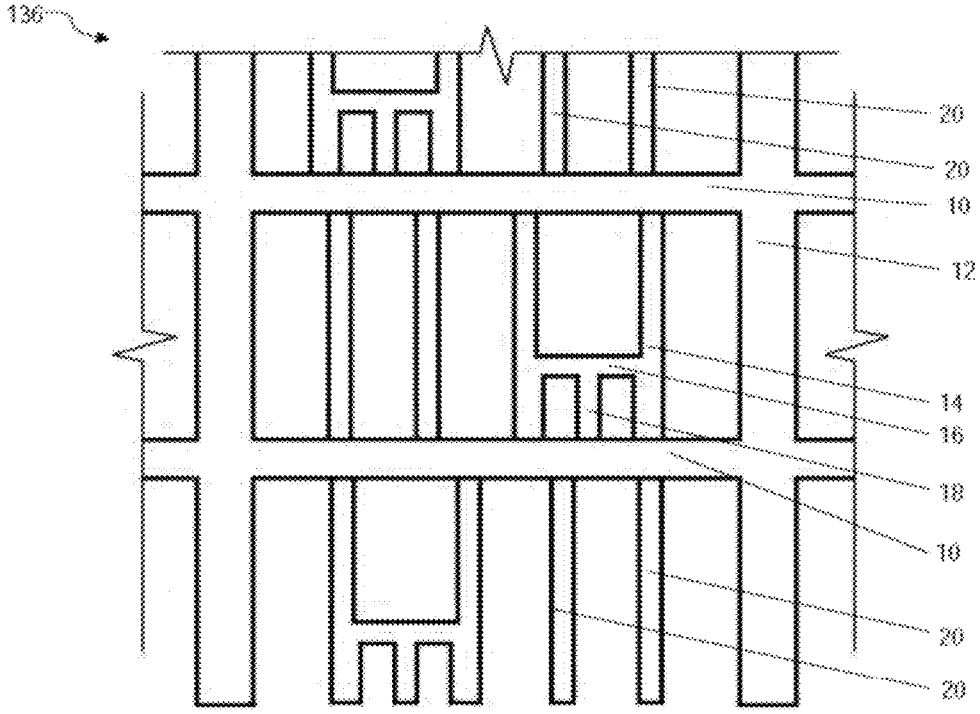
FIG. 23 shows a side view of an illustrative embodiment of the alignment of window structures and dense columns in multiple structures of FIG. 2 of a building.

FIG. 23 shows a side view of an illustrative embodiment of the alignment of window structures 22 and dense columns 20 in multiple RC dense column frame structures 8 for multiple stories in a building 136 where the window structures and the dense columns are not loadbearing. In contrast to building 124 in FIG. 19, window columns 14 and dense columns 20 are not vertically aligned in building 136. This allows for alternating arrangements of dense columns 20 and window structures 22.

Figure 24:
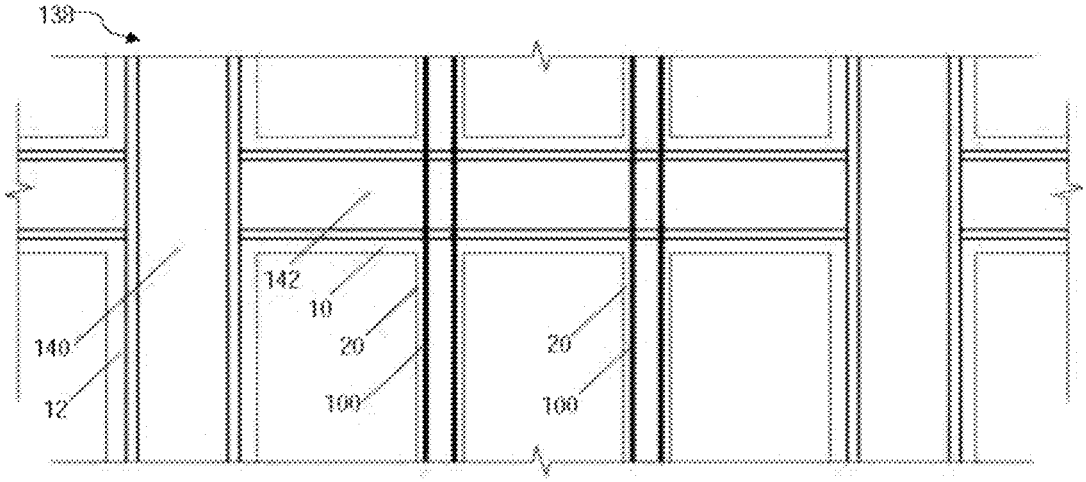
FIG. 24 shows a side view of an illustrative embodiment of concrete reinforcing structures in an RC dense column frame structure.

FIG. 24 shows a side view of an illustrative embodiment of concrete reinforcing structures in an RC dense column frame structure 138. Structure 138 utilizes concrete-encased steel. Metal beams 140 and 142 are used for frame beams 10 and frame columns 12, respectively, instead of rebar structures. The concrete for dense columns 20 may be poured up to the bottom of frame beam 10 and then metal beam 142 may be placed atop of the dense column. Metal beams 140 and 142 may be steel or other materials of similar tensile strength. Instead of concrete-encased steel, steel encased concrete may be used. Either way, frame beams 10 and frame columns 12 may have rectangular, circular, L-shaped, L-shaped, or cross-shaped cross-sections.

Figure 25:
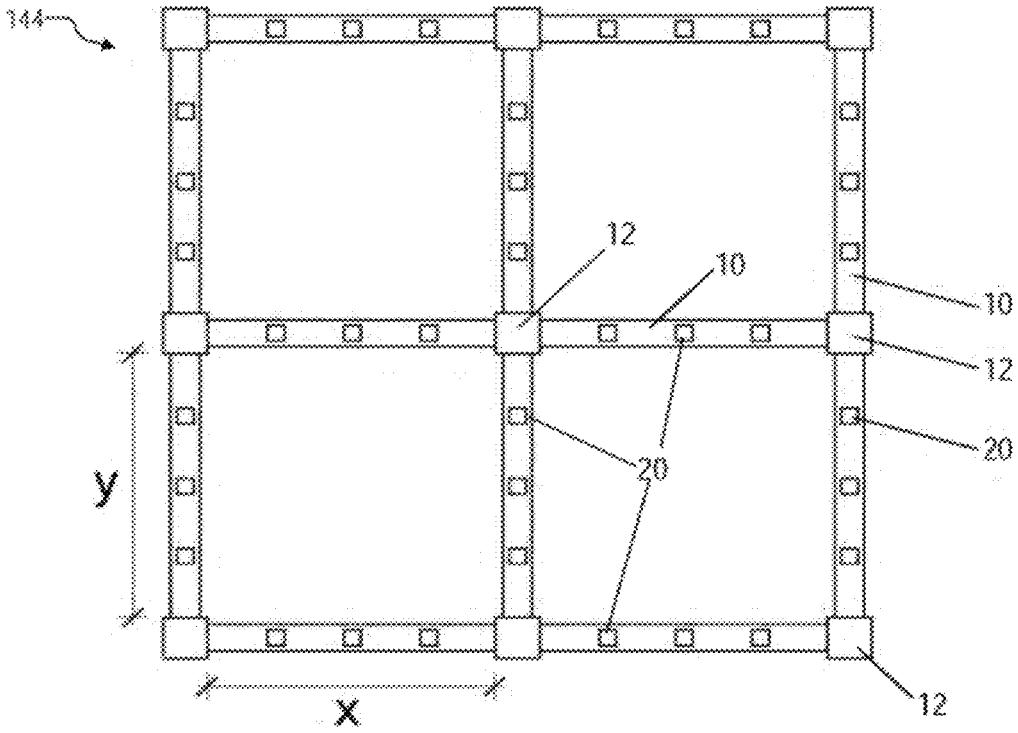
FIG. 25 shows a top view of an illustrative embodiment of a placement of dense columns in an RC dense column frame structure.

FIG. 25 shows a top view of an illustrative embodiment of a placement of dense columns 20 in a RC dense column frame structure 144. When dense columns 20 along the structure perimeter are loading bearing, horizontal distance "x" and vertical distance "y" between frame columns 12 may be increased. At the same time, additional dense columns 20 may be added within the structure perimeter.

Figure 26:
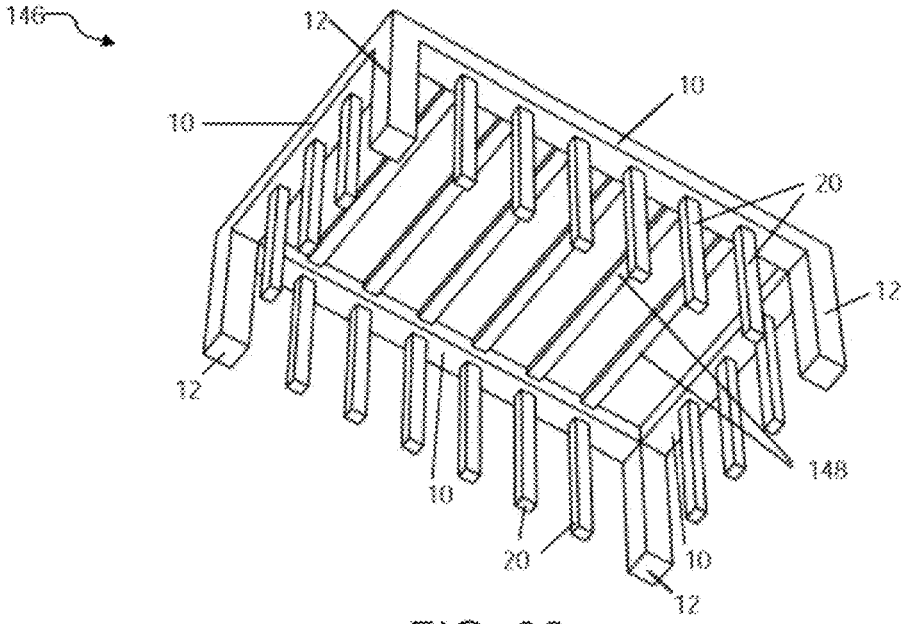
FIG. 26 shows a perspective view of an illustrative embodiment of an arrangement of dense beams in a RC dense column frame structure.

FIG. 26 shows a perspective view of an illustrative embodiment of parallel RC dense beams 148 in a RC dense column frame structure 146. Dense beams 148 have smaller cross-sections than frame beams 10 along the structure perimeter. Dense beams 148 run between opposing frame beams 10 and are aligned with dense columns 20 under the frame beams.

Figure 27:
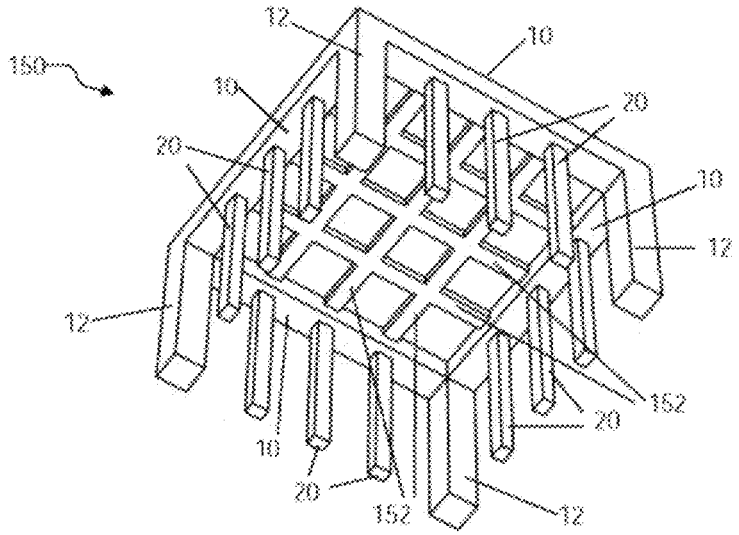
FIG. 27 shows a perspective view of an illustrative embodiment of an arrangement of dense beams in a RC dense column frame structure.

FIG. 27 shows a perspective view of an illustrative embodiment of an orthogonal grid of dense beams 152 in a RC dense column frame structure 150. Dense beams 152 have smaller cross-sections than frame beams 10 along the structure perimeter. Dense beams 152 run between opposing frame beams 10 and are aligned with dense columns 20 under the frame beams.

Figure 28:
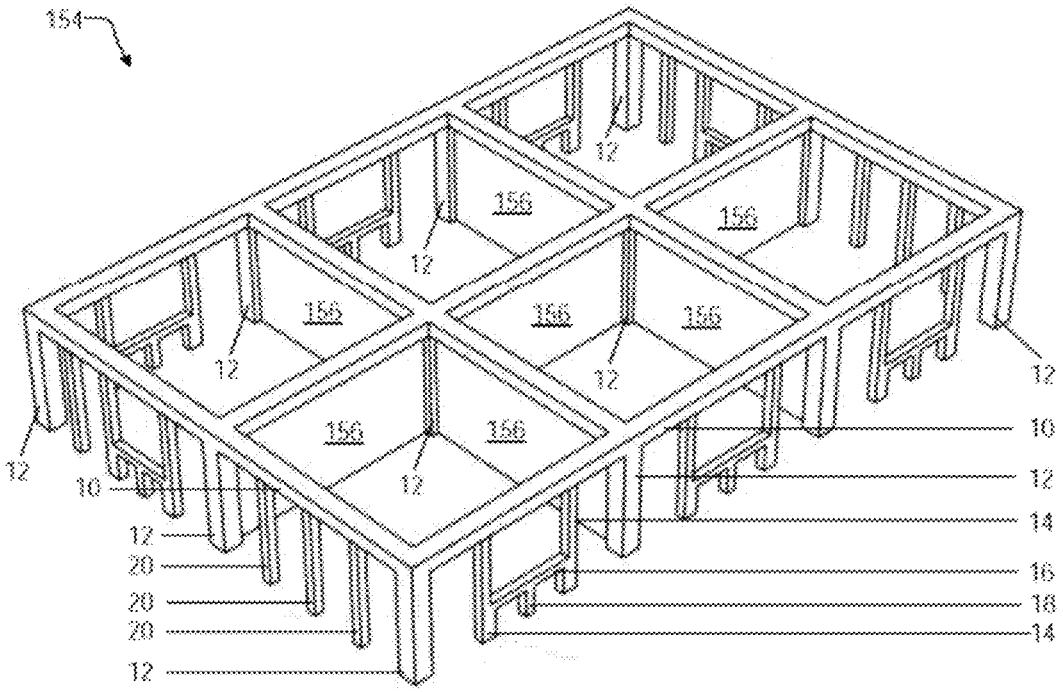
FIG. 28 shows a perspective view of an illustrative embodiment of a RC dense column frame-shear wall structure for a story in a building.

FIG. 28 shows a perspective view of an illustrative embodiment of a RC dense column frame-shear wall structure 154 for a story in a single or a multi-story building. Structure 154 is similar to structure 8 in FIG. 2 but includes RC shear walls 156. Shear walls 156 are located within the structure perimeter instead of along the structure perimeter. Shear walls 156 run under frame beams 10 and between frame columns 12.

Figure 29:
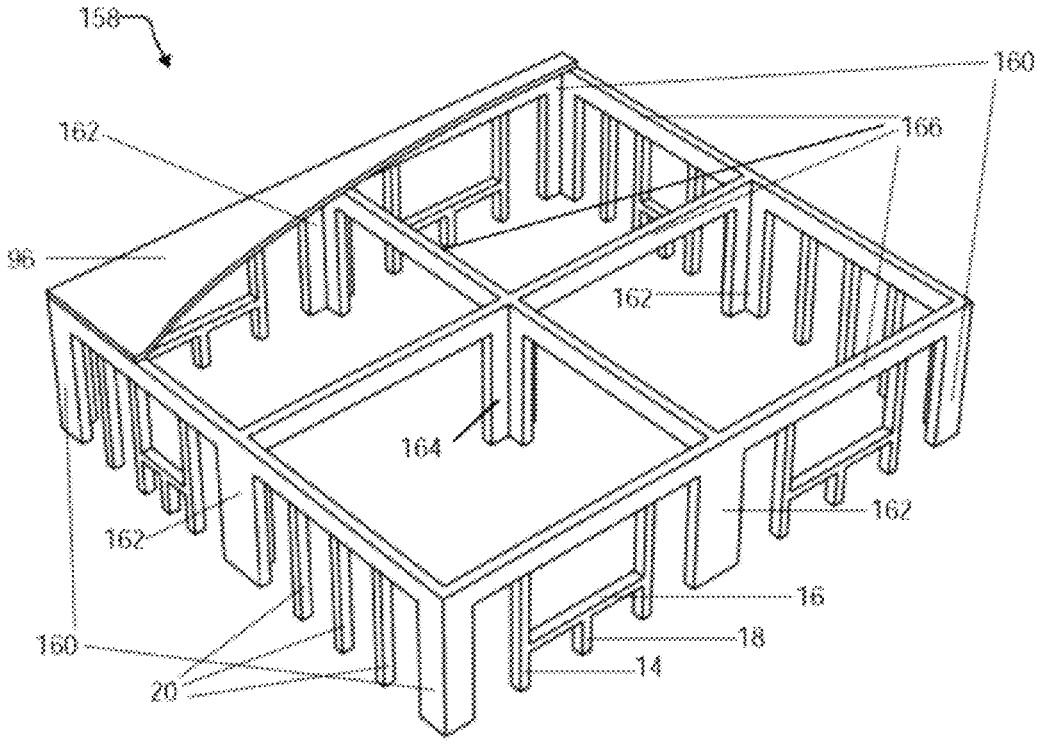
FIG. 29 shows a perspective view of an illustrative embodiment of a RC dense column frame structure with L,T, and cross shaped beams and columns for a story in a building.

FIG. 29 shows a perspective view of an illustrative embodiment of a RC dense column frame structure 158 with L-shaped frame columns 160, T-shaped frame columns 162, cross-shaped frame columns 164, and rectangular frame beams 166 for a story in a single or a multi-story building. Structure 158 is similar to structure 8 in FIG. 2 but frame columns 12 have been replaced with L-shaped frame columns 160 at the corners of the structure, T-shaped frame columns 162 along the structure perimeter, and cross-shaped frame columns 164 within the structure perimeter. Similarly, frame beams 10 have been replaced by rectangular frame beams 166.

Figure 30:
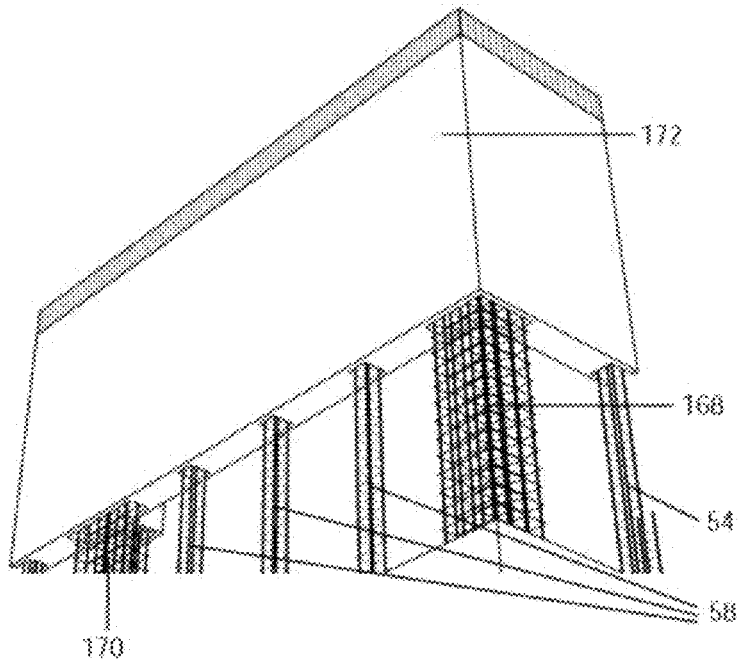
FIG. 30 shows a perspective view of an illustrative embodiment for installing a corner prefabricated wall panel for the structure of FIG. 29.

FIG. 30 shows a perspective view of an illustrative embodiment for installing a full-height L-shaped corner prefabricated wall panel 172 for RC dense column frame structure 158 of FIG. 29. Corner prefabricated wall panel 172 is hoisted into place around L-shaped frame column rebar structures 168, T-shaped frame column rebar structures 170, window column rebar structures 54, and dense column rebar structures 58. Similar to corner prefabricated wall panel 76, corner prefabricated wall panel 172 defines molds for casting L-shaped frame columns 160 (FIG. 29), T-shaped frame columns 162 (FIG. 29), window columns 14 (FIG. 29), and dense columns 20 (FIG. 29) around L-shaped frame column rebar structures 168, T-shaped frame column rebar structures 170, window column rebar structures 54, and dense column rebar structures 58, respectively. The top of corner prefabricated wall panel 172 defines a mold for casting rectangular frame beam 166 (FIG. 29) around rectangular frame beam rebar structures.

Figure 31:
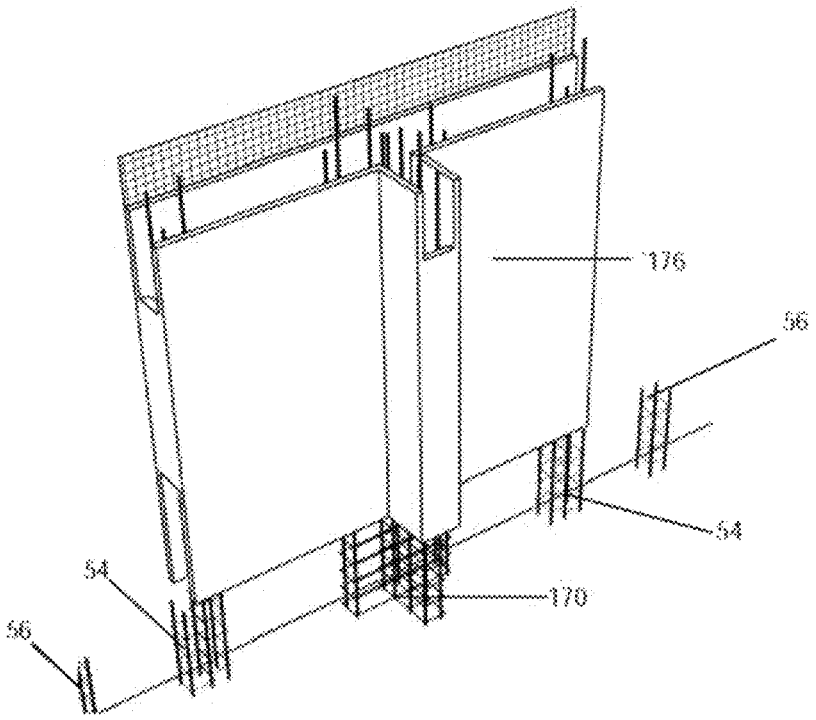
FIG. 31 shows a perspective view of an illustrative embodiment for installing a straight prefabricated wall panel for the structure of FIG. 29.

FIG. 31 shows a perspective view of an illustrative embodiment for installing a full-height straight prefabricated wall panel 176 for RC dense column frame structure 158 of FIG. 29. Straight prefabricated wall panel 176 is hoisted into place around T-shaped frame column rebar structures 170 and window column rebar structures 54. Similar to straight prefabricated wall panel 74, prefabricated wall panel 176 defines molds for casting T-shaped frame columns 162 (FIG. 29) and window columns 14 (FIG. 29) around T-shaped frame column rebar structures 170 and window column rebar structures 54, respectively. The top of straight prefabricated wall panel 176 defines a mold for casting rectangular frame beam 166 (FIG. 29) around rectangular frame beam rebar structures.

Figure 32:
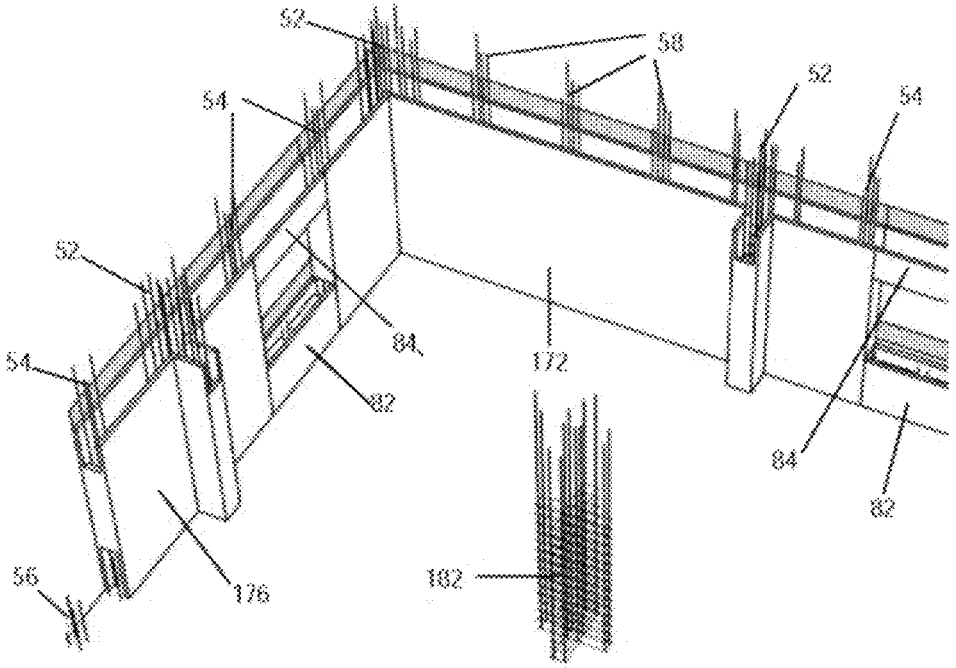
FIG. 32 shows a perspective view of an illustrative embodiment for installing lower and upper prefabricated wall panels for the structure of FIG. 29.

FIG. 32 shows a perspective view of an illustrative embodiment for installing lower prefabricated wall panel 82 and upper prefabricated wall panel 84 for RC dense column frame structure 158 of FIG. 29. Lower prefabricated wall panel 82 and upper prefabricated wall panel 84 are hoisted into place between full-height prefabricated wall panels, such as prefabricated wall panels 172 and 176. Lower prefabricated wall panel 82 defines window column molds 312 (FIGS. 66 and 67) for casting parts of lower column sections 26 (FIG. 3) of window columns 14 (FIG. 2) around short rebar cages 62 (FIG. 6), a window beam mold 310 (FIGS. 66 and 67) for casting window beam 16 (FIG. 2) around window beam rebar structure 64 (FIG. 6), a short window column mold 314 (FIGS. 66 and 67) for casting short window column 18 (FIG. 2) around short window column rebar structure 56 (FIG. 6).

Upper prefabricated wall panel 84 is fixed to adjoining prefabricated wall panels 172 and 176 above lower prefabricated wall panel 82. The top of upper prefabricated wall panel 84 defines a mold for casting rectangular frame beam 166 (FIG. 29) around rectangular frame beam rebar structure at the structure perimeter.

Figure 33:
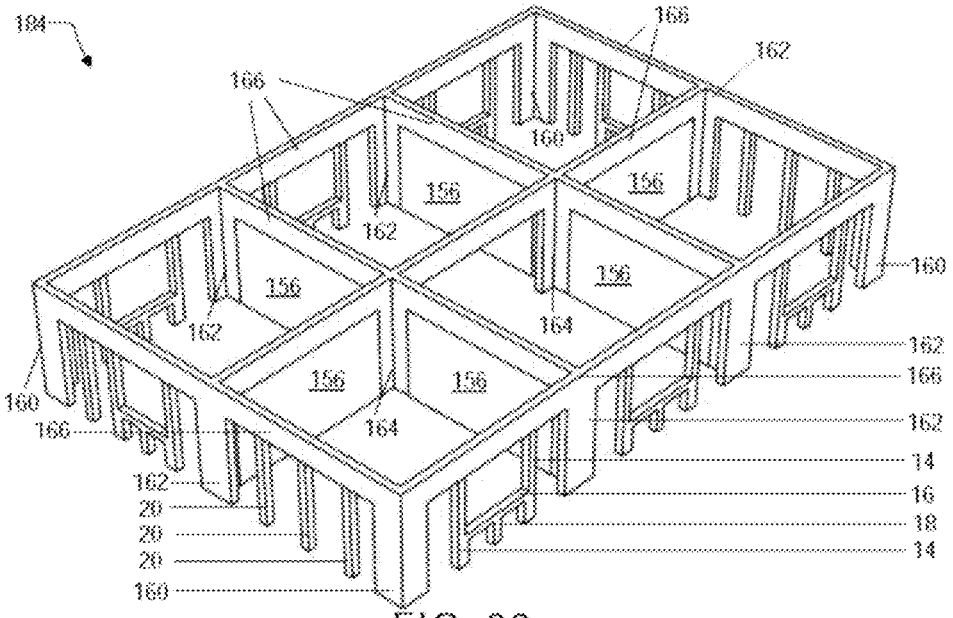
FIG. 33 shows a perspective view of an illustrative embodiment of a RC dense column frame-shear wall structure with L, T, and cross-shaped frame columns and rectangular frame beams for a story in a building.

FIG. 33 shows a perspective view of an illustrative embodiment of a RC dense column frame-shear wall structure 184 with L-shaped columns 160, T-shaped columns 162, cross-shaped columns 164, and rectangular frame beams 166 for a story in a single or a multi-story building. Structure 184 is similar to structure 158 of FIG. 29 but includes RC shear walls 156. Shear walls 156 are located within the structure perimeter instead of along the structure perimeter. Shear walls 156 runs under rectangular frame beams 166 and between opposing frame columns, such T-shaped frame column 162 and cross-shaped frame column 164.

Figure 34:
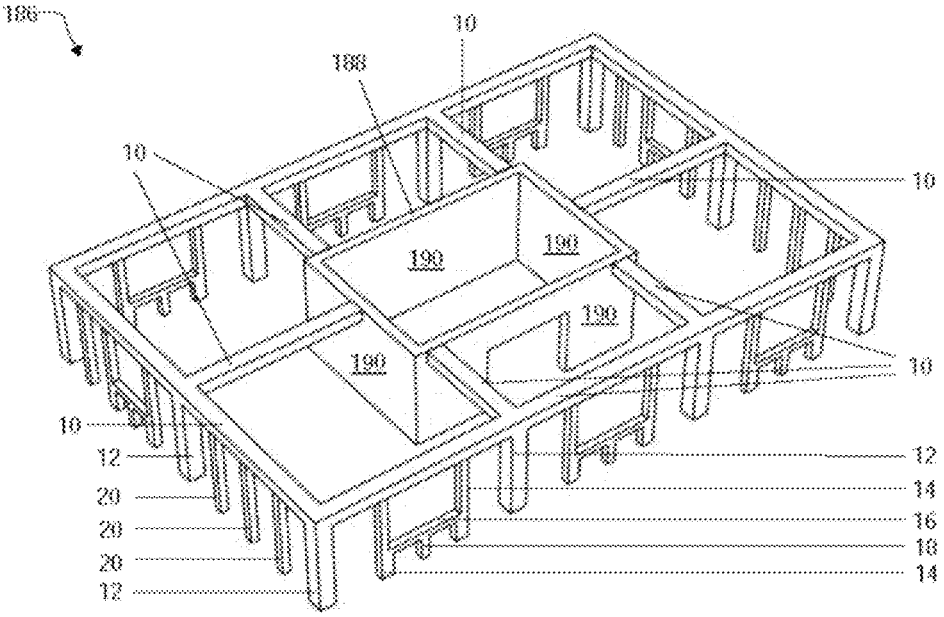
FIG. 34 shows a perspective view of an illustrative embodiment of a RC dense column frame-shear wall structure with an interior shear wall structure for a story in a building.

FIG. 34 shows a perspective view of an illustrative embodiment of a dense column frame-shear wall structure 186 with a RC shear wall structure 188 for a story in a single or multi-story building. Structure 186 is similar to structure 8 of FIG. 2 but interior frame beams 10 are connected to shear wall structure 188 within the structure perimeter. Shear wall structure 188 may be rectangular with four adjoining RC shear walls 190. One or more openings, such as doors and windows, may be defined in one or more shear walls 190.

Figure 35:
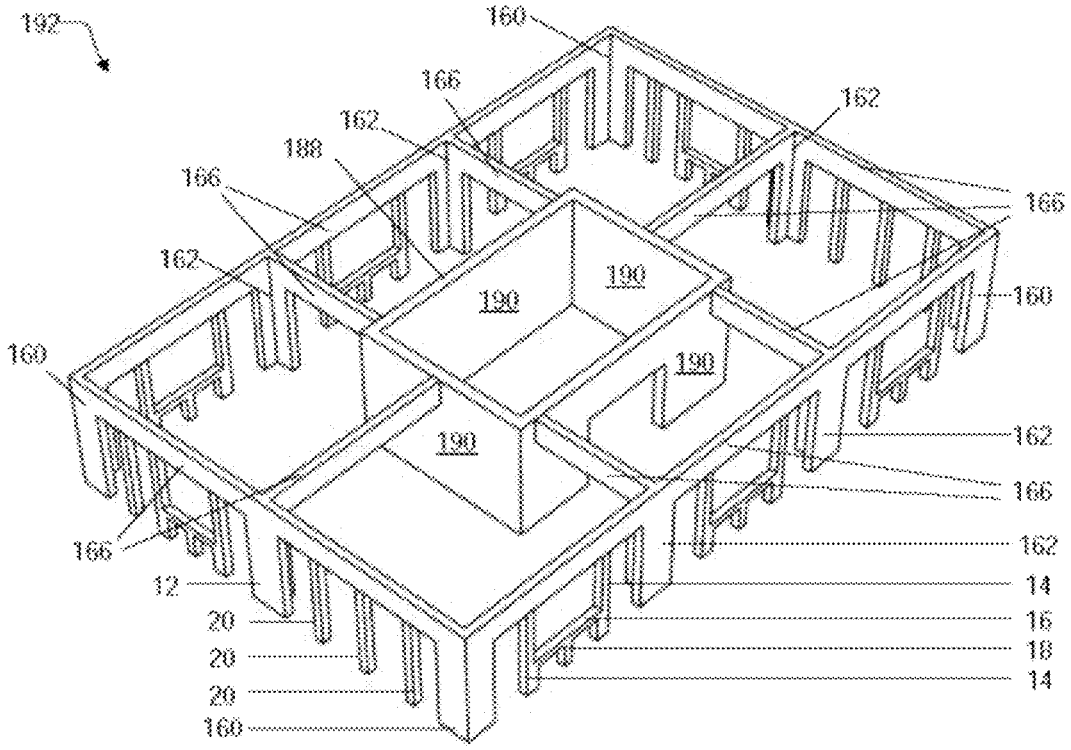
FIG. 35 shows a perspective view of an illustrative embodiment of a RC dense column frame-shear wall structure with L, T, and cross-shaped frame columns, rectangular frame beams, and an interior shear wall structure for a story in a building.

FIG. 35 shows a perspective view of an illustrative embodiment of a dense column frame-shear wall structure 192 with L-shaped frame columns 160, T-shaped frame columns 162, cross-shaped frame columns 164, rectangular frame beams 166, and RC shear wall structure 188 for a story in a single or multi-story building. Structure 192 is similar to structure 158 of FIG. 29 but interior frame beams 166 are connected to interior shear wall structure 188.

Prefabricated Wall Panels

In one or more embodiments of the present disclosure, a prefabricated wall panel includes foam boards and foam glass panels that are sized and arranged to define molds for casting RC columns and beams. Once the concrete dries, the prefabricated wall panel becomes locked in and integral with the concrete structures.

Foam boards by themselves have many shortcomings. However, when foam boards are protected behind foam glass panels, the resulting prefabricated wall panel can meet government high-rise regulations for weather, wind load, impact resistance, and fire protection.

The prefabricated wall panel comes with an exterior wall finish so scaffolding work traditionally performed to apply the exterior wall finish may be eliminated. The quality of the exterior wall finish is improved as the prefabricated wall panel is produced in a factory under controlled conditions. The potentially higher material cost of the prefabricated wall panel may be offset by volume production and ease of installation, including the reduced use of heavy equipment during construction.

Figure 36:
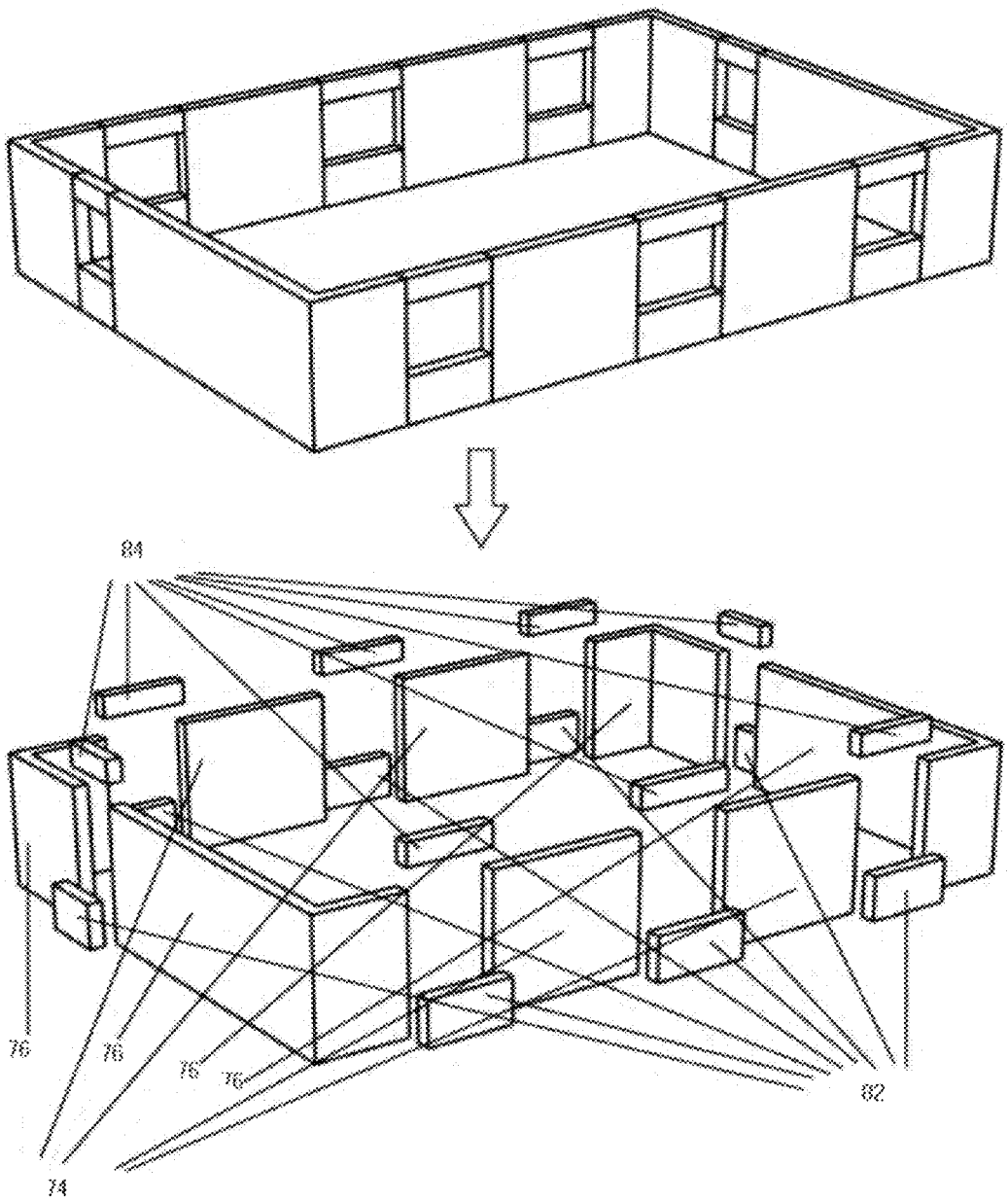
FIG. 36 shows a perspective view of an illustrative embodiment of full-height and less-than-full height prefabricated wall panels that make up a story on a single or multi-story building.

FIG. 36 shows a perspective view of an illustrative embodiment of full-height and less-than-full height prefabricated wall panels that make up a story on a single or multi-story building. Full-height prefabricated wall panels make up the walls between window openings. Full-height prefabricated wall panels may be straight (e.g., prefabricated wall panels 74 as shown), L-shaped (e.g., prefabricated wall panels 76 as shown), [-shaped, Z-shaped, W-shaped, or another shape depending on the building design. One or more portion of a full-height prefabricated wall panel may protrude outward or recess inward. The protrusions and recesses may be curved or rectilinear. Less-than-full height upper prefabricated wall panels make up the walls above window and door openings. Less-than-full height lower prefabricated wall panels make up the walls below window openings. The upper and the lower prefabricated wall panels may be straight (e.g., prefabricated wall panels 82 and 84 as shown), polygonal, curved, or another shape depending on the window design.

FIGS. 37 to 42 show an illustrative embodiment of a method to construct a prefabricated wall panel, such as corner prefabricated wall panel 76. Other prefabricated wall panels may be similarly constructed, such as straight prefabricated wall panel 74 (FIG. 10), lower prefabricated wall panel 82 (FIG. 12), upper prefabricated wall panel 84 (FIG. 12), corner prefabricated wall panel 172 (FIG. 30), and straight prefabricated wall panel 176 (FIG. 31).

Figure 37:
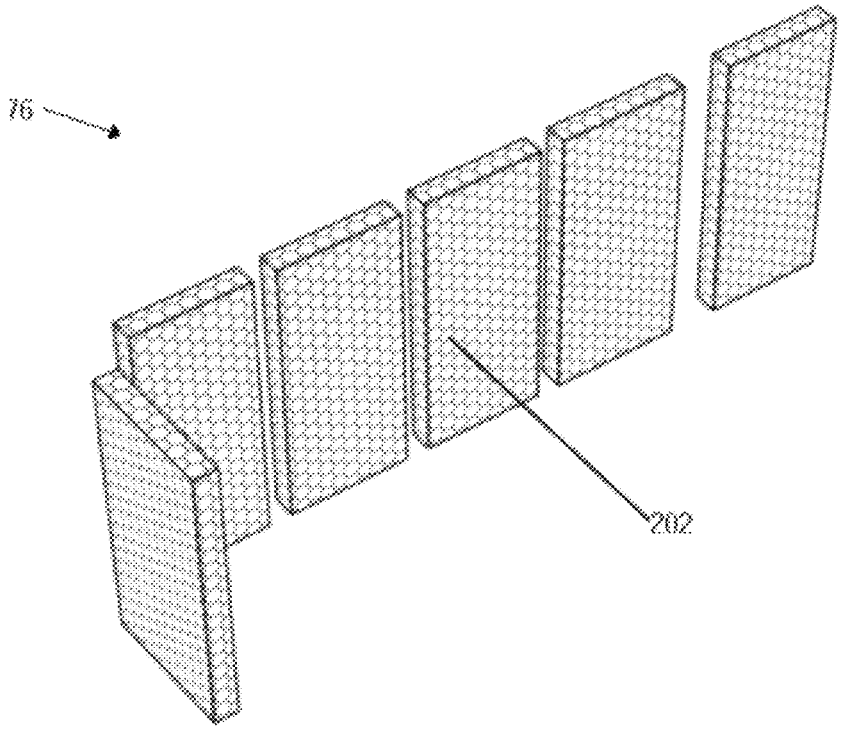
FIG. 37 shows a perspective view of an illustrative embodiment of foam boards arranged according to the desired shape of a prefabricated wall panel.
Figure 45:
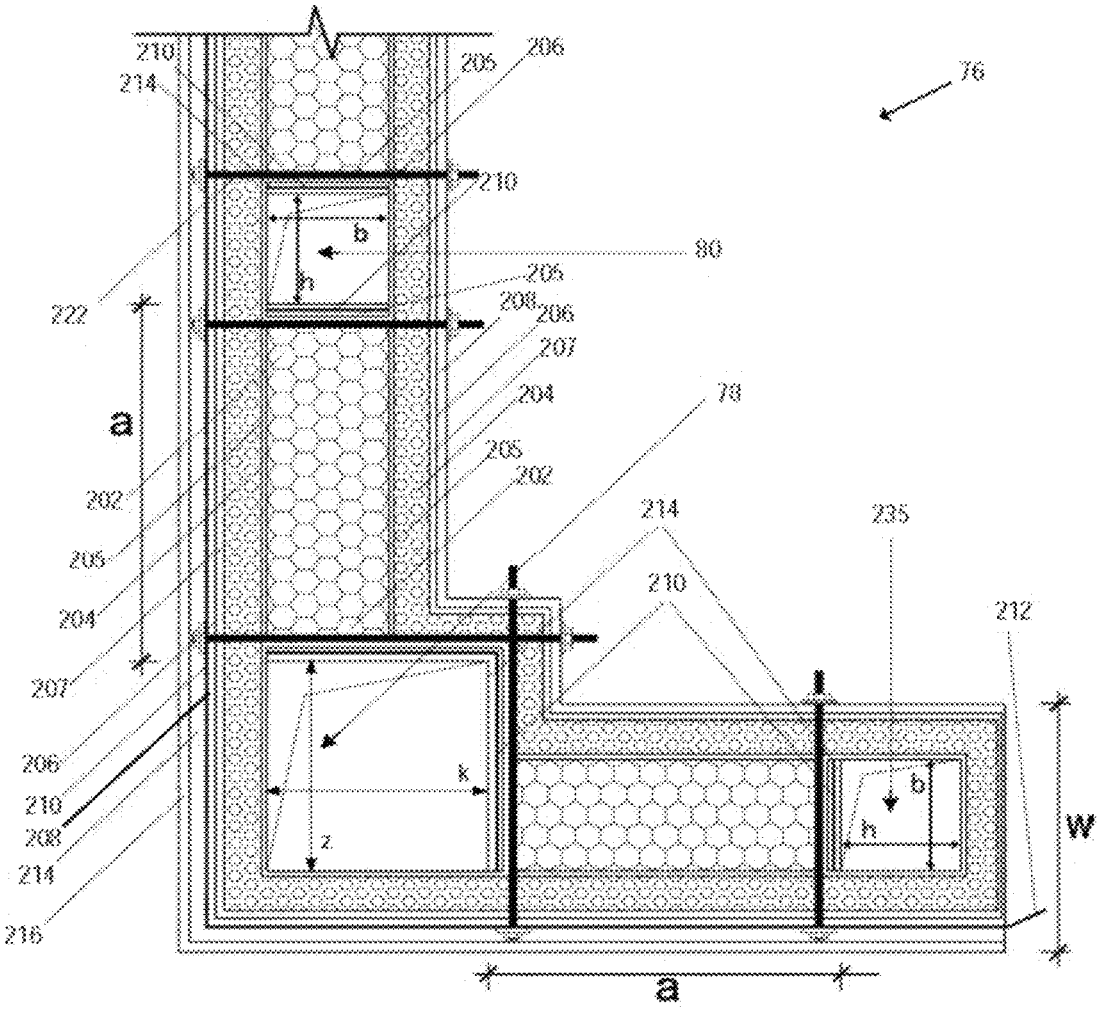

FIG. 37 shows a perspective view of an illustrative embodiment of foam boards 202 aligned along the length of prefabricated wall panel 76. Foam boards 202 provide thermal insulation for the prefabricated wall panel. Foam boards 202 are spaced apart according to the widths of frame column molds 78 (FIG. 45), dense column molds 80 (FIG. 45), and window column molds 235 (FIG. 45). The thickness of foam boards 202 is sized according to the depth of dense column molds 80 and window column molds 235. Foam boards 202 may be EPS boards. In an embodiment, an interface agent may be applied over all the surfaces of foam boards 202. The interface agent can help to waterproof foam boards 202 and improves bonding to foam boards 202.

Figure 38:
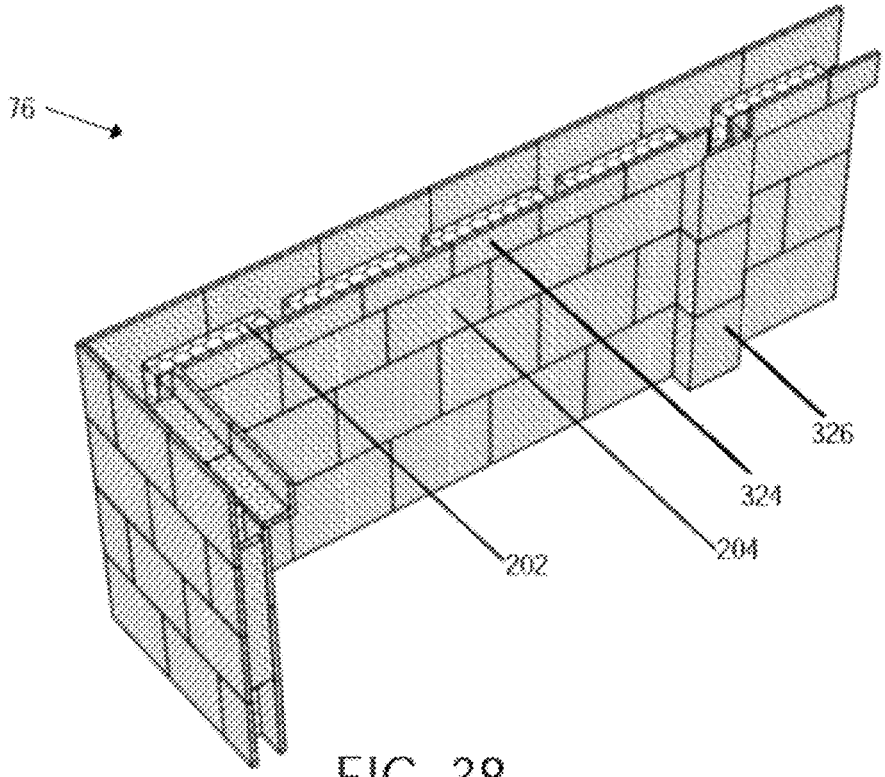
FIG. 38 shows a perspective view of an illustrative embodiment of cellular or foam glass panels bonded to the foam boards of FIG. 37.
Figure 44:
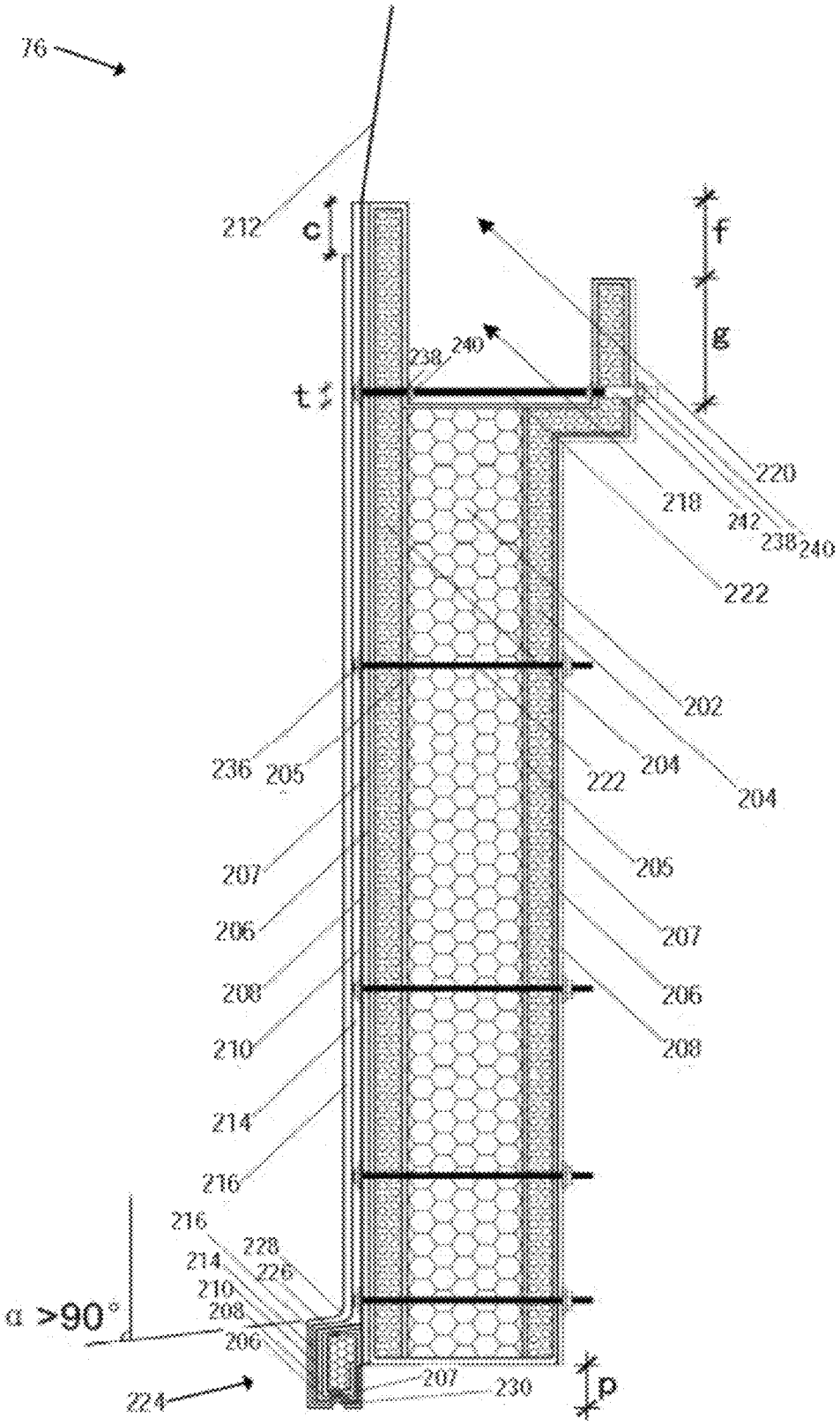
FIGS. 44 and 45 show side and top cross-sectional view of an illustrative embodiment of a prefabricated wall panel.

FIG. 38 shows a perspective view of an illustrative embodiment of foam glass panels 204 bonded to foam boards 202. Foam glass panels 204 can provide thermal insulation to the prefabricated wall panel. Cement agent 205 (FIG. 44) is applied to foam glass panels 204, which are then bonded to the two major surfaces of foam boards 202 and the lateral surfaces of foam boards 202 at the two ends. The top of foam glass panels 204 extend over foam boards 202 to form a frame beam mold 218 (FIG. 44). The top interior side of foam glass panels 204 may be shaped as an L-shaped angle 324 to form frame beam mold 218. The top exterior side of foam glass panels 204 may be taller than the top interior side to form a floor slab mold 220 (FIG. 44). Foam glass panels 204 may be shaped like a U-channel 326 about a space between two foam boards 202 to form a frame column mold 78 (FIG. 45).

Figure 39:
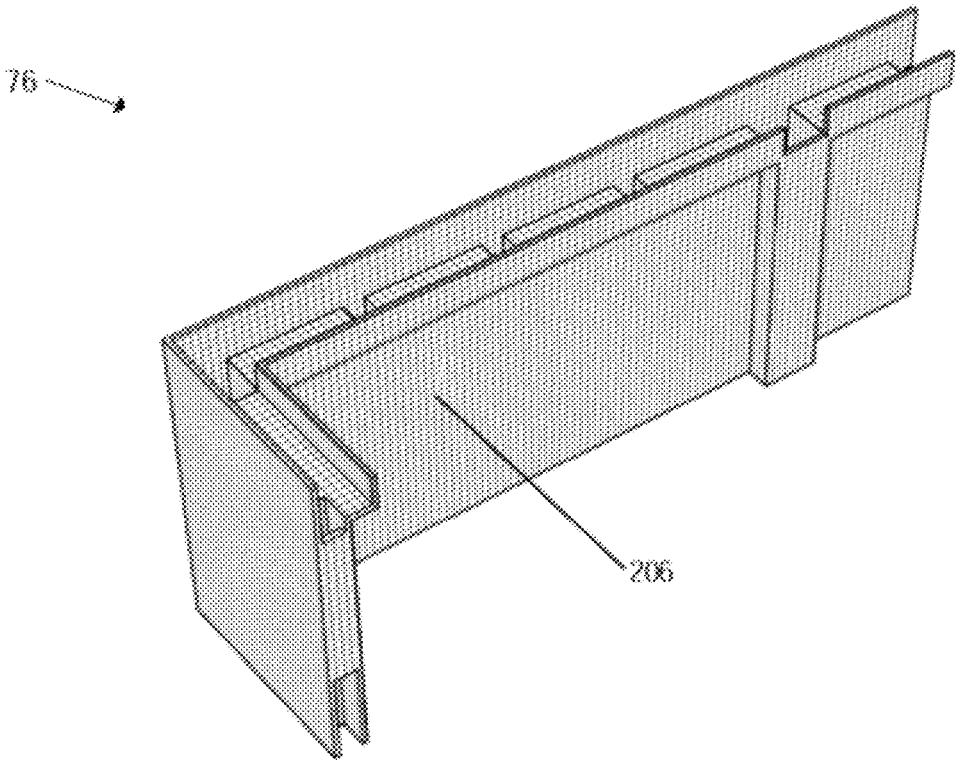
FIG. 39 shows a perspective view of an illustrative embodiment of a fabric mesh wrapped over the foam glass panels and the foam boards of FIG. 38.

FIG. 39 shows a perspective view of an illustrative embodiment of a fabric mesh 206 wrapped over foam glass panels 204 and foam boards 202. Fabric mesh 206 may be a fiberglass mesh. Fabric mesh 206 covers all the exposed surfaces of foam glass panels 204 and foam boards 202, including the interior surfaces of the foam glass panels and the foam boards. Fabric mesh 206 may be dipped in adhesive 207 (FIG. 442) and then applied to foam glass panels 204 and foam boards 202. Alternatively adhesive 207 is applied to the exposed surface of foam glass panels 204 and foam boards 202 and fabric mesh 206 is placed on adhesive 207. Adhesive 207 may be an elastic surface adhesive.

Figure 40:
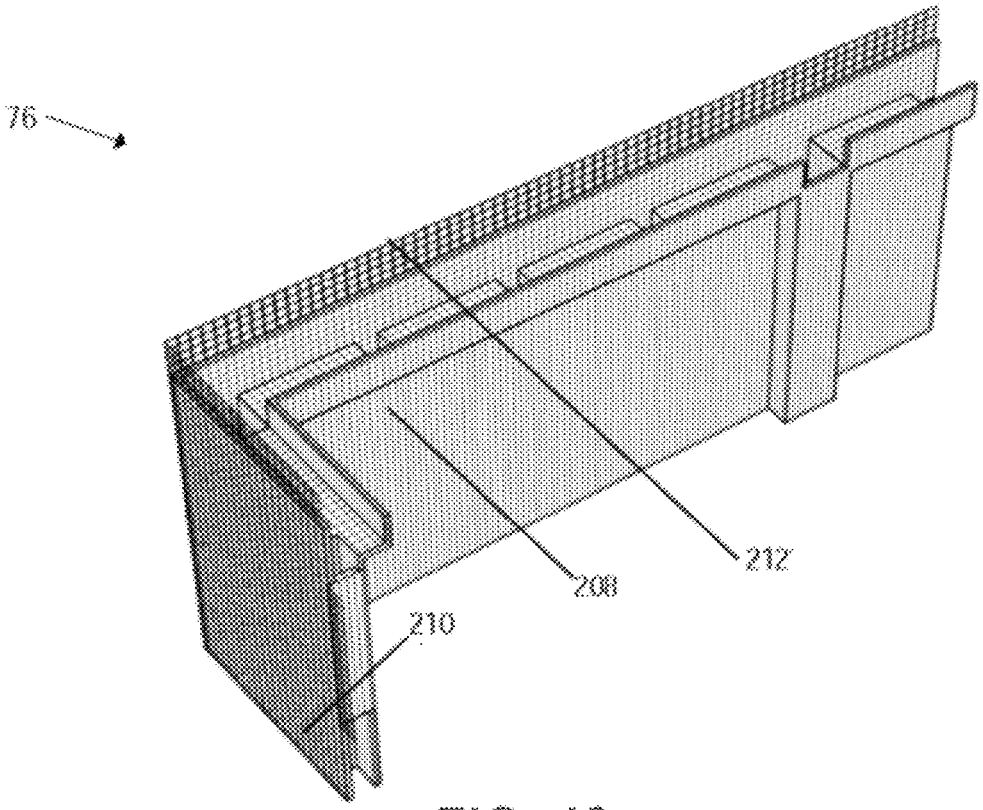
FIG. 40 shows a perspective view of an illustrative embodiment of a wire mesh applied to the wall of FIG. 39.

FIG. 40 shows a perspective view of an illustrative embodiment of a wire mesh 210 applied to the exterior side of the wall. An adhesive or mortar 208 may applied to the inner side of the wall, and an adhesive 208 may be applied to the exterior side of the wall. Adhesive 208 may be an elastic surface adhesive, and mortar 208 may be a cement mortar. Wire mesh 210 is placed on the exterior side of the wall. In an example embodiment, the bottom of wire mesh 210 and the bottom of mesh fabric 206 can be tied by wires. The top 212 of wire mesh 210 extends over the top of foam glass panels 204. The top 212 of wire mesh 210 helps to prevent materials from falling over during construction and concrete from overflowing down the sides of the structure during pouring. The top 212 of wire mesh 210 may also be folded over and onto the concrete for floor slab 96 (FIG. 17) so the wire mesh is fixed to a loadbearing element to help support any exterior wall finish fixed to the wire mesh. Wire mesh 210 is stretched in both the vertical and the horizontal directions to pretension the wire mesh. Bolts 222 (FIGS. 42 to 45) are installed through the wall and connected to wire mesh 210. Bolts 222 help to hold the wall together when concrete is poured into the various molds.

Figure 41:
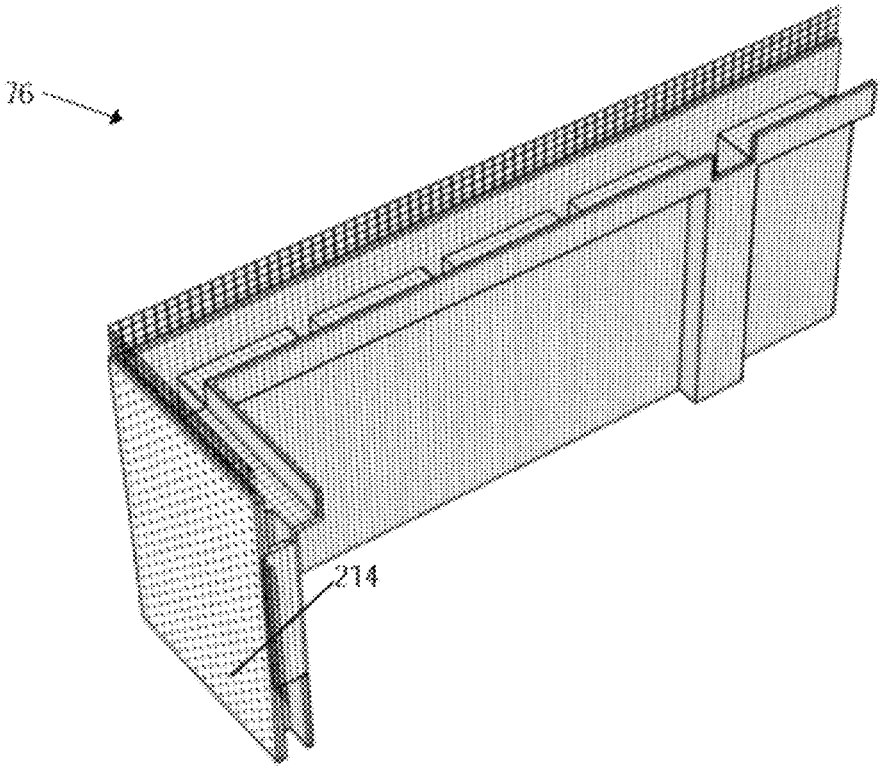
FIG. 41 shows a perspective view of an illustrative embodiment of a mortar applied to wall of FIG. 40.

FIG. 41 shows a perspective view of an illustrative embodiment of a mortar 214 applied to the exterior side of the wall. Mortar 214 may be a plastering or cement mortar. Mortar 214 may include, for example, additives such as plastic and fibers, and aggregates such as yellow sand, quartz sand, and fine stones. To prepare for the exterior finish, mortar 214 may be scratched to provide a grooved surface. Once mortar 214 dries, wire mesh 210 remains under tension to improve shock resistance, ensuring a flat exterior, and provide strength along all directions.

Figure 42:
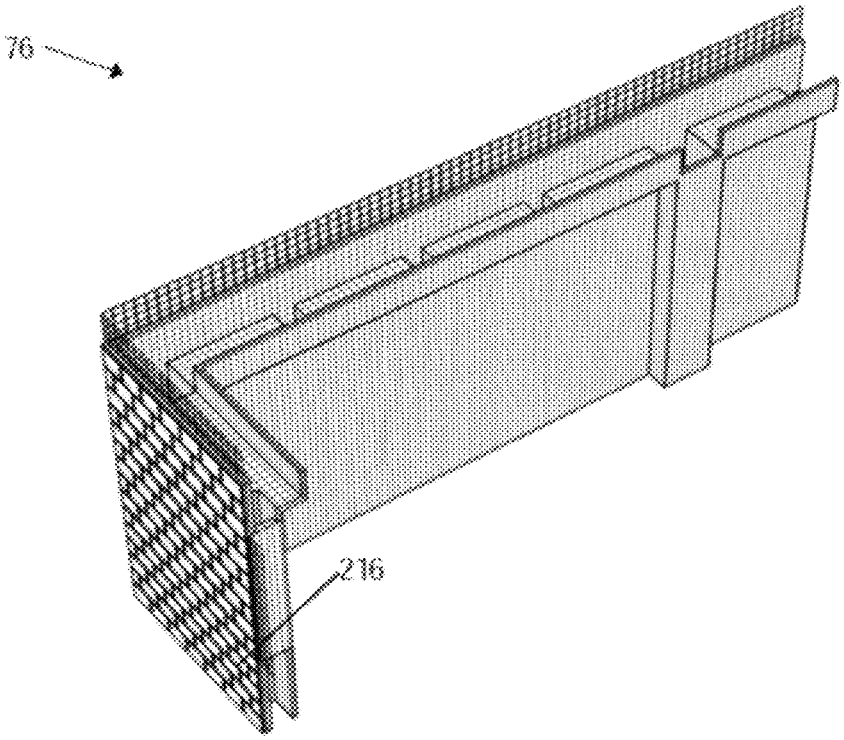
FIG. 42 shows a perspective view of an illustrative embodiment of an exterior finish applied to the wall of FIG. 41.
Figure 43:
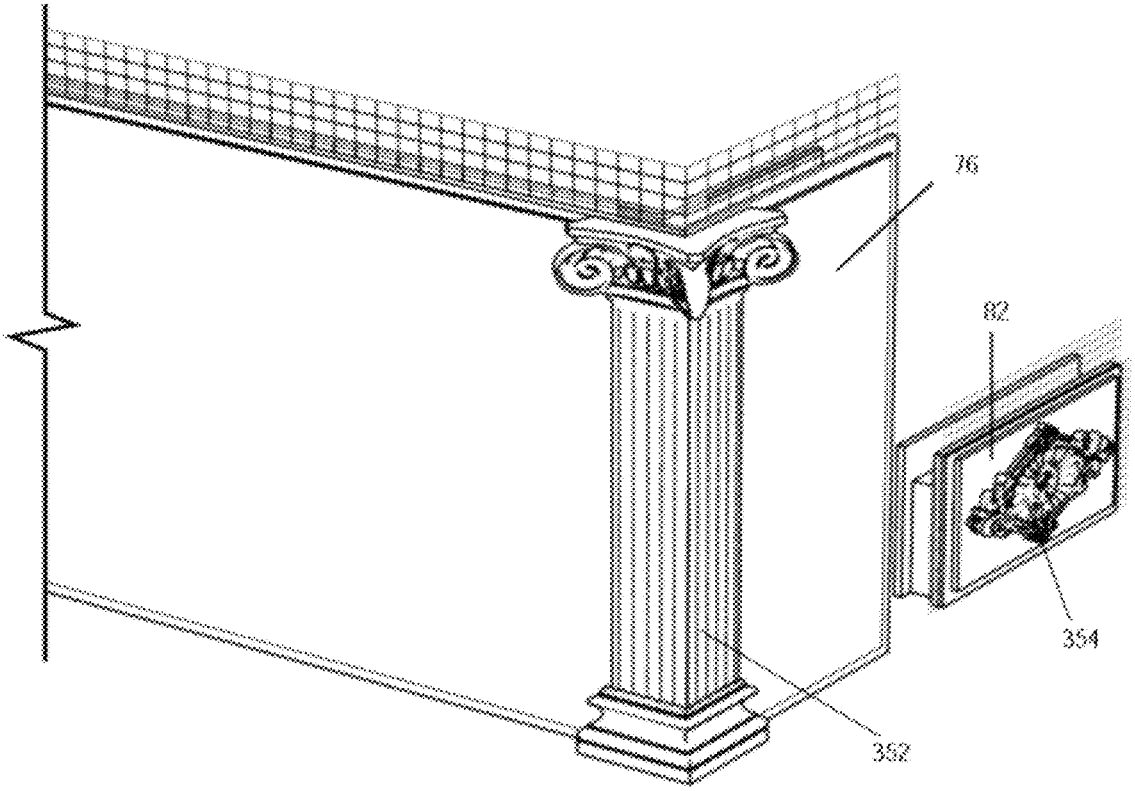
FIG. 43 shows a perspective view of an illustrative embodiment of corner and lower prefabricated wall panels with exterior decorative elements.

FIG. 42 shows a perspective view of an illustrative embodiment of an exterior finish 216 applied to the exterior side of the wall. Non-limiting examples of exterior finish 216 may be a coated finish, a bonded finish, or an anchored finish. Coated finishes include coating, chipped marble finish, or granitic plaster. Bonded finishes include exterior wall tiles, stones, and mosaics. The proper base coat is first applied to the exterior side of the wall before exterior finish 216. Anchored finishes include metal and stone curtain walls. Decorative features, such as reliefs, faux columns, or cornice lines, may be constructed out of foam, such as EPS, and glued to the outer surface of the wall. Fabric mesh 206 with adhesive 207 is applied over the decorative features and the surrounding area of the wall, which is then coated with exterior finish 216. FIG. 43 shows a perspective view of an illustrative embodiment of a corner prefabricated wall panel 76 with a column 352 and a lower prefabricated wall panel 82 with a relief 354.

FIGS. 44 and 45 show side and top cross-sectional view of an illustrative embodiment of prefabricated wall panel 76. Referring to FIG. 42, the top of prefabricated wall panel 76 includes a frame beam mold 218 for frame beams 10 (FIG. 2) and a floor slab mold 220 for floor slab 96. The top of the exterior side of preformed wall panel 76 is taller than the top of the interior side of the prefabricated wall panel by a thickness "f" of floor slab 96. Frame beam mold 218 has a height "g" of frame beam 10. Bolts 222 in frame beam mold 218, only one of which is visible, are located above the bottom of the frame beam mold by a distance "t," which provides a protective layer of concrete for horizontal rebar structure 88 (FIG. 13) for frame beam 10 against possible exposure to corrosion. Additional bolts 222 pass through prefabricated wall panel 76 in other locations.

An architrave 224 extends downward from the bottom of the exterior side of prefabricated wall panel 76 by a distance "p." The top of exterior finish 216 is below the top of the exterior side of prefabricated wall panel 76 by a distance "c," which is the same as distance p to accommodate an architrave from an upper prefabricated wall panel. Architrave 224 prevents water from entering the joint between two prefabricated wall panels. Architrave 224 may be formed with a core 226 of foam or foam glass bonded by adhesive 207 to wire mesh 210 of prefabricated wall panel 76, and then covered by its own fabric 206, adhesive or mortar 208, and wire mesh 210. The two ends of fabric mesh 206 and wire mesh 210 of architrave 224 are connected to wire mesh 210 of prefabricated wall panel 76. Mortar 214 and exterior finish 216 from prefabricated wall panel 76 extend down and wrap around architrave 224. The corner between prefabricated wall panel 76 and architrave 224 may include a fillet 228. The top of architrave 224 may be sloped to form an angle $\alpha>90°$ with prefabricated wall panel 76. The bottom of architrave 224 may include a semicircular concave groove that forms a drip line 230. Fillet 228 and drip line 230 may be waterproofed, for example, by applying waterproof paint or asphalt. If exterior wall tiles are used for exterior finish 216, round exterior wall tiles may be applied over architrave 224. Architrave 224 may be an architectural element that enriches the outer appearance of the exterior wall.

Referring to FIG. 45, the sides of frame column mold 78, dense column mold 80, and window column mold 235 may be covered by cement agent 205 and mesh fabric 206. The two sides of each mold that face foam boards 202 may be reinforced by wire mesh 210 and mortar 214. Bolts 222 below frame beams 10 are located closed to the two reinforced sides of each mold, directly contacting cement agent 205 but not entering the mold.

Figure 46:
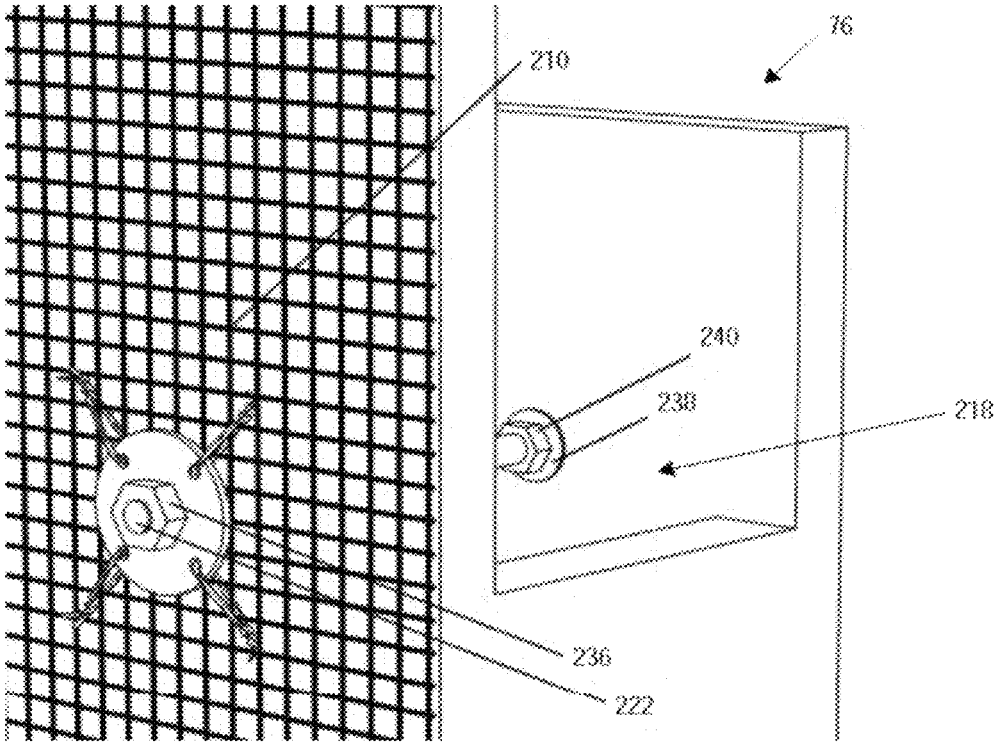
FIG. 46 shows a perspective view of an illustrative embodiment of a bolt that passes through a prefabricated wall panel.

FIG. 46 shows a perspective view of an illustrative embodiment of a bolt 222 that passes through mold 218 for frame beam 10. The exterior end of bolt 222 uses a nut 236 integrated with a washer. The washer portion of nut 236 defines four holes, which are tied by wires to wire mesh 210 to connect the bolt to the wire mesh.

Figure 47:
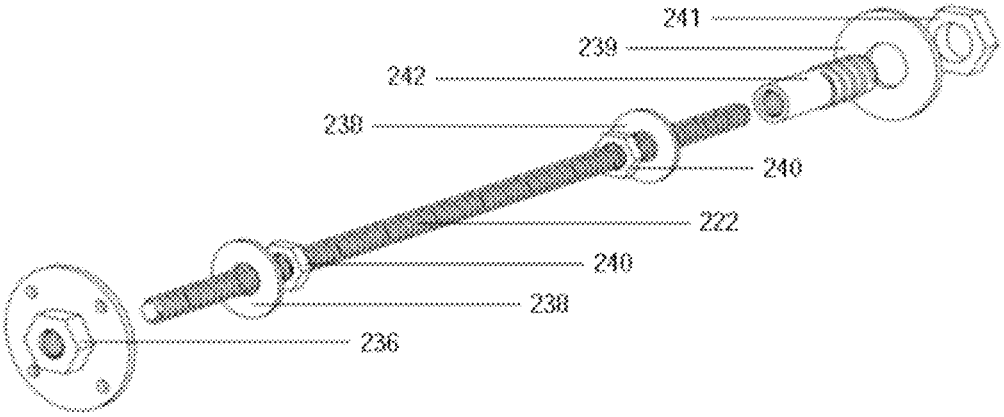
FIG. 47 shows an exploded view of an illustrative embodiment of the bolt of FIG. 46.

FIG. 47 shows an exploded view of an illustrative embodiment of bolt 222 that passes through a mold, such as mold 218, to be locked to concrete. Referring to both FIGS. 46 and 47, the shank of bolt 222 has two sets of washers 238 and nuts 240, each abutting an interior side of mold 218. A sleeve 242 fits on the interior end of bolt 222. Sleeve 242 has interior threads that match the threads of bolt 222, exterior threads that match the threads of a nut 241, and a head (not visible) for receiving and being turned by a screwdriver. Sleeve 242 is secured by washer 239 and nut 241 against the interior side of prefabricated wall panel 76. As bolt 222 passes through a mold, its ends should not be exposed to the surroundings. After the concrete dries, exposed nuts 241, washers 239, and sleeves 242 may be removed, and the hole they leave behind may be patched. Bolts 222 that do not pass through any mold are not locked to concrete and may be removed from the prefabricated wall panel for reuse after the concrete cures so they do not need sleeve 242. Each of these bolts 222 is secured by washers 238 and nuts 240 at their two ends against the exterior and the interior sides of prefabricated wall panel 76 as shown in FIGS. 44 and 45.

Figure 48:
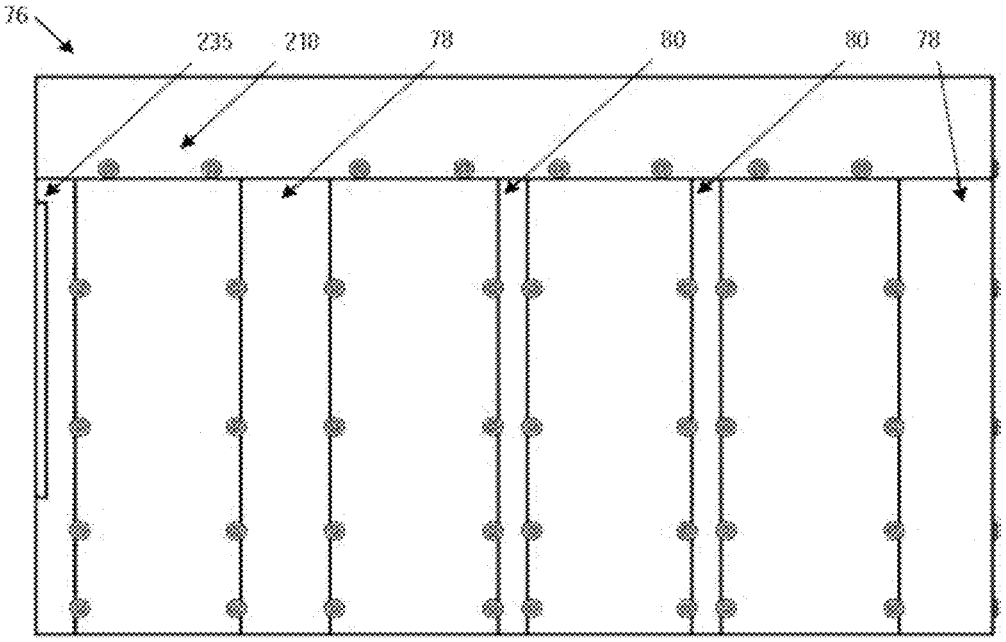
FIG. 48 shows a side view of an illustrative embodiment of the placement of bolts in a prefabricated wall panel.

FIG. 48 shows a side view of an illustrative embodiment of the placement of bolts 222 relative to frame column molds 78, dense column molds 80, and window column mold 235 in prefabricated wall panel 76. Bolts 222 are placed closely against the interior sides of each column mold without passing through the column mold. Bolts 222 are aligned vertically and the number of bolts increases near the bottom to support the weight of concrete poured into the column molds. Also shown in frame beam mold 218 are bolts 222 that are located near but spaced above the bottom of the frame beam mold.

Figure 49:
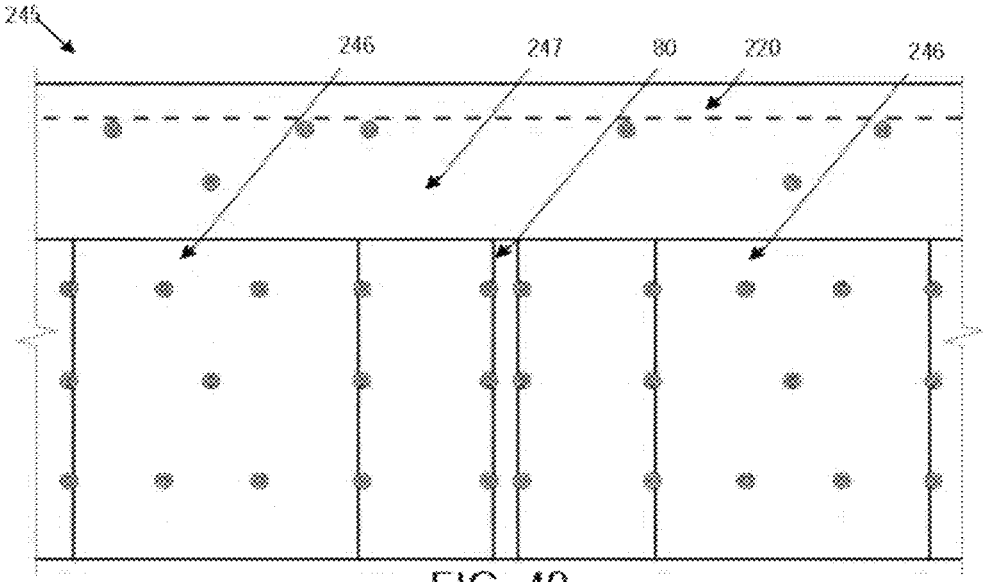
FIG. 49 shows a side view of an illustrative embodiment of a prefabricated wall panel with molds for shear walls and a stiffening beam connecting the shear walls.

FIG. 49 shows a side view of an illustrative embodiment of a prefabricated wall panel 245 with shear wall molds 246 for forming shear walls, a stiffening beam mold 247 for a stiffening beam connecting the shear walls, floor slab mold 220, and a dense column mold 80. For each shear wall mold 246, bolts 222 are placed closely against the interior sides of the shear wall mold, and additional bolts also pass through the shear wall mold. For stiffening beam mold 247, a row of bolts 222 is spaced just below the bottom of floor slab mold 220, and other bolts also pass through elsewhere in the stiffening beam mold. Due to the weight of concrete in the shear walls, additional stiffeners may be added to strength prefabricated wall panel 245.

Figure 50:
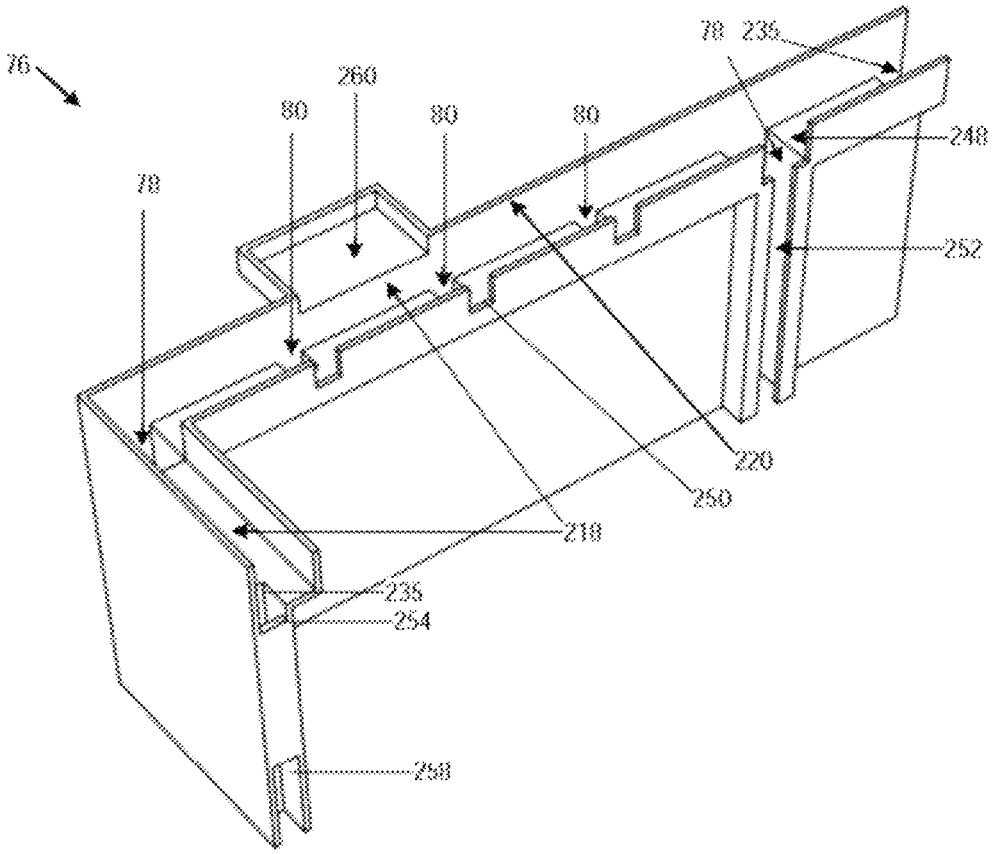
FIG. 50 shows a perspective view of an illustrative embodiment of a prefabricated wall panel.
Figure 70:
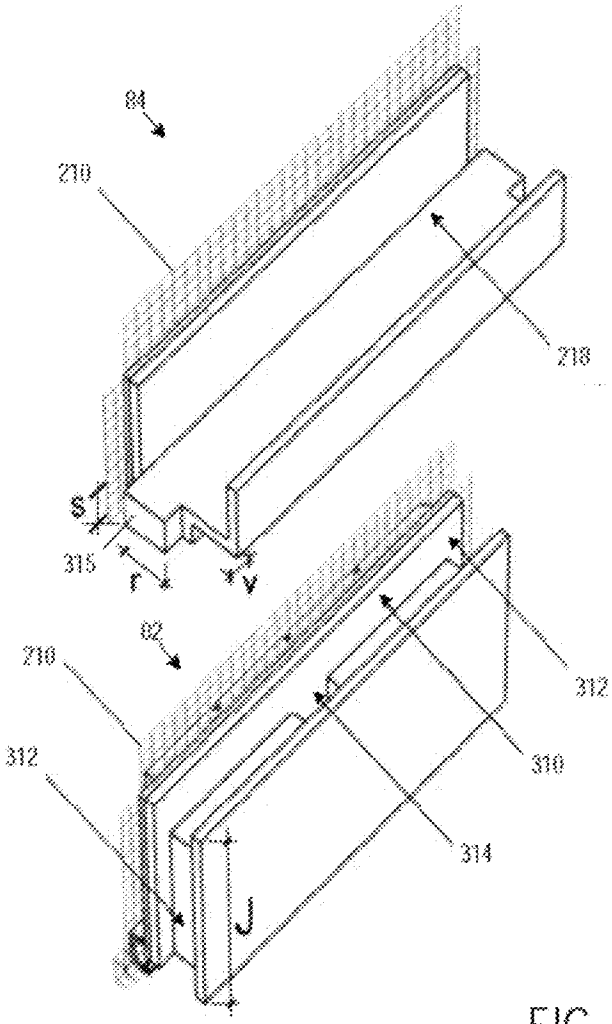
FIGS. 69 and 70 show perspective front and back views of an illustrative embodiment of lower and upper prefabricated wall panels.
Figure 69:
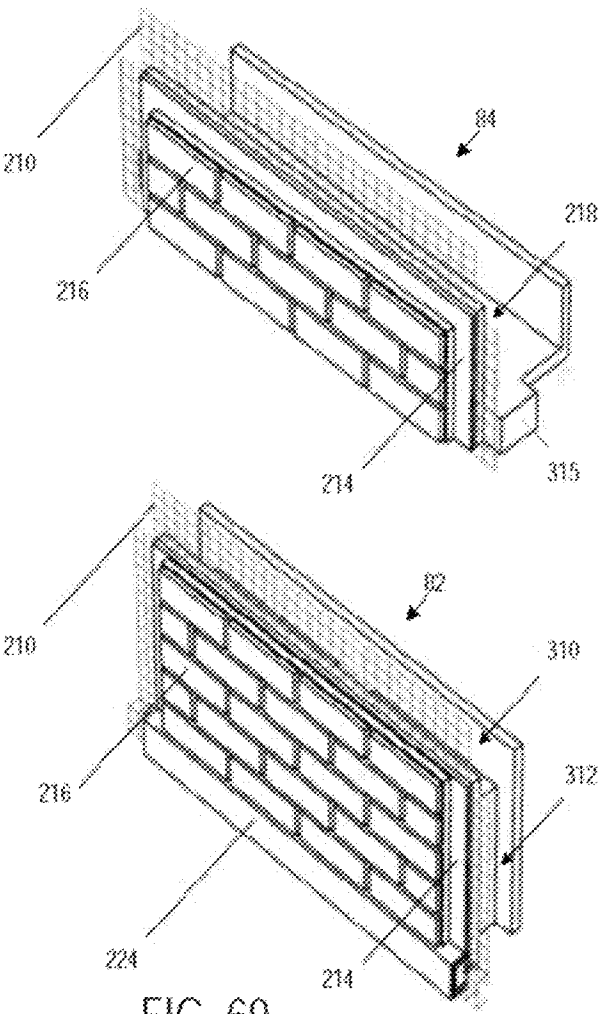

FIG. 50 shows a perspective view of an illustrative embodiment of prefabricated wall panel 76. When an interior frame beam 10 (FIG. 2) intersects a peripheral frame beam 10 in prefabricated wall panel 76, a rectangular notch 248 is defined at the top of the interior side of the prefabricated wall panel to receive the interior frame beam. When a dense beam 148 or 152 (FIG. 26 or 27) intersects peripheral frame beam 10 in prefabricated wall panel 76, a rectangular notch 250 is defined at the top of the interior side of the prefabricated wall panel to receive the dense beam. When a shear wall 156 (FIG. 28) intersects a frame column 12 (FIG. 28) in prefabricated wall panel 76, a rectangular slot 252 is defined along the length of mold 78 for receiving the shear wall. An upper opening 254 is defined in window column mold 235 to match a corresponding tab 315 (FIGS. 69 and 70) in upper prefabricated wall panel 84 (FIGS. 69 and 70). A lower opening 258 is defined in window column mold 235 to match a corresponding mold 312 (FIGS. 69 and 70) in lower prefabricated wall panel 82 (FIGS. 69 and 70). Prefabricated wall panel 76 may include a mold 260 for a cantilevered slab, which is usually at the same level as floor slab 96 and is typically used to hold air conditioning, solar power equipment, or other equipment. Cantilevered slab mold 260 is open to frame beam mold 218 and floor slab mold 220, and has depth f of floor slab 96.

Figures 51, 52:
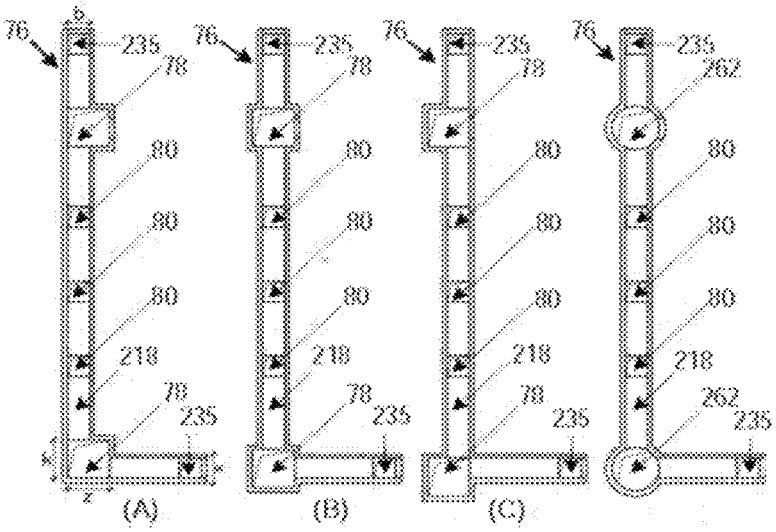
FIGS. 51, 52, 53, 54, 55, and 56 show top cross-sectional views of illustrative embodiments of prefabricated wall panels.

FIG. 51 shows top cross-sectional views of illustrative embodiments of arrangements for frame column molds 78 in prefabricated wall panel 76. In FIG. 51A, frame column molds 78 are flush with the exterior side of prefabricated wall panel 76 so it extends inward from the prefabricated wall panel. In FIG. 51B, frame column molds 78 are centered along prefabricated wall panel 76. In FIG. 51C, frame column molds 78 are flush with the interior side of the prefabricated wall panel 76 so it extends outward from the prefabricated wall panel.

FIG. 52 shows a top cross-sectional view of an illustrative embodiment of frame column molds 262 for frame columns 12 that have a circular cross-section in prefabricated wall panel 76. Like frame column molds 78 that have a rectangular or square cross-section, frame column molds 262 may be flush with the exterior side of prefabricated wall panel 76, centered along the prefabricated wall panel, or flush with the interior side of the prefabricated wall panel.

Figures 53, 54, 55, 56:
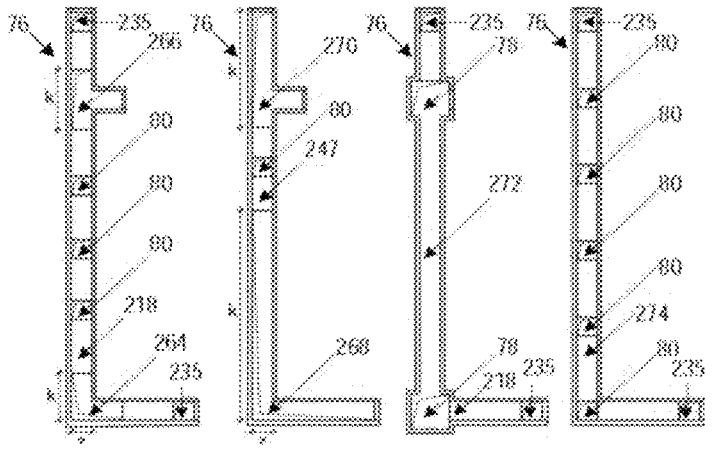

FIG. 53 shows a top cross-sectional view of an illustrative embodiment of prefabricated wall panel 76 for L-shaped frame column 160 (FIG. 29) and T-shaped frame column 162 (FIG. 29). Prefabricated wall panel 76 has an L-shaped frame column mold 264 for casting L-shaped frame column 160, and a T-shaped frame column mold 266 for casting T-shaped frame column 162. L-shaped frame column mold 264 has an exterior width k and a thickness z. T-shaped frame column mold 266 is flush with the exterior side of prefabricated wall panel 76 so it extends inward from the prefabricated wall panel. T-shaped mold 266 has a width k and a thickness z, where in an embodiment $1<k/z\leq 4$, $k\geq 500$ mm, and 200 mm$\leq z\leq$300 mm.

FIG. 54 shows a top cross-sectional view of an illustrative embodiment of prefabricated wall panel 76 integrated with L and T-shaped shear walls. Prefabricated wall panel 76 has an L-shaped shear wall mold 268 for casting an L-shaped shear wall, a T-shaped shear wall mold 270 for casting a T-shaped shear wall, a dense column mold 80 for casting a dense column 20 (FIG. 2), and a stiffening beam mold 247 for casting a stiffening beam connecting the L and the T-shaped shear walls. L-shaped shear wall mold 268 and T-shaped shear wall mold 270 have width k and thickness z where in an embodiment $k/z\geq 5$ is the definition of a shear wall in contrast to a column.

FIG. 55 shows a top cross-sectional view of an illustrative embodiment of prefabricated wall panel 76 with a shear wall spanning between two frame columns 12 (FIG. 2). Prefabricated wall panel 76 has a shear wall mold 272 for casting the shear wall. Shear wall mold 272 spans across two frame column molds 78. Prefabricated wall panel 76 also has window column molds 235 and a frame beam mold 218.

FIG. 56 shows a top cross-sectional view of an illustrative embodiment of corner prefabricated wall panel 76 with a ring beam over dense columns. Prefabricated wall panel 76 has dense column molds 80 for casting dense columns 20 (FIG. 2), window column molds 235 for casting window columns 14 (FIG. 2), and a ring beam mold 274 for casting the ring beam.

Figure 57:
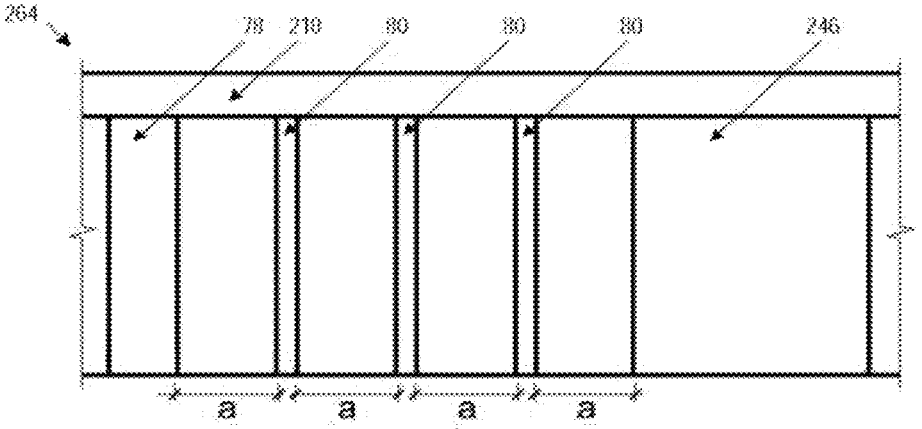
FIG. 57 shows a side view of an illustrative embodiment of a prefabricated wall panel.

FIG. 57 shows a side view of an illustrative embodiment of a prefabricated wall panel 264. In an embodiment, if the two adjacent molds are frame column molds 78, dense column molds 80, window column molds 235, or shear wall molds 246, the distance a between any two adjacent molds is≤1,250 mm.

Figures 58, 59, 60, 61, 62:
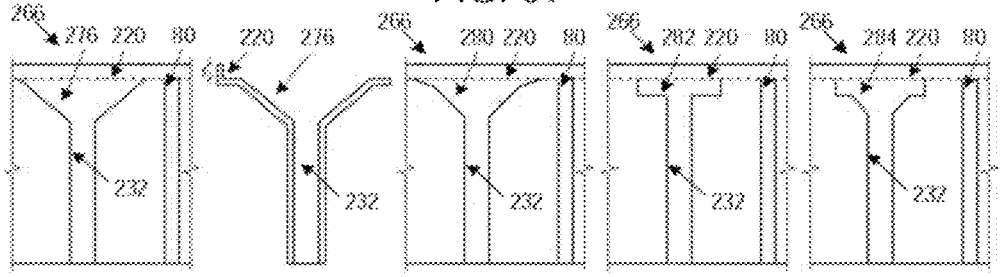
FIGS. 58, 59, 60, 61, and 62 show cross-sectional views of illustrative embodiments of prefabricated wall panels used in slab-column systems.

FIGS. 58 and 59 show front and side cross-sectional views of an illustrative embodiment of a prefabricated wall panel 266 used in a slab-column system. Prefabricated wall panel 266 includes a capital column mold 276 for casting a column capital, which is open to floor slab mold 220 and frame column mold 78. Column capital mold 276 has a trapezoidal shape. As the slab-column system does not have any frame beams, prefabricated wall panel 266 does not include any molds for the frame beams. The top of the exterior side of prefabricated wall panel 266 is greater than the top of the interior side of the prefabricated wall panel by floor slab thickness f.

FIG. 60 shows front cross-sectional view of an illustrative embodiment of prefabricated wall panel 266 having a different column capital mold 280. The sides of capital column mold 280 have double inclination angles instead of a single inclination angle.

FIG. 61 shows front cross-sectional view of an illustrative embodiment of prefabricated wall panel 266 having a different column capital mold 282 that is a bearing plate. Column capital mold 282 now has a rectangular or cylindrical shape.

FIG. 62 shows front cross-sectional view of an illustrative embodiment of prefabricated wall panel 266 having a different column capital mold 284 that is a combination of the trapezoidal shape of mold 276 and rectangular or cylindrical shape of mold 282.

Figure 63:
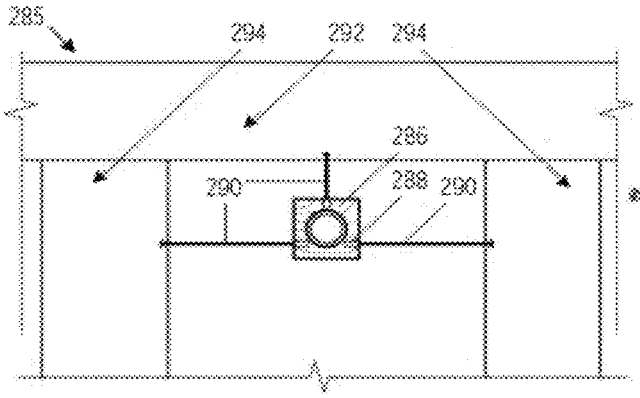
FIG. 63 shows a front cross-sectional view of an illustrative embodiment of a prefabricated wall panel with a conduit support.
Figure 64:
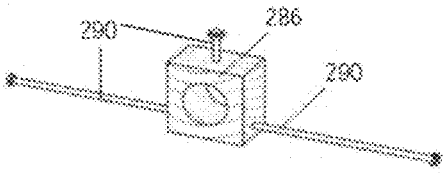
FIG. 64 shows a perspective view of an illustrative embodiment of the conduit support of FIG. 63.

FIG. 63 shows a front cross-sectional view of an illustrative embodiment of a prefabricated wall panel 285 with a conduit support 286. FIG. 64 shows a perspective view of an illustrative embodiment of conduit support 286. Conduit support 286 may be used when prefabricated wall panel 285 provides space for any type of conduit, such as exhaust or HVAC conduit. Conduit support 286 may be a wood block with a center hole. Holes are provided in the top, left, and right sides of conduit support 286, plastic expanding anchors 288 are placed in the holes, and metal bolts 290 are screwed into the plastic expanding anchors. The top bolt 290 protrudes into a mold 292 for a horizontal RC element, such as a frame beam, and the side bolts 290 protrude into molds 294 for vertical RC elements, such as a frame, window, or dense columns.

Figure 65:
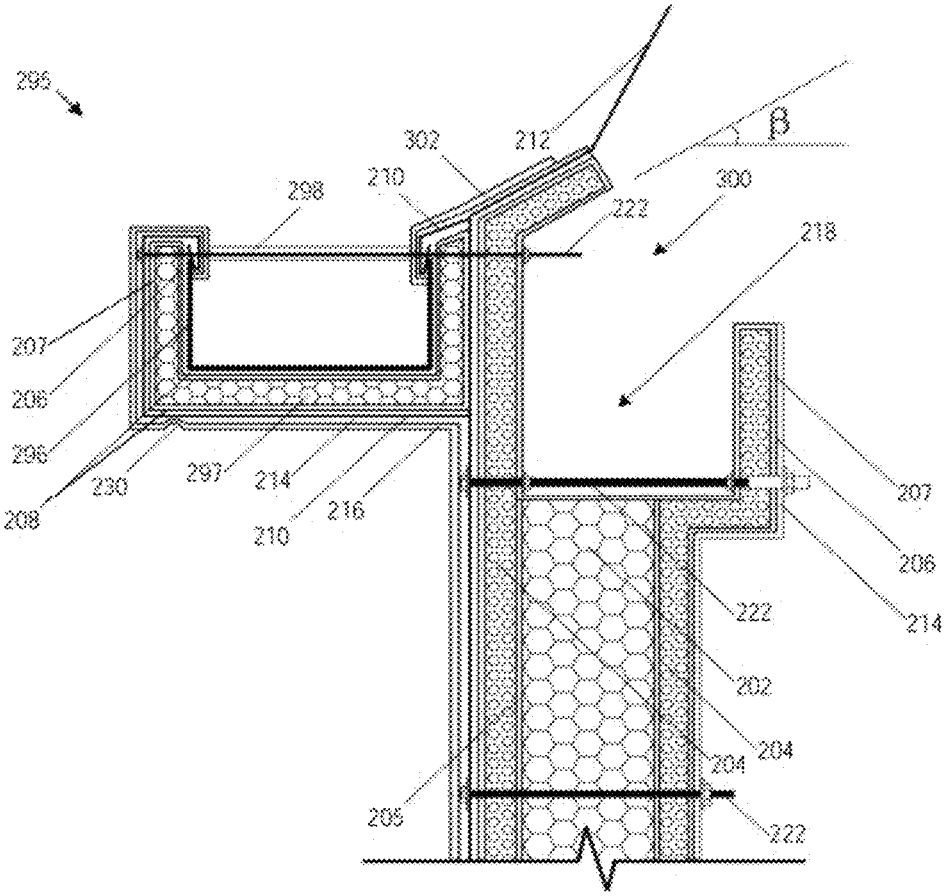
FIG. 65 shows a side cross-sectional view of an illustrative embodiment a prefabricated wall panel that forms part of the top story of a building.

FIG. 65 shows a side cross-sectional view of an illustrative embodiment a prefabricated wall panel 295 that forms part of the top story of a building. Prefabricated wall panel 295 has similar construction as prefabricated wall panel 76 in FIG. 44. When the building has a sloped roof, prefabricated wall panel 295 may be integrated with an exterior trough, such as a rain gutter 296. Rain gutter 296 may be metal, plastic, or another suitable material. A cornice is formed around rain gutter 296. The cornice is installed after wire mesh 210 is fixed to the exterior side of prefabricated wall panel 295. The cornice is formed with a U-channel 297 made of a material such as EPS. Fabric mesh 206 with adhesive 207 is wrapped around U-channel 297 and the ends of the fabric mesh are connected by wires to wire mesh 210 of prefabricated wall panel 295. Adhesive 208 and wire mesh 210 are then applied to both sides of the cornice. Wire mesh 210 of the cornice is connected at one end to wire mesh 210 of prefabricated wall panel 295, and the other end is looped into itself at the top of rain gutter 296. Another layer of mortar 214 and exterior finish 216 are applied to the cornice exterior. Bolts 222 extend from the exterior side of the cornice, through the interior side of the cornice and into a mold 300 for a cast in situ concrete roof. Bolts 222 may be tied to the rebar structure of the concrete roof. Bolts 222 may be weatherproofed by a plastic sleeve 298 around the bolt.

The bottom of the cornice may have a semicircular concave groove that forms drip line 230. The cornice line may be an architectural element that enriches the outer appearance of the exterior wall.

When a cast in-situ concrete roof is used, the top of the exterior side of prefabricated wall panel 295 may be sloped at an angle "β" to form the interface to the roof. The top of the exterior side of prefabricated wall panel 295 is covered by a waterproof layer 302, which may be a membrane, a layer of asphalt, or a waterproof coating.

Figure 66:
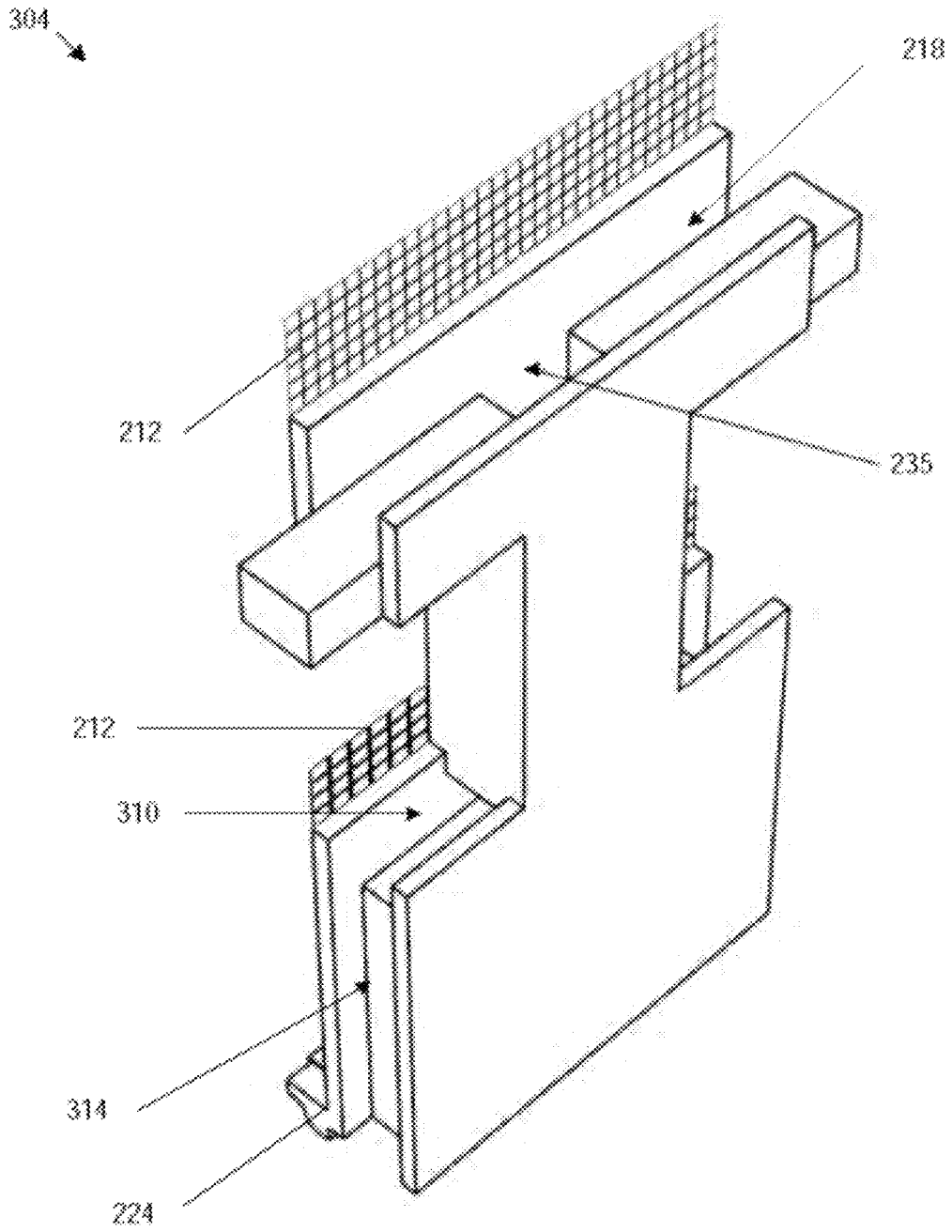
FIG. 66 shows a perspective back view of an illustrative embodiment of a prefabricated wall panel.

FIG. 66 shows a perspective back view of an illustrative embodiment of a straight full-height prefabricated wall panel 304 combining the elements of straight prefabricated wall panel 74, lower prefabricated wall panel 82, and upper prefabricated wall panel 84. Prefabricated wall panel 304 may be used when two windows are closely located next to each other. Each side of prefabricated wall panel 304 forms half of lower prefabricated wall panel 82 and upper prefabricated wall panel 84 so prefabricated wall panel 304 includes window beam molds 310 and short window column molds 314. Window column mold 235 is located near the center of prefabricated wall panel 304. Frame beam mold 218 and a tab 315 are formed at the top of prefabricated wall pane 304. Each side of prefabricated wall panel 304 may interface with a side of another prefabricated wall panel that forms the other half of lower prefabricated wall panel 82 and upper prefabricated wall panel 84 (without a tab).

Figure 67:
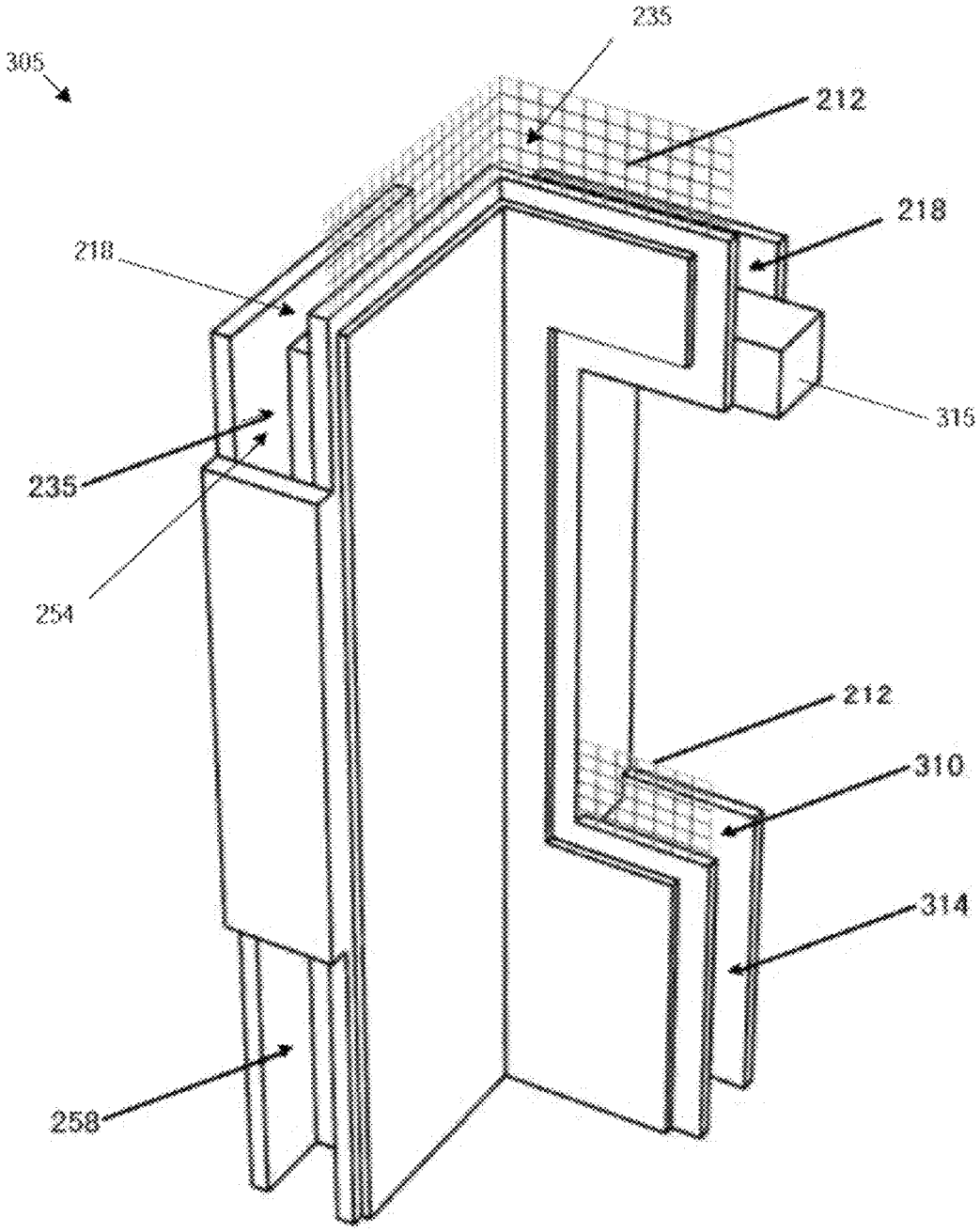
FIG. 67 shows a perspective back view of an illustrative embodiment of a prefabricated wall panel.

FIG. 67 shows a perspective back view of an illustrative embodiment of a corner full-height prefabricated wall panel 305 combining the elements of corner prefabricated wall panel 76, lower prefabricated wall panel 82, and upper prefabricated wall panel 84. For example, the right side of prefabricated wall panel 305 forms half of lower prefabricated wall panel 82 and upper prefabricated wall panel 84 so prefabricated wall panel 305 includes window beam molds 310 and short window column molds 314. Window column mold 235 is located at the corner of prefabricated wall panel 305. Frame beam mold 218 and a tab 315 are formed at the top of prefabricated wall pane 305.

The right side of prefabricated wall panel 304 may interface with a side of another prefabricated wall panel that forms the other half of lower prefabricated wall panel 82 and upper prefabricated wall panel 84 (without a tab 315). The left side of prefabricated wall panel 305 is like the sides of corner prefabricated wall panel 76 and includes upper opening 254 and lower opening 258 in window column mold 235. The left side of prefabricated wall panel 305 may connected to lower prefabricated wall panel 82 and upper prefabricated wall panel 84.

Figure 68:
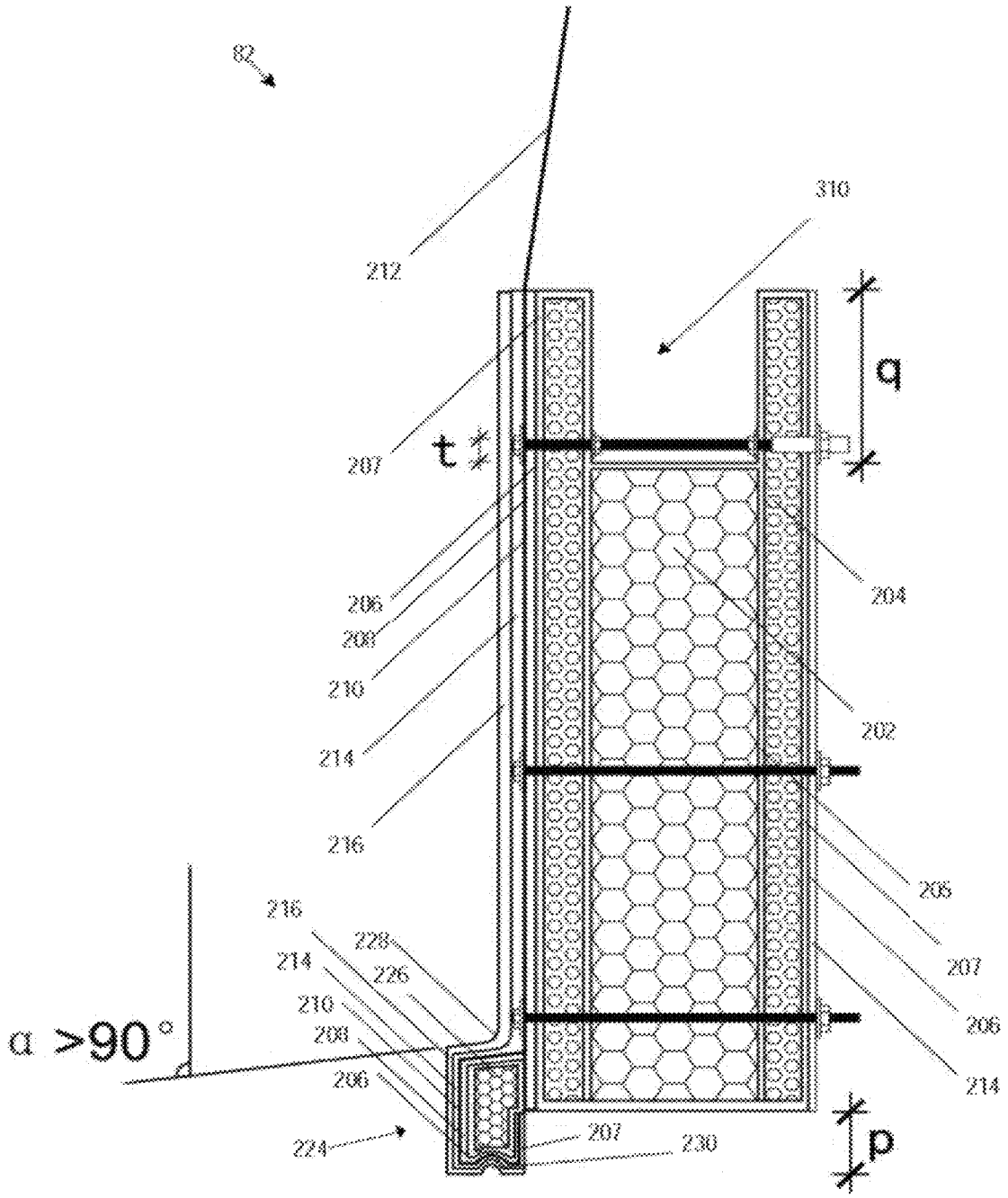
FIG. 68 shows a side cross-sectional view of an illustrative embodiment of a lower prefabricated wall panel.

FIG. 68 shows a side cross-sectional view of an illustrative embodiment of lower prefabricated wall panel 82. Lower prefabricated wall panel 82 has similar construction as the lower portion of prefabricated wall panel 76 in FIG. 44. The top of lower prefabricated wall panel 82 includes a window beam mold 310. Window beam mold 310 a height "q" of window beam 16 (FIG. 2). Bolts 222 in mold 310, only one of which is visible, are located above the bottom of the mold by distance t, which provides a protective layer of concrete for horizontal rebar structures 64 (FIG. 6) for window beam 16 against possible exposure to corrosion. Additional bolts 222 pass through lower prefabricated wall panel 82 in other locations.

An architrave 224 extends down from the bottom of the exterior side of lower prefabricated wall panel 82 by distance p. Distance p is the same as distance c of the prefabricated wall panel located below prefabricated wall panel 82. The construction of architrave 224 has been previously described in reference to FIG. 42.

Figure 72:
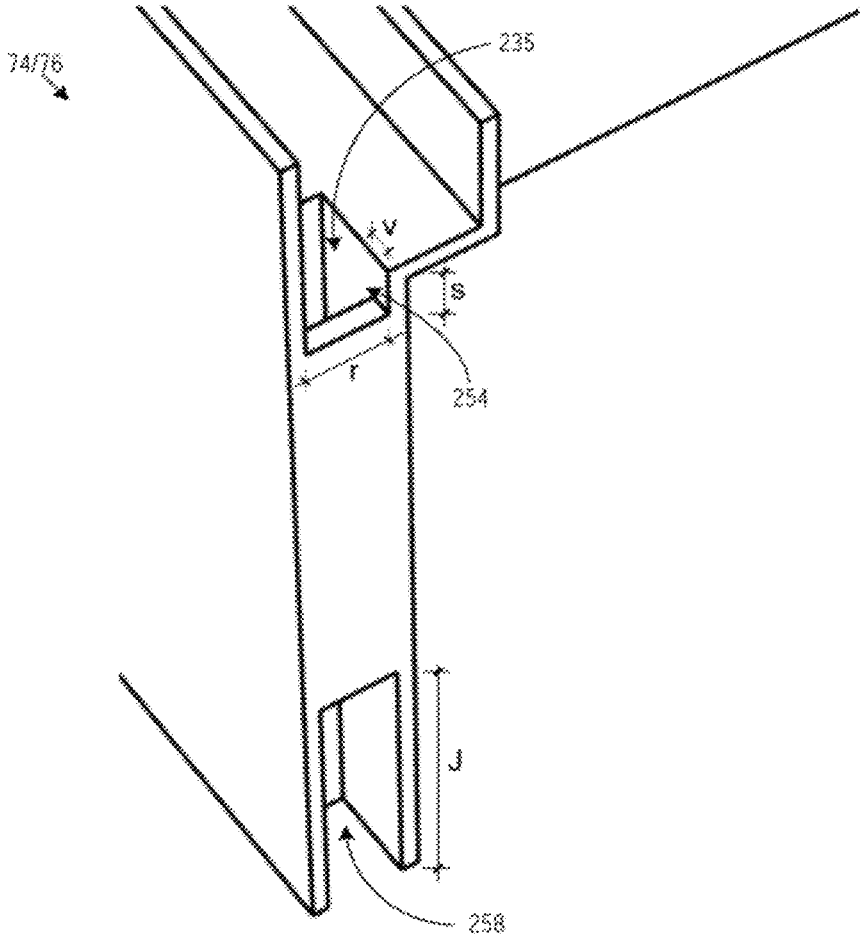
FIG. 72 shows an enlarged perspective view of an illustrative embodiment of a prefabricated wall panel.

FIGS. 69 and 70 show perspective front and back views of an illustrative embodiment of lower prefabricated wall panel 82 and upper prefabricated wall panel 84. The top of prefabricated wall panel 82 includes a window beam mold 310 for casting window beam 16 (FIG. 2). The two sides of prefabricated wall panel 82 include window column molds 312 for casting a lower portion of window columns 14 (FIG. 2). Window column molds 312 have a height "j" that matches the height of lower openings 258 (FIG. 72) of window column molds 235 (FIG. 72) in adjoining prefabricated wall panels 74 or 76 (FIG. 72). The middle of prefabricated wall panel 82 includes a mold 314 for casting short window column 18. Wire mesh 210 extends from the top and the two sides of lower preformed wall panel 82.

Figure 71:
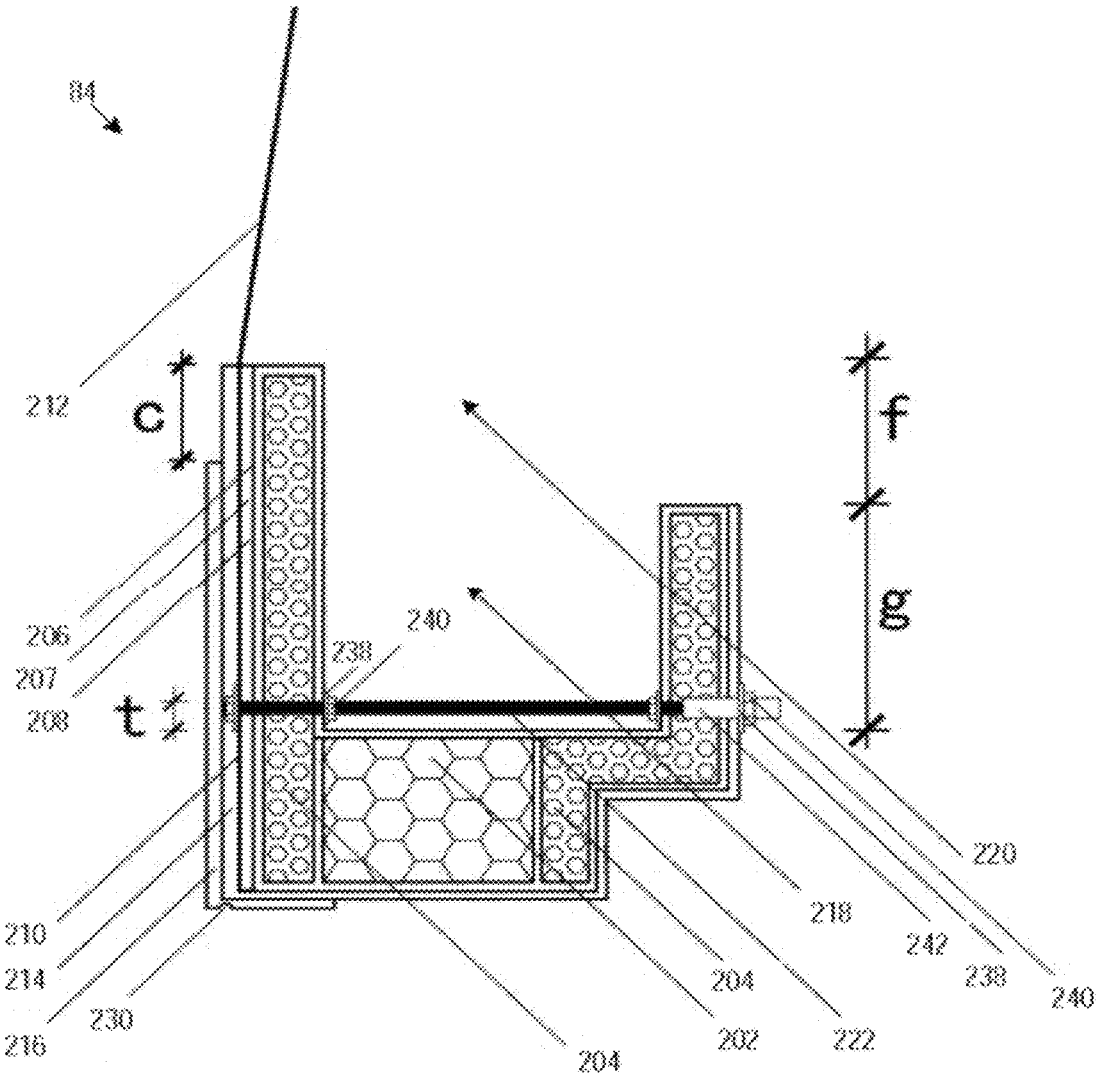
FIG. 71 shows a side cross-sectional view of an illustrative embodiment of an upper prefabricated wall panel.

FIG. 71 shows a side cross-sectional view of an illustrative embodiment of an upper prefabricated wall panel 84. Upper prefabricated wall panel 84 has similar construction as the upper portion of prefabricated wall panel 76 in FIG. 44. The top of upper prefabricated wall panel 84 includes frame beam mold 218 and floor slab mold 220. The top of the exterior side of upper preformed wall panel 84 is taller than the top of the interior side of the upper prefabricated wall panel by floor slab thickness f. Frame beam mold 218 has frame beam height g. Bolts 222 in frame beam mold 218, only one of which is visible, are located above the bottom of the frame beam mold by distance t, which provides a protective layer of concrete for frame beam rebar structures 88 (FIG. 13) of frame beam 10 (FIG. 2) against possible exposure to corrosion. Additional bolts 222 pass through upper prefabricated wall panel 84 in other locations. The bottom of upper prefabricated wall panel 84 may include drip line 230.

Referring back to FIGS. 69 and 70, wire mesh 210 extends from the top and the two sides of prefabricated wall panel 84. The two sides of prefabricated wall panel 84 include protruding blocks 315 having width "r," height "s," and depth "v" that match the dimensions of upper openings 254 (FIG. 72) of window column molds 235 (FIG. 72) in adjoining prefabricated wall panels 74 or 76 (FIG. 72).

FIG. 72 shows an enlarged perspective view of an illustrative embodiment of a prefabricated wall panel 74 or 76 showing the dimensions of upper opening 254 and lower opening 258 of window column mold 235.

Figure 73:
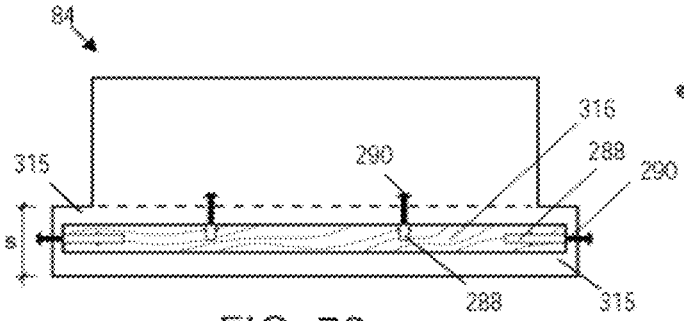
FIG. 73 shows a cross-sectional view of an illustrative embodiment of an upper prefabricated wall panel with an embedded beam.
Figure 74:
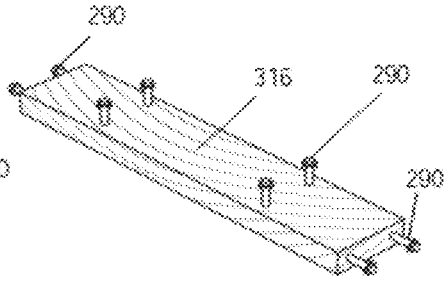
FIG. 74 shows a perspective view of an illustrative embodiment of the beam of FIG. 73.

FIG. 73 shows a cross-sectional view of an illustrative embodiment of upper prefabricated wall panel 84 with an embedded beam 316 instead of a foam board 202. FIG. 74 shows a perspective view of an illustrative embodiment of beam 316. Beam 316 may be a wood block. Holes are provided in the top, left, and right sides of beam 316, plastic expanding anchors 288 are placed in the holes, and metal bolts 290 are screwed into the plastic expanding anchors. Beam 316 is then secured to upper prefabricated wall panel 84, where top metal bolt 290 protrudes into frame beam mold 218 (FIG. 69) and side metal bolts 290 protrude from blocks 315 into upper openings 254 (FIG. 72) in window column molds 235 (FIG. 72).

Figure 75:
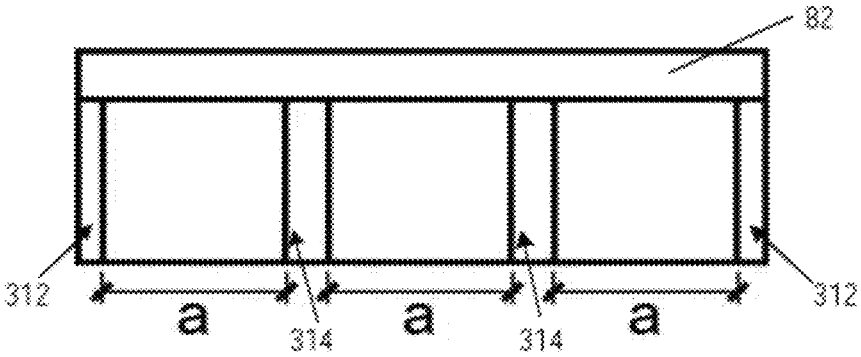
FIG. 75 shows a front view of an illustrative embodiment of a lower preformed wall panel.

FIG. 75 shows a front view of an illustrative embodiment of lower preformed wall panel 82. Lower prefabricated wall panel 82 includes at least one window column mold 312 and one short window column mold 314. When lower prefabricated wall panel 82 is long, the number of short window columns 18 (FIG. 2) is increased and adjacent short window column molds 314 are spaced apart by distance a, where in an embodiment a≤1,250 mm. Similarly, adjacent window column mold 312 and short window column mold 314 are spaced apart by distance a.

Figure 76:
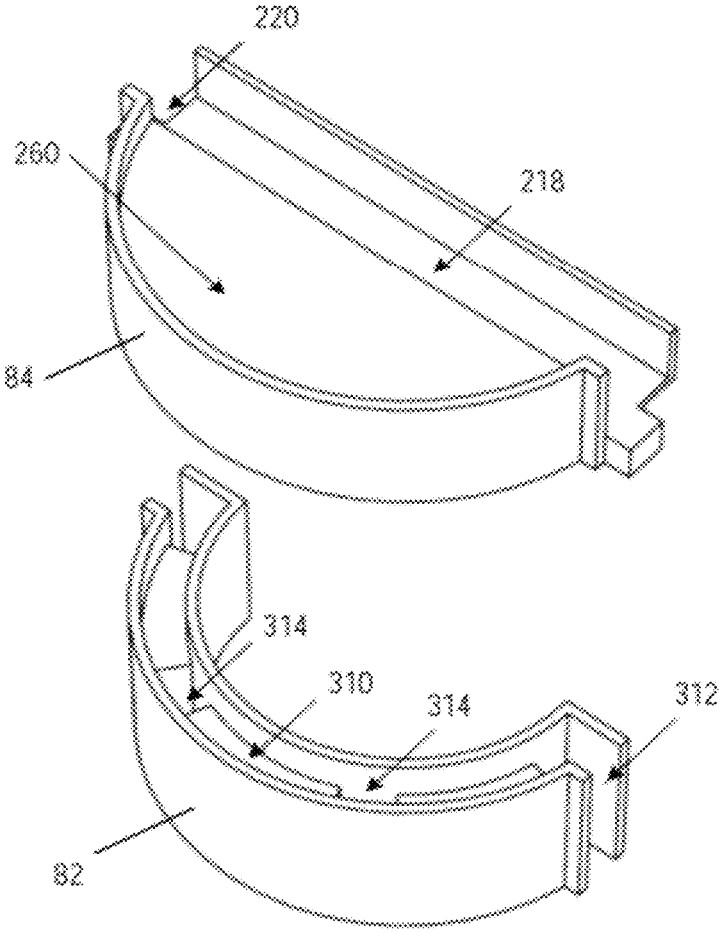
FIGS. 76, 77, 78, and 79 shows perspective views of illustrative embodiments of lower and upper prefabricated wall panels.

FIG. 76 shows a perspective view of an illustrative embodiment of a curved lower prefabricated wall panel 82 and a curved upper prefabricated wall panel 84 that provide a curved bay window (i.e., a bow window). Upper prefabricated wall panel 84 may include a curved cantilever slab mold 260, which is open to frame beam mold 218 and floor slab mold 220 and has the floor slab depth f. Upper prefabricated wall panel 84 may include an embedded beam 316 (FIGS. 73 and 74) that is curved. Lower prefabricated wall panel 82 includes a curved window beam mold 310, window column molds 312, and short window column molds 314. In an embodiment, short window column molds 314 are spaced apart evenly at a distance≤600 mm.

Figure 77:
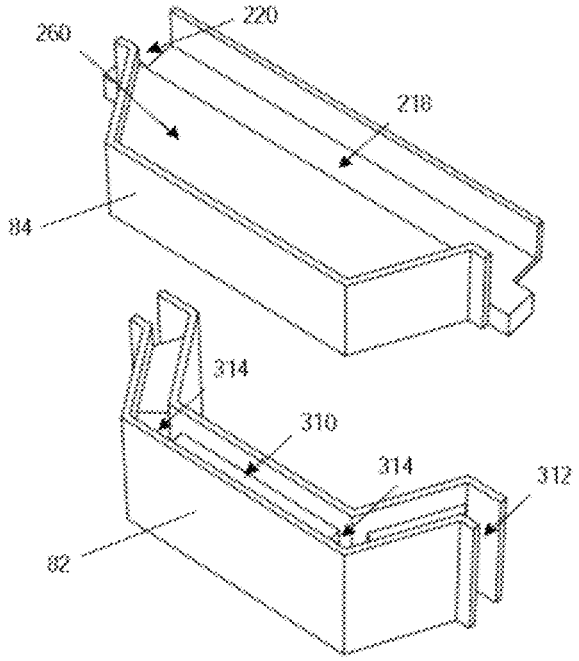

FIG. 77 shows a perspective view of an illustrative embodiment of a polygonal lower prefabricated wall panel 82 and a polygonal upper preformed wall panel 84 for providing a bay window. Upper prefabricated wall panel 84 may include a polygonal cantilevered slab mold 260, which is open to frame beam mold 218 and floor slab mold 220 and has the floor slab depth f. Upper prefabricated wall panel 84 may include an embedded beam 316 (FIGS. 73 and 74) that is trapezoidal. Lower prefabricated wall panel 82 includes a trapezoidal window beam mold 310, short window column molds 314, and window column molds 312. In an embodiment, short window column molds 314 are placed at the turns in lower prefabricated wall panel 82 and they are spaced apart by a distance≤1,250 mm.

Figure 78:
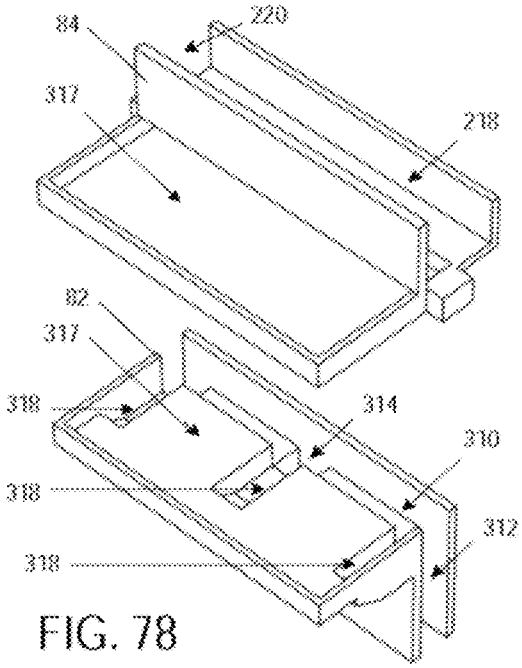
Figure 79:
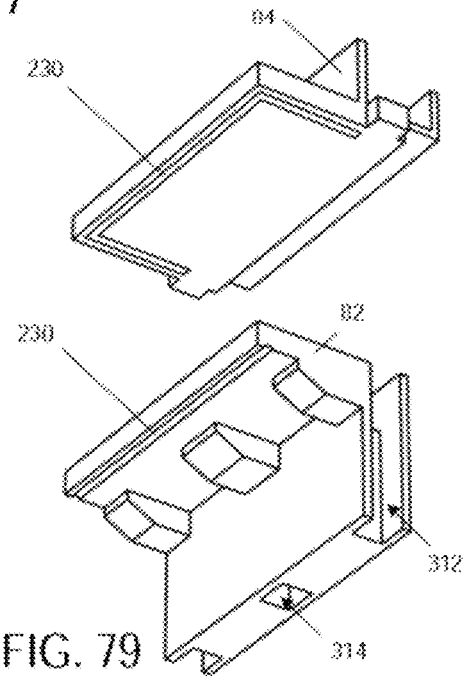

FIGS. 78 and 79 show top and bottom perspective views of an illustrative embodiment of a lower prefabricated wall panel 82 and an upper preformed wall panel 84. Lower prefabricated wall panel 82 includes a cantilevered slab mold 317 for casting a cantilevered slab below the window. Cantilevered slab mold 317 is open to window beam mold 310. Cantilevered slab mold 317 may include bracket molds 318 for casting support brackets, which are open to window column molds 312 and short window column molds 314. Upper prefabricated wall panel 84 may include a cantilevered slab mold 260 for casting a cantilevered slab above the window. The bottoms of cantilevered slab molds 260 and 317 include drip lines 230.

Figure 80:
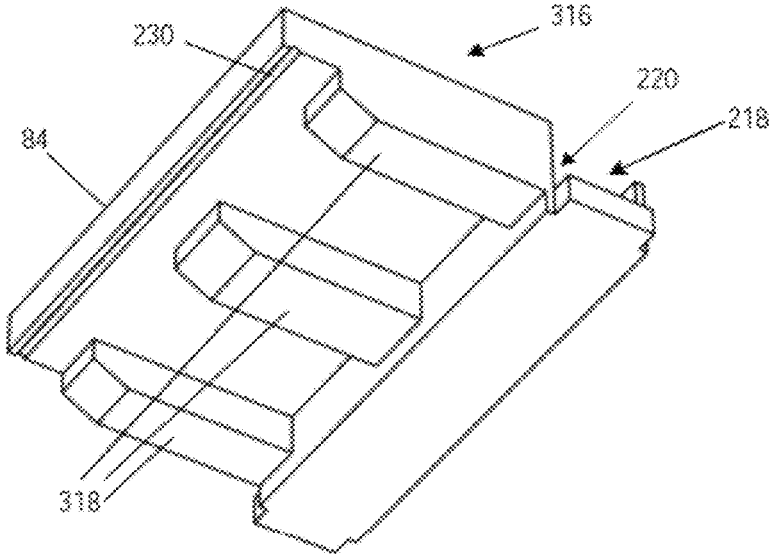
FIGS. 80 and 81 show perspective views illustrative embodiments of upper prefabricated wall panels.

FIG. 80 shows a bottom perspective view of an illustrative embodiment of an upper prefabricated wall panel 84 for providing a balcony for the story above. Upper prefabricated wall panel 84 includes a cantilevered slab mold 317 for casting a cantilevered slab, which is open to frame beam mold 218 and floor slab mold 220. Cantilevered slab mold 317 includes bracket molds 318 for casting support brackets. The bottom of cantilevered slab mold 317 includes a drip line 230.

Figure 81:
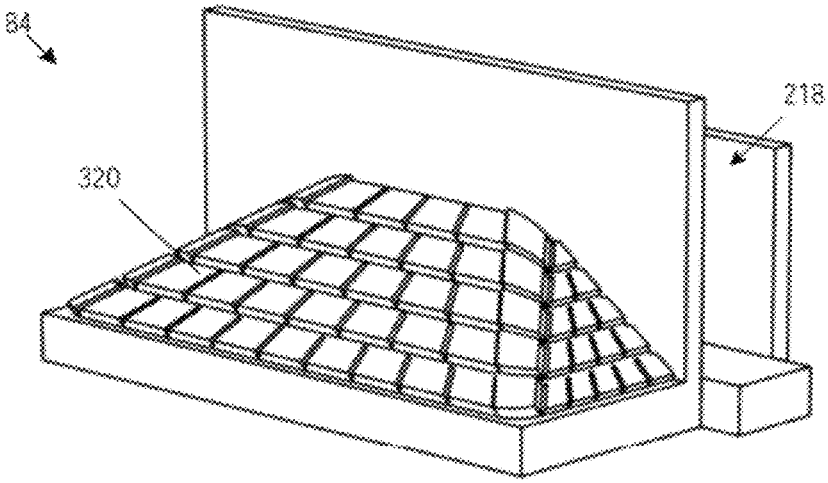

FIG. 81 shows a perspective view of an illustrative embodiment of an upper prefabricated wall panel 84 with a roof 320. The underlying shape of roof 320 is implemented with a foam core in upper prefabricated wall panel 84. Roof 320 may be covered by tiles or other suitable roofing material.

Figure 82:
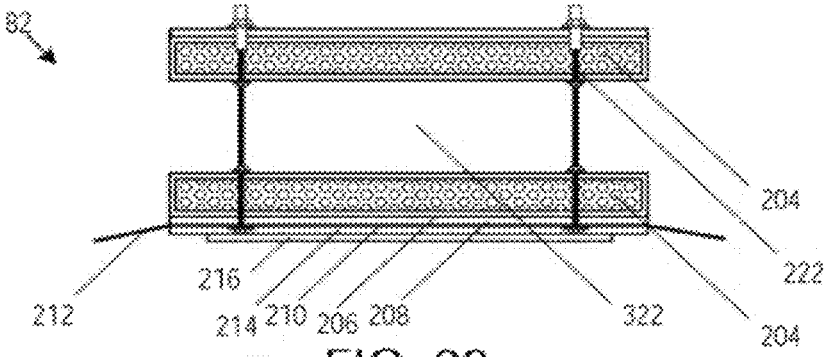
FIG. 82 shows a top cross-sectional view of an illustrative embodiment of a lower prefabricated wall panel that is interconnected with the story below.

FIG. 82 shows a top cross-sectional view of an illustrative embodiment of a lower prefabricated wall panel 82 that is a shear wall interconnected with the story below. Prefabricated wall panel 82 may be connected with the beam from the story below so it defines a space 322 that is open at the top, the bottom, and the sides. Lower prefabricated wall panel 82 is essentially two preformed wall units coupled by bolts 222.

In the prefabricated wall panels described above, foam boards 202 may be replaced with foam glass panels 204. Mortar 208 or 214 may be replaced with a dry mix. Foam glass panels 204 may be replaced with Perlite, silicate insulation board, or Aerogel. EPS foam boards 202 may be replaced with extruded polystyrene (XPS) board, polyurethane rigid foam (PUR) board, polyethylene foam (PE) board, or phenolic foam (PF) board. Furthermore, the prefabricated wall panels may include use either foam boards 202 or foam glass panels 204 as the only insulation material.

System for Making Prefabricated Wall Panels

Figure 83:
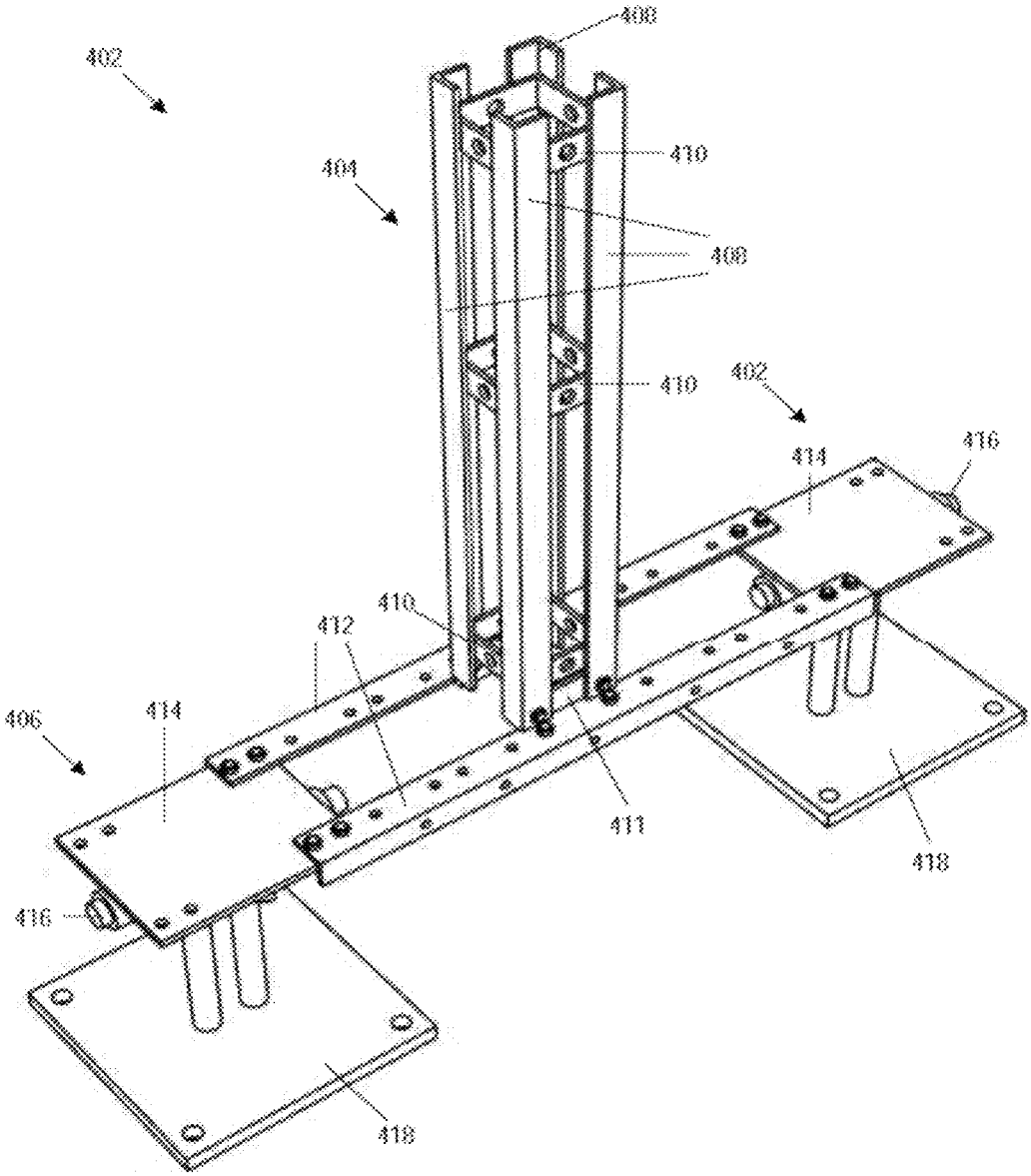
FIGS. 83 and 84 show perspective assembled and exploded views of an illustrative embodiment of a wall rack that is part of a production system for finishing straight prefabricated wall panels.
Figure 84:
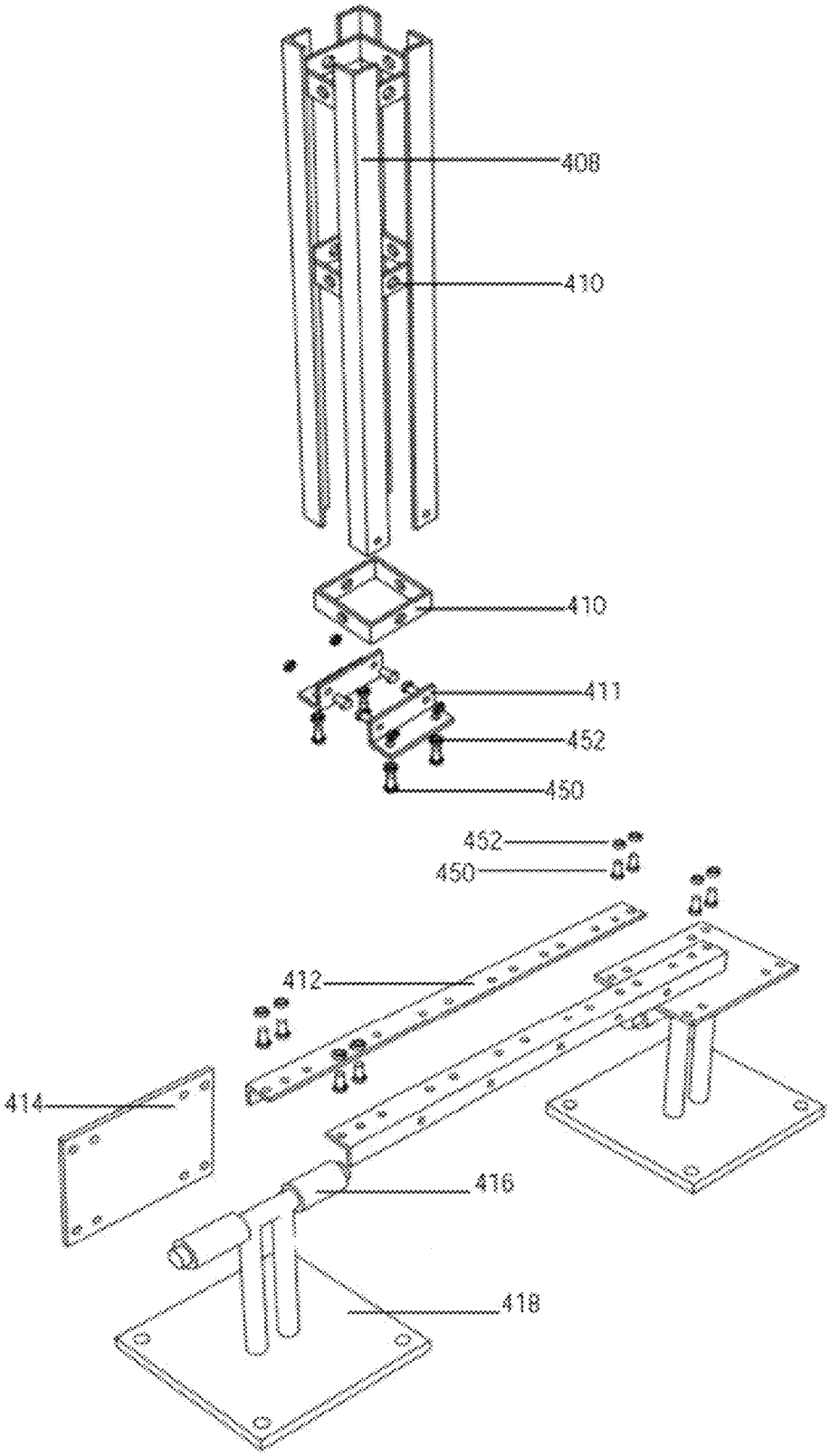

FIGS. 83 and 84 show perspective assembled and exploded views of an illustrative embodiment of a wall rack 402 that is part of a production system for finishing the straight prefabricated wall panels described above. Wall rack 402 includes one or more columns 404 and two or more supports 406. Column 404 includes four column L-brackets 408 connected at their interior by rectangular brackets 410. The dimensions of column 404 depend on the column it represents in a prefabricated wall panel. The lower end of column 404 is fixed by mounting L-brackets 411 to two base L-brackets 412 by screws 250 and nuts 252. Support 406 includes a mounting plate 414 fixed by welding to a pin joint 416, which is fixed by welding to a base plate 418. Column 404 is connected by base L-brackets 412 to mounting plates 414 of supports 406 where the base L-brackets fit around two sides of the mounting plates and are secured by screws 250 and nuts 252. Base L-brackets 412 has a number of mounting holes so the mounting points for column 404 and supports 406 may be adjusted. Column 404 may rotate by supports 406 from a vertical position to a horizontal position and vice versa.

Figure 85:
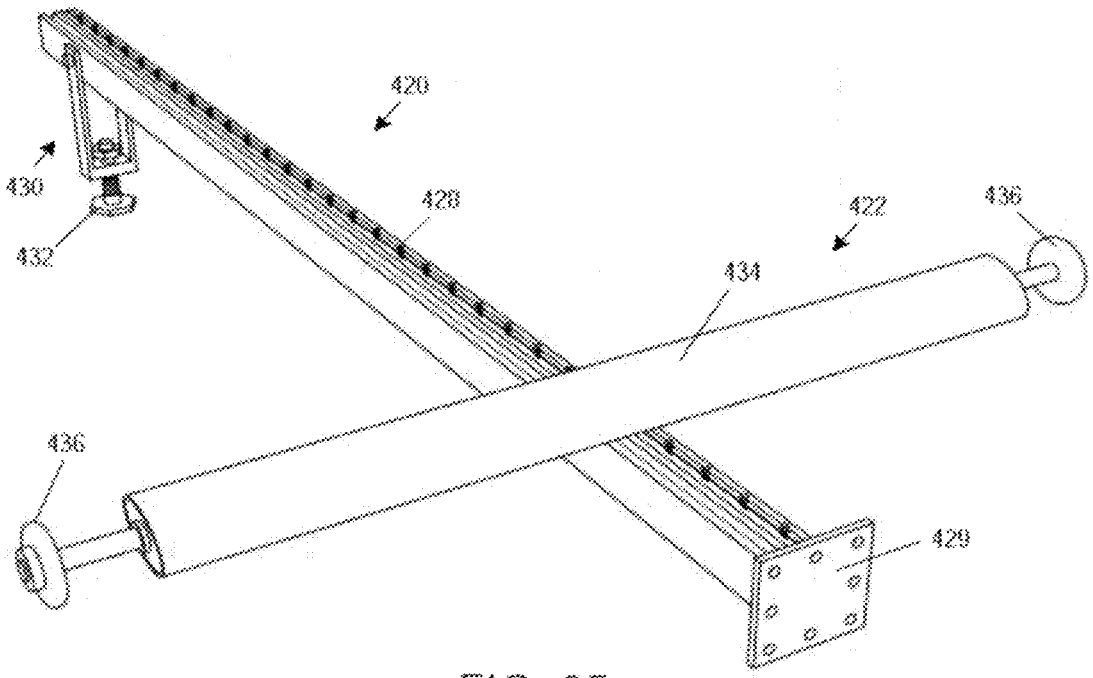
FIGS. 85 and 86 show perspective views of an illustrative embodiment of a track and a roller that are part of the production system.
Figure 86:
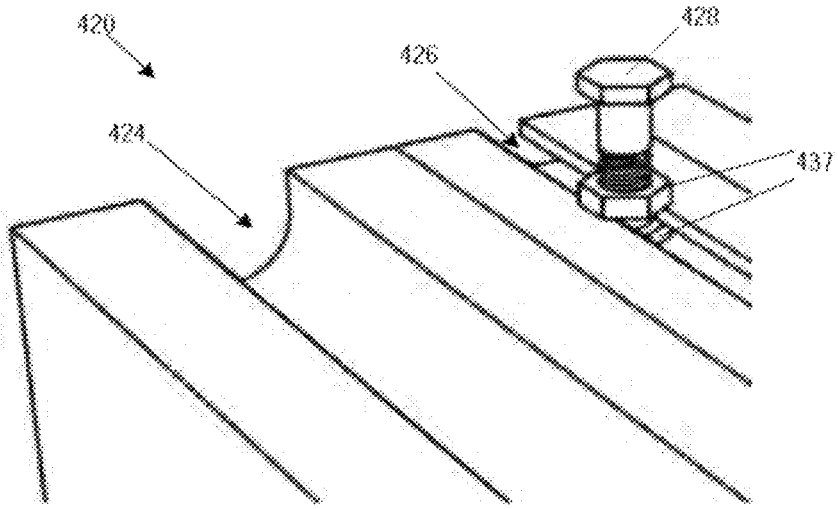
Figure 87:
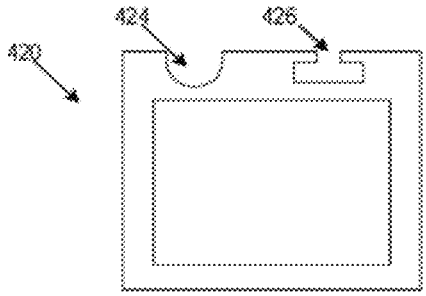
FIG. 87 shows a cross-sectional view of an illustrative embodiment of the track of FIG. 85.

FIG. 85 shows a perspective view of an illustrative embodiment of a track 420 and a leveling device 422, such as a roller, that are part of the production system. FIG. 86 shows an enlarged portion of FIG. 85. FIG. 87 shows a cross-sectional view of an illustrative embodiment of track 420 of FIG. 85. Referring to both FIGS. 85, 86, and 87, track 420 includes a U-channel 424, a C-channel 426 alongside the U-channel, bolts 428 fitted in the slot of the C-channel, a mounting plate 429 connected to one end of the U and the C-channels, and a pivotable support 430 with a height adjustment screw 432. Bolts 428 may be secured by nuts 437 along C-channel 426.

Figure 88:
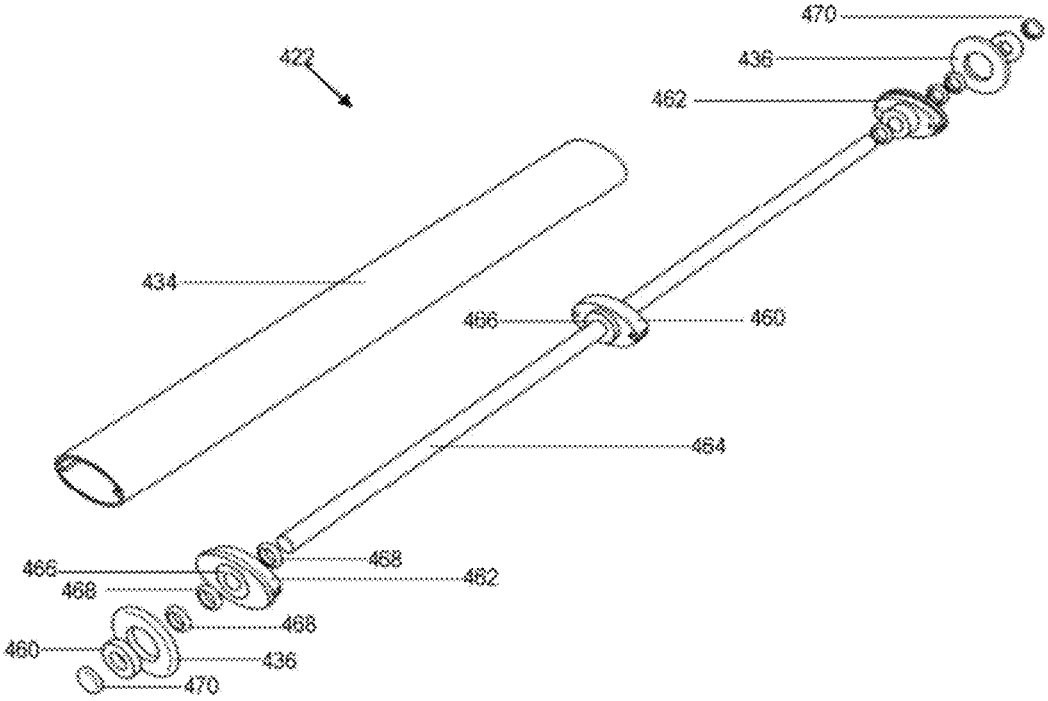
FIG. 88 shows an exploded view of an illustrative embodiment of the roller of FIG. 85.
Figure 89:
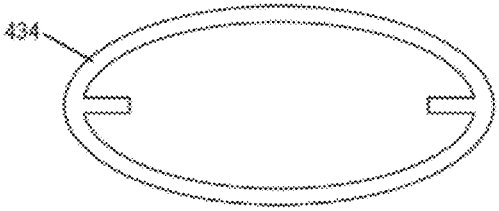
FIG. 89 shows a cross-sectional view of an illustrative embodiment of a rod of the roller of FIG. 88.

FIG. 88 shows an exploded view of an illustrative embodiment of a roller 422 of FIG. 85. Roller 422 includes a tube 434 and wheels 436 at the two ends of the tube. Tube 434 may be oval so when it rolled over a motor the pressure applied may be adjusted. Wheels 436 fit in U-channels 424 of two parallel tracks 420. FIG. 89 shows a cross-sectional view of an illustrative embodiment of rod 434 of FIG. 88. Referring back to FIG. 88, an oval plug 460 is located inside tube 434, oval covers 462 are located at the two ends of the tube, and a shaft 464 passes through bearings 466 in the plug and the cover. Wheels 436 with bearings 466 are located at the two ends of shaft 464 exterior of cover 462. Each cover 462 is positioned on shaft 464 between two nuts 468. Each wheel 436 is positioned on shaft 464 between a nut 468 and a shaft cap 470. Tube 434 may rotate freely about shaft 464.

Figure 90:
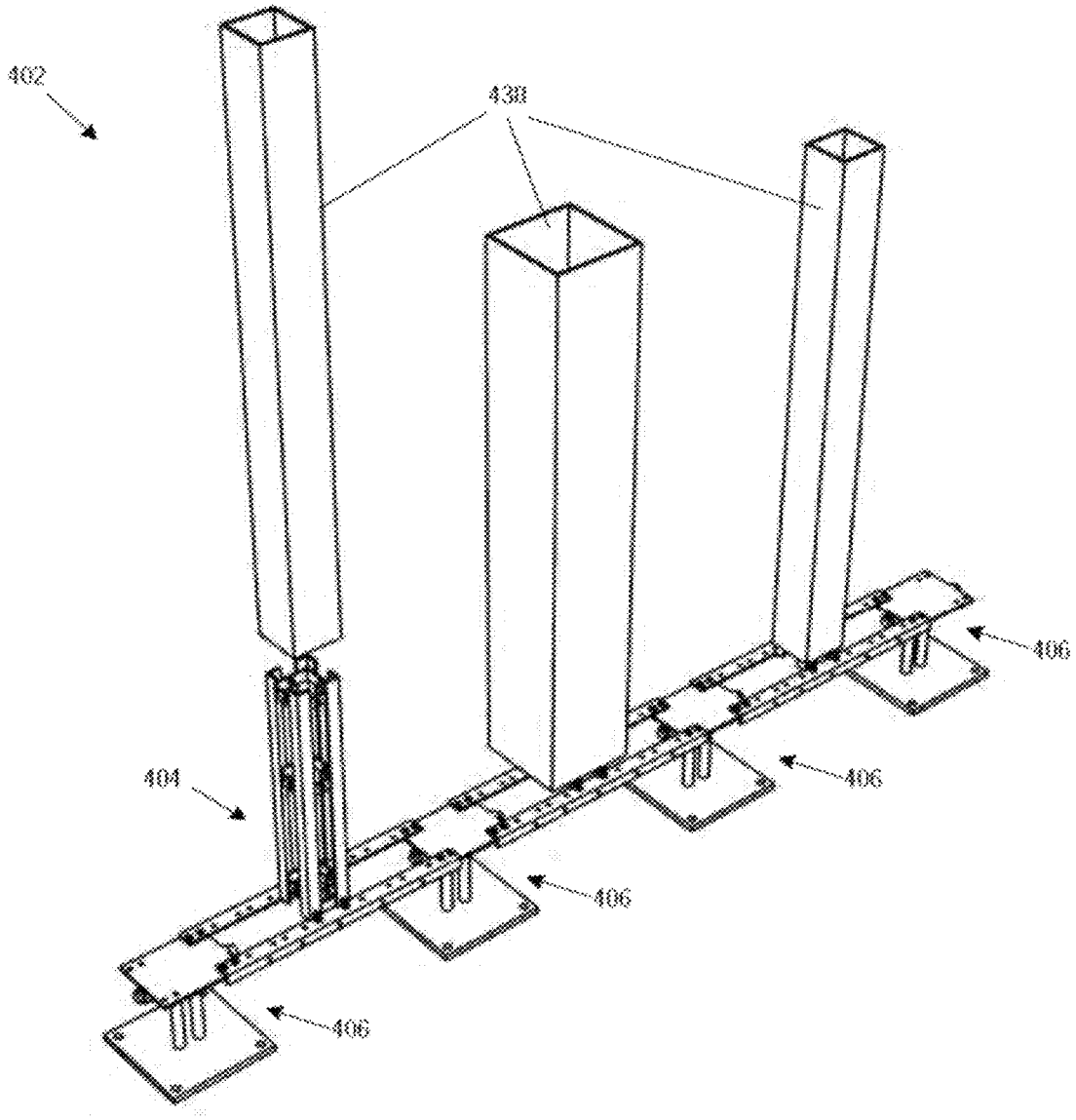
FIG. 90 shows a perspective view of an illustrative embodiment of a wall rack.

FIG. 90 shows a perspective view of an illustrative embodiment of wall rack 402 with three columns 404 mounted to four supports 406 where adjacent columns sharing a common support between them. The number, the dimensions, and the spacing of columns 404 are adjusted according to the molds in a prefabricated wall panel. Wooden sleeves 438 are fitted over columns 404. The prefabricated wall panel, less wire mesh 210 (FIG. 44), mortar 214 (FIG. 44), and exterior finish 216 (FIG. 44), is hoisted and fitted over wall rack 402 where column molds in the prefabricated wall panels receive the corresponding wood sleeves 438 of the wall rack.

Figure 91:
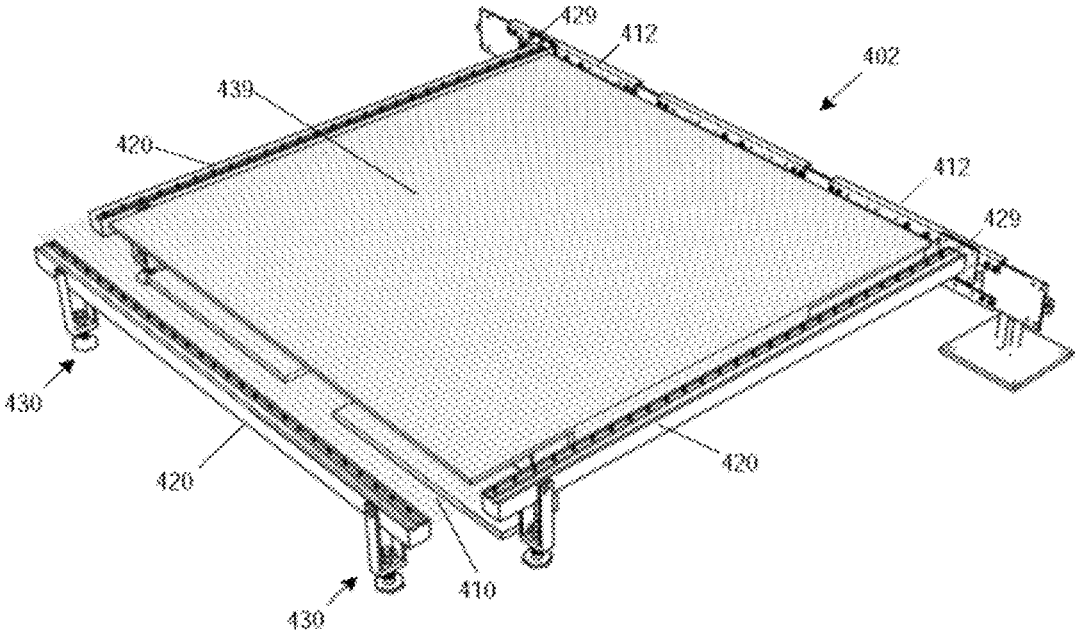
FIGS. 91 and 92 show perspective views of an illustrative embodiment the wall rack of FIG. 85 mounted with a prefabricated wall panel.
Figure 92:
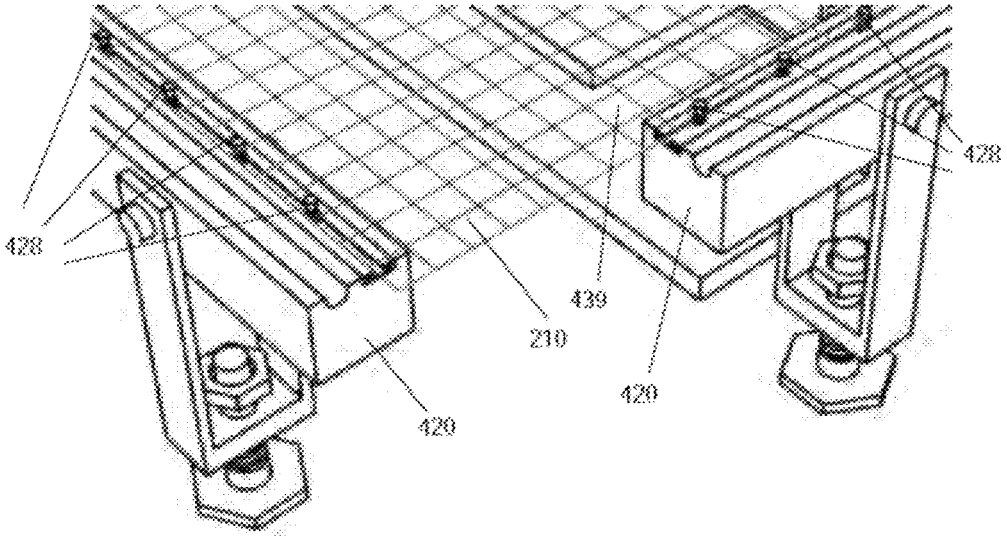

FIG. 91 shows a perspective view of an illustrative embodiment wall rack 402, with a prefabricated wall panel 439 installed and rotated from the vertical position to the horizontal position. FIG. 92 shows an enlarged view of a portion FIG. 91. Referring to both FIGS. 91 and 92, two lateral tracks 420 are fixed by their mounting plates 429 to base L-brackets 412 of wall rack 402. Lateral tracks 420 are spaced apart about the width of prefabricated wall panel 439 so the lateral tracks are near the sides of the prefabricated wall panel. A top track 420 is located parallel to wall rack 402 at a distance about the height of prefabricated wall panel 439 so the top track is near the top of prefabricated wall panel 439. Note top track 420 includes two adjustable screws 430 at the two ends. Three sides of wire mesh 210 of prefabricated wall panel 439 are then secured to bolts 428 of the three tracks 420 to ensure they are under tension and flat against prefabricated wall panel 439 when mortar 214 is applied.

Figure 93:
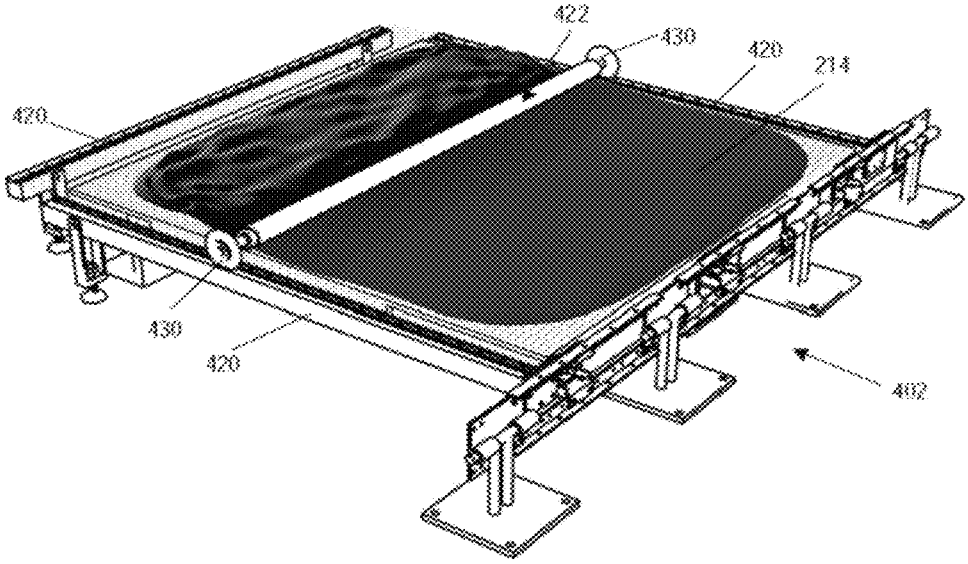
FIG. 93 shows a perspective view of an illustrative embodiment of the wall rack of FIG. 91 and roller of FIG. 85.

FIG. 93 shows a perspective view of an illustrative embodiment of wall rack 402 and roller 422. Mortar 214 is generally applied over wire mesh 210 of prefabricated wall panel 439. Roller 422 is then placed on tracks 420 along the two sides of prefabricated wall panel 439 and then rolled over mortar 214 to provide a consistent flat surface on prefabricated wall panel 439. Wheels 436 of roller 422 may be selected to provide the appropriate thickness of mortar 214. Instead of roller 422, a flat stamp may be used to provide a consistent flat surface on prefabricated wall panel 439.

Figure 94:
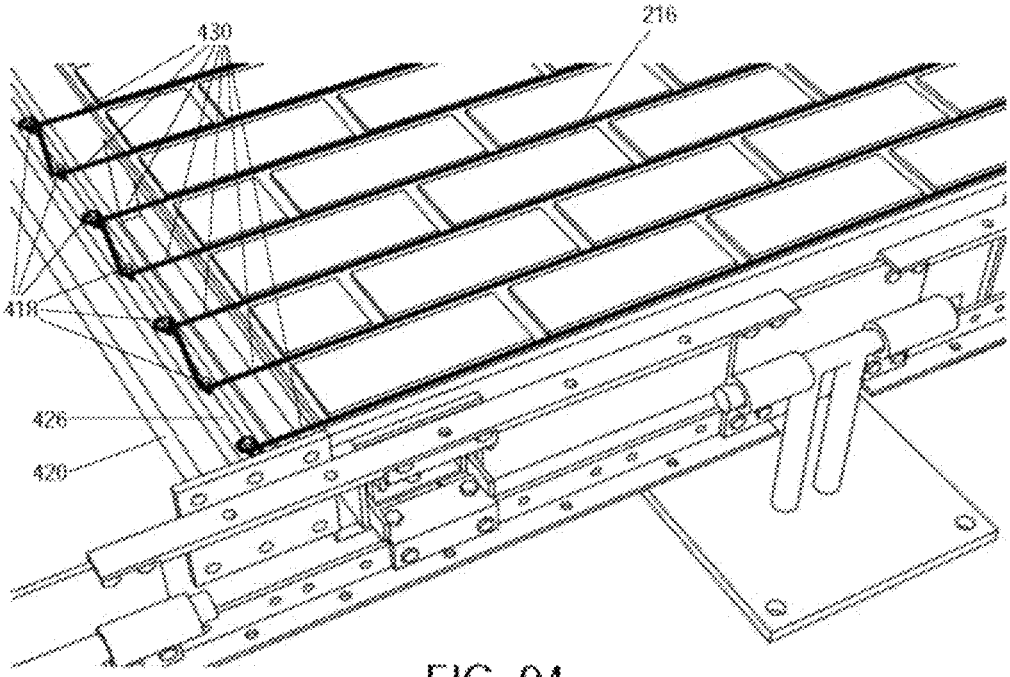
FIG. 94 shows a perspective view of an illustrative embodiment of an exterior finish applied to the prefabricated wall panel of FIG. 93.

FIG. 94 shows a perspective view of an illustrative embodiment of exterior finish 216 applied to the prefabricated wall panel. A non-limiting example of exterior finish 216 may be exterior wall tiles. Strings 430 are wrapped around bolts 428 between the opposing tracks 420 to form guides for laying down exterior wall tiles 216. The spacing between bolts 428 in C-channels 426 is adjusted according to the size of exterior wall tiles 216.

Figure 95:
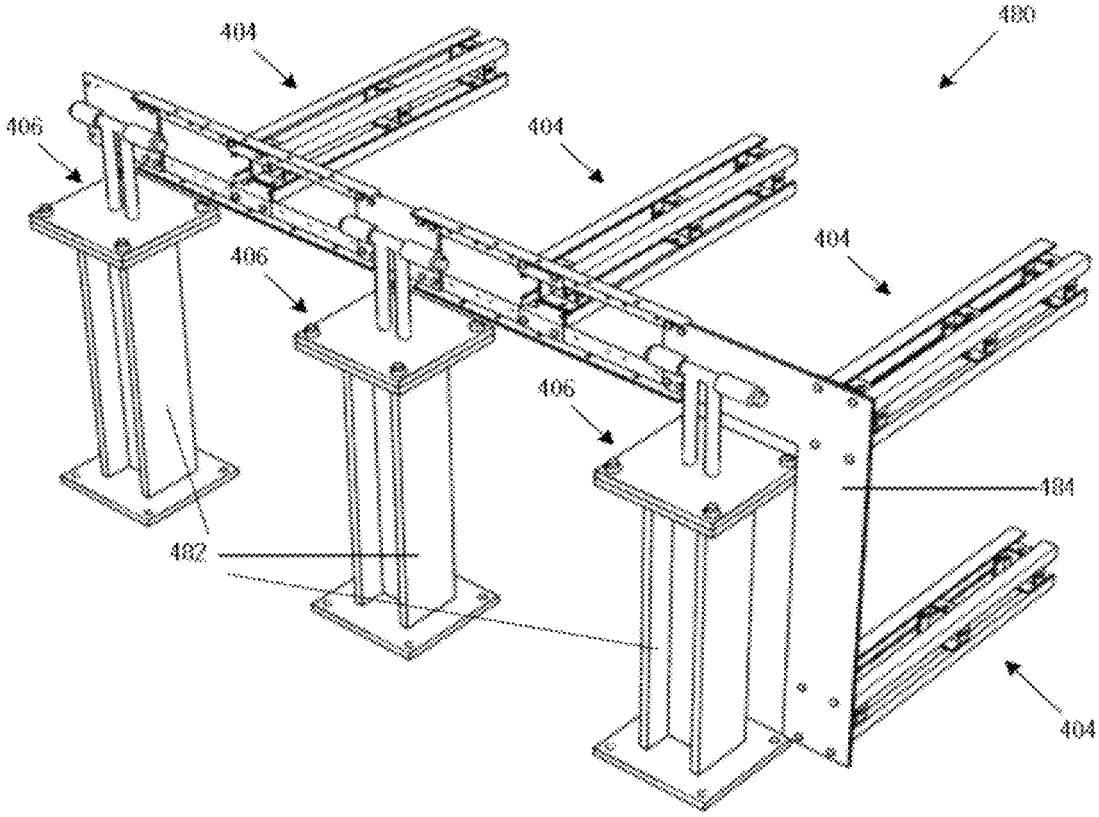
FIG. 95 shows a perspective view of an illustrative embodiment of a wall rack that is part of a production system for finishing corner prefabricated wall panels.

FIG. 95 shows a perspective view of an illustrative embodiment of a wall rack 480 that is part of a production system for finishing corner prefabricated wall panels. Wall rack 480 includes one or more columns 404 mounted on two or more supports 406. Supports 406 are mounted on extension columns 482 to elevate them above the ground about length of one of the two sections of a corner prefabricated wall panel. A support 406 at one end now has an L-shape mounting plate 484 with mounting holes, and columns 404 are fixed by screws to the L-shape mounting plate to match one of the two sections of the corner prefabricated wall panel.

Reinforced Concrete Dense Column Structure

In one or more embodiments of the present disclosure, an RC dense column structure includes RC dense columns along the structure perimeter and a RC ring beam over the dense columns but without RC frame beams and columns. Unlike light-frame construction where walls are made of wood or steel studs, the dense columns has better loadbearing capacity and fire resistance, and is generally insect resistant. Furthermore, the use of prefabricated wall panels reduces construction time and costs.

FIG. 96 shows a perspective view of an illustrative embodiment of a RC dense column structure 500 for a story in a single or multi-story building. Structure 500 includes window structures 22 each including window columns 14, window beam 16, and a short window column 18, dense secondary columns 20, a ring beam 502, and floor slab 96. For clarity, only some of the elements are labeled in FIG. 96 and the remainder of the drawings.

Unlike RC dense column frame structure 8 in FIG. 2, RC dense column structure 500 is not a frame structure with a grid of frame beams 10 and frame columns 12 at the beam intersections. Instead, dense columns 20 and window structures 22 are located along the structure perimeter. Dense columns 20 may also be located within the structure perimeter. Ring beam 502 is formed over dense columns 20 and window structures 22 to tie together structure 500. Note that ring beam 502 is a feature unique to RC dens column structure 500 and it is not found in RC dense column frame structure 8.

Figure 97:
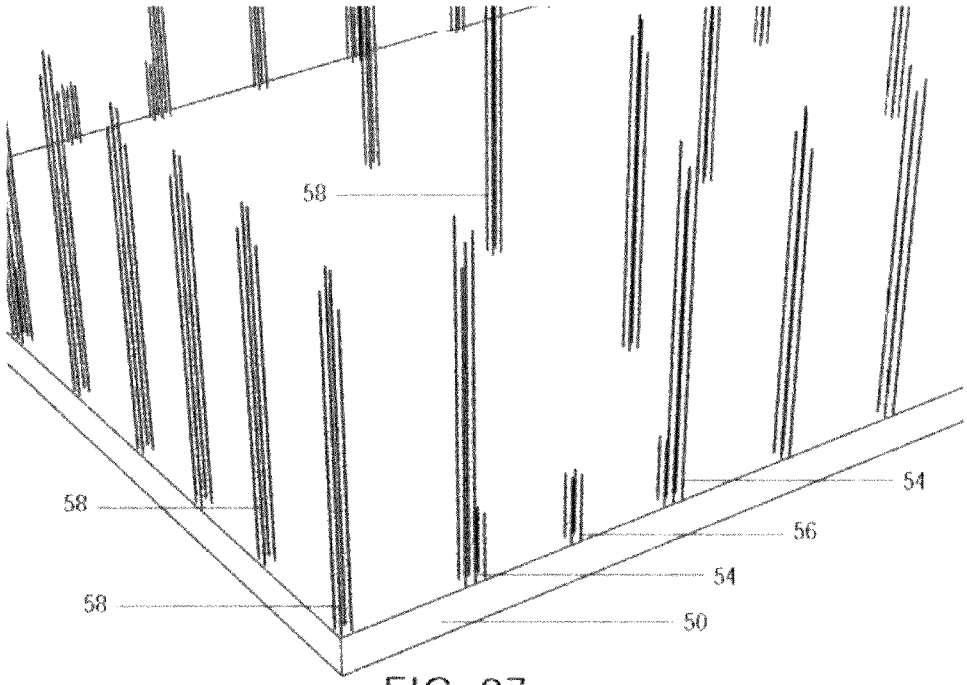
FIG. 97 shows a perspective view of an illustrative embodiment for forming a foundation for the structure of FIG. 96.

RC dense column structure 500 may be constructed in a similar manner as RC dense column frame structure 8. As illustrated in FIG. 97, foundation 50 is formed with vertically protruding window column rebar structures 54, short window column rebar structures 56, and dense column rebar structures 58.

Figure 98:
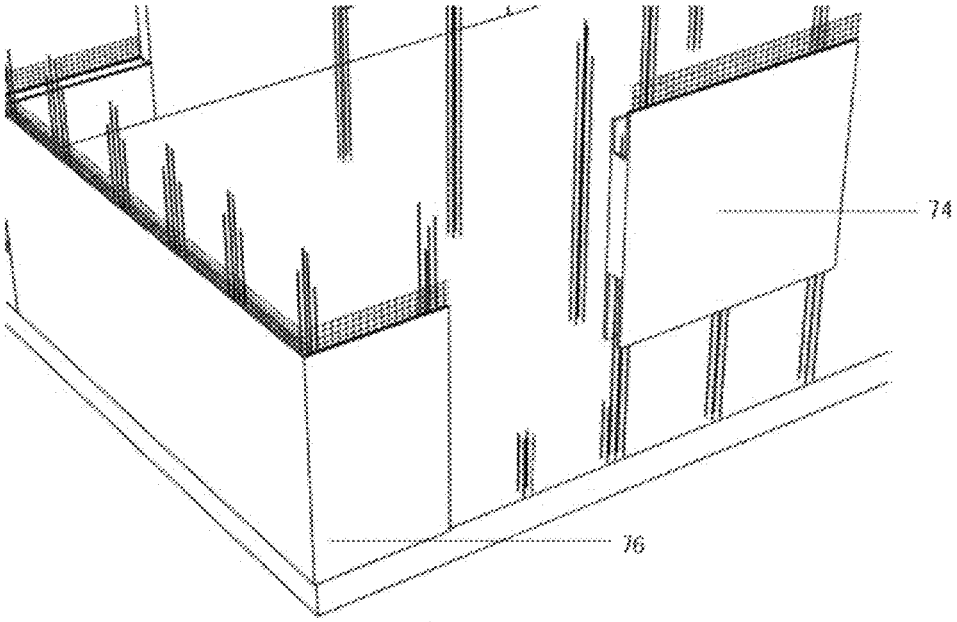
FIG. 98 shows a perspective view of an illustrative embodiment for installing straight and corner prefabricated wall panels for the structure of FIG. 96.

As illustrated in FIG. 98, straight prefabricated wall panels 74 and corner prefabricated wall panels 76 are hoisted into place around corresponding vertical rebar structures. Unlike the earlier described prefabricated wall panels 74 and 76, these prefabricated wall panels only define molds for casting window columns 16 (FIG. 96) and dense columns 20 (FIG. 2) around window column rebar structures 54 (FIG. 97) and dense column rebar structures 58 (FIG. 97), respectively. The top of prefabricated wall panels 74 and 76 define molds for casting ring beam 502 (FIG. 96) along the structure perimeter.

Figure 99:
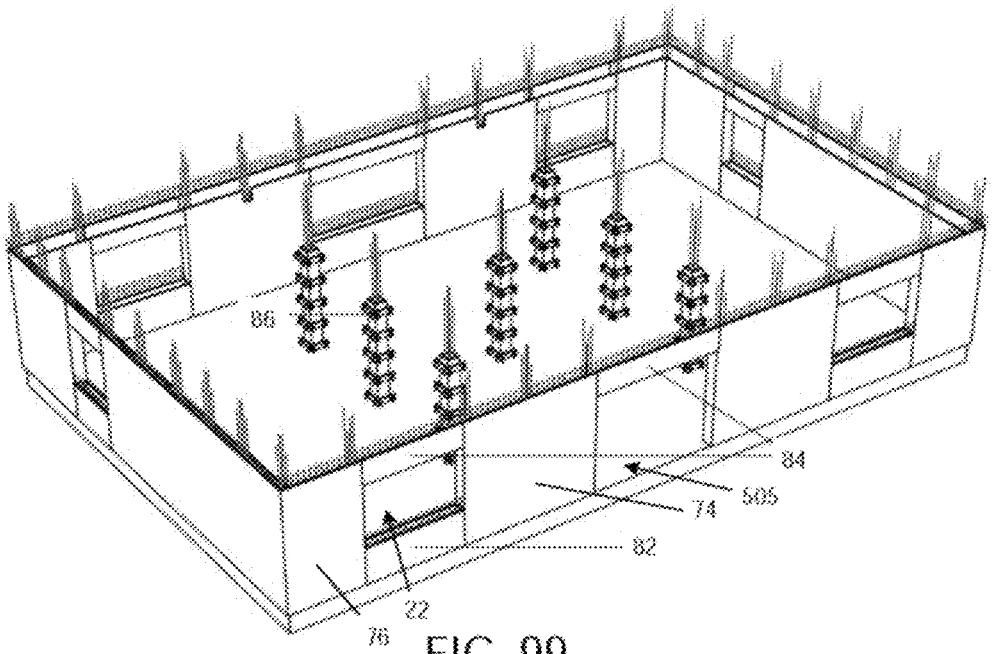
FIG. 99 shows a perspective view of an illustrative embodiment for installing lower and upper prefabricated wall panels for the structure of FIG. 96.

FIG. 99 shows a perspective view of an illustrative embodiment for installing lower prefabricated wall panels 82 and upper prefabricated wall panels 84. Lower prefabricated wall panels 82 and upper prefabricated wall panels 84 are hoisted into place between prefabricated wall panels 74 and 76. Lower preformed wall panel 82 defines molds for casting parts of the lower column sections 26 (FIG. 3) of window columns 14 (FIG. 96) around short rebar cages 62 (FIG. 6), window beam 16 (FIG. 96) around window beam rebar structure 64 (FIG. 6), short window column 18 (FIG. 96) around short window rebar structure 56 (FIG. 6).

Upper prefabricated wall panel 84 is fixed to adjoining prefabricated wall panels 74/76. When fixed above lower prefabricated wall panel 82, upper prefabricated wall panel 84 forms part of window structure 22. Otherwise upper prefabricated wall panel 84 and dense columns 20 in the adjoining prefabricated wall panels 74/76 form a door structure 505. The top of upper prefabricated wall panel 84 defines a mold for casting ring beam 502 (FIG. 96).

Concrete forms 86 are formed around interior dense column rebar structures 58 within the structure perimeter. Concrete forms 86 define molds for casting interior dense columns 20 (FIG. 96) around interior dense column rebar structures 58.

Figure 100:
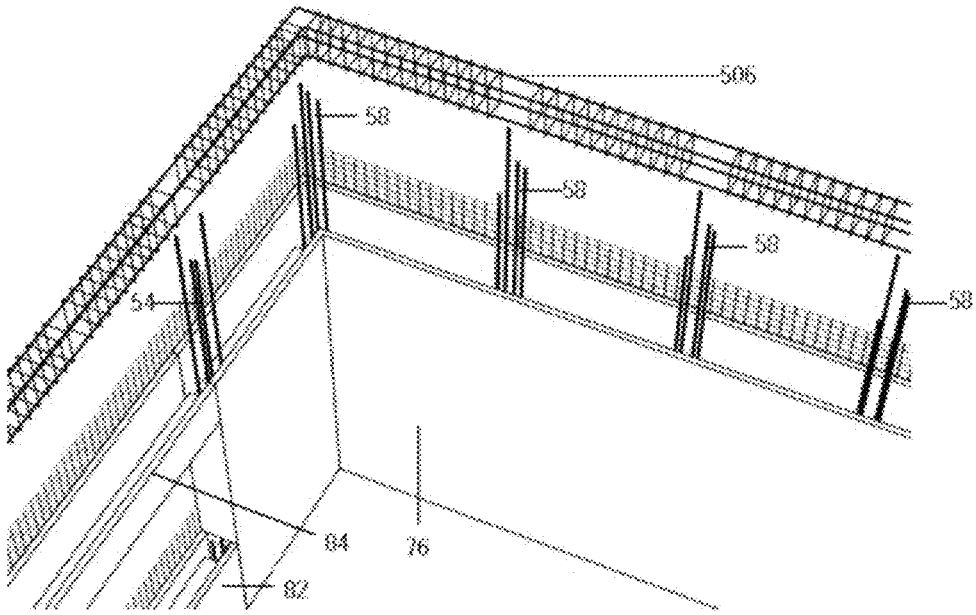
FIGS. 100 and 101 show perspective views of an illustrative embodiment for installing rebar structures for a ring beam and window beams for the structure of FIG. 96.
Figure 101:
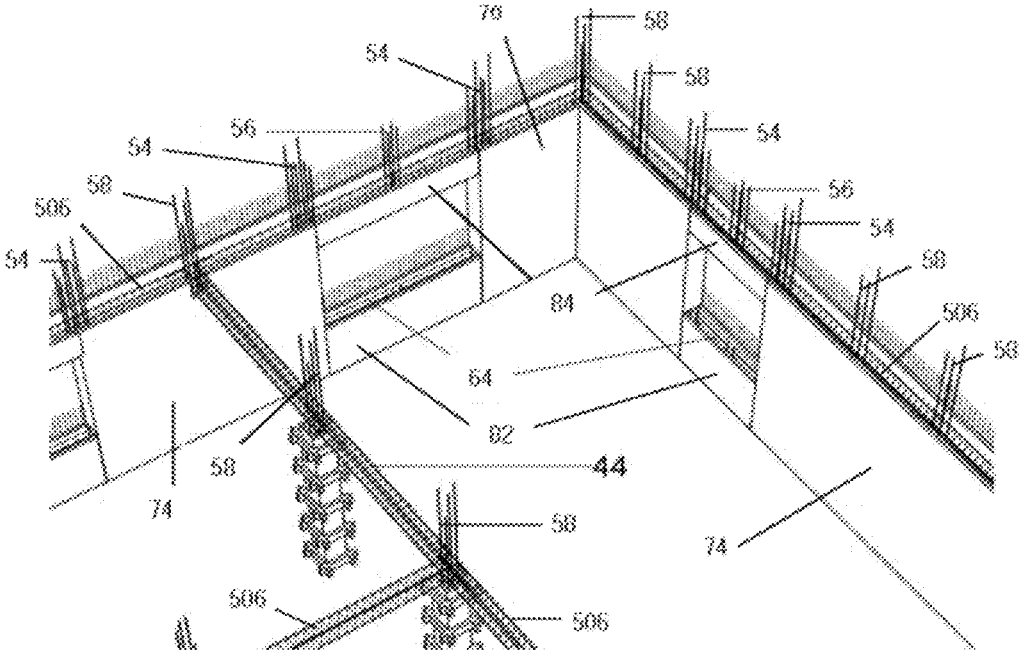

Referring to FIGS. 100 and 101, ring beam rebar structure 506 for ring beam 502 (FIG. 90) is formed. Ring beam rebar structure 506 may be implemented using any of the rebar structures shown in FIG. 9. Peripheral ring beam rebar structure 506 around the structure perimeter is bent at the corners so it remains continuous around the structure perimeter. Peripheral ring beam rebar structure 506 is hoisted onto window column rebar structures 54 and dense column rebar structures 58 and into the molds provided atop of prefabricated wall panels 74, 76, and 84. Peripheral ring beam rebar structure 506 is connected by wires, welding, or another means to window column rebar structures 54 and dense column rebar structures 58. Short window column rebar structures 56 for the next story, if any, are formed and connected by wires, welding, or another means to ring beam rebar structure 506. Interior ring beam rebar structures 506 within the structure perimeter are formed and connected by wires, welding, or another means to the peripheral ring beam rebar structure 506 and dense column rebar structure 58.

Window beam rebar structures 64 for window beams 16 (FIG. 96) are formed. Window beam rebar structures 64 may be formed in molds provided at the top of lower prefabricated wall panels 82. Window beam rebar structures 64 may be connected by wires, welding, or another means to window column rebar structures 54 (FIG. 97) and short window column rebar structures 56 (FIG. 97).

Figure 102:
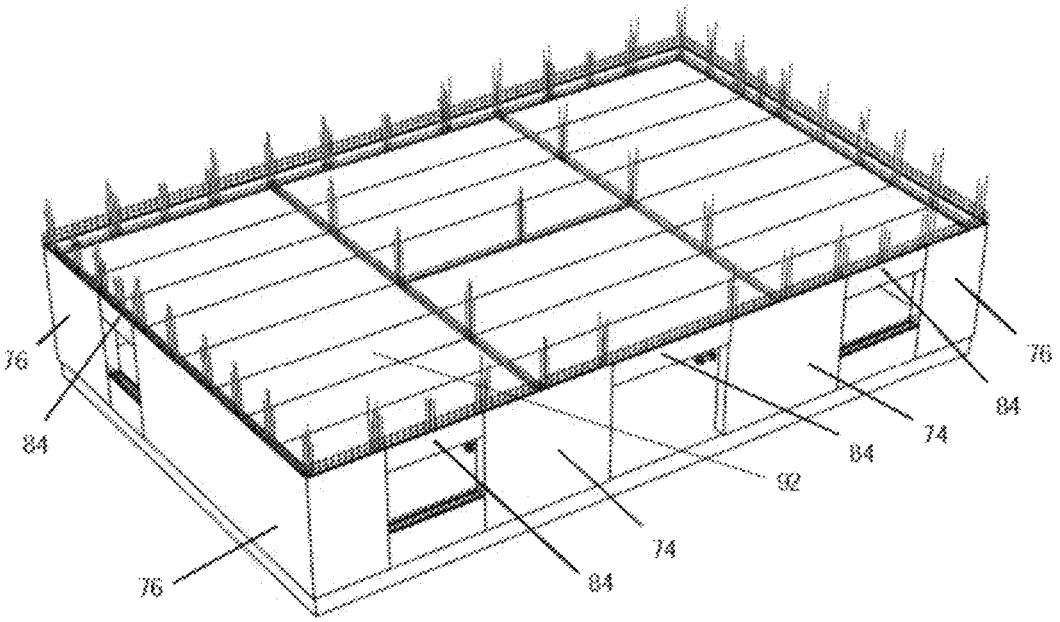
FIG. 102 shows a perspective view of an illustrative embodiment for installing concrete forms for a floor slab for the structure of FIG. 96.

Referring to FIG. 102, concrete forms 92 for casting floor slab 96 (FIG. 96) are placed over and supported by prefabricated wall panels 74, 76, and 84 (FIG. 99), and concrete forms 86 (FIG. 99). Concrete forms 92 also define molds for forming ring beam 502 (FIG. 96).

Figure 103:
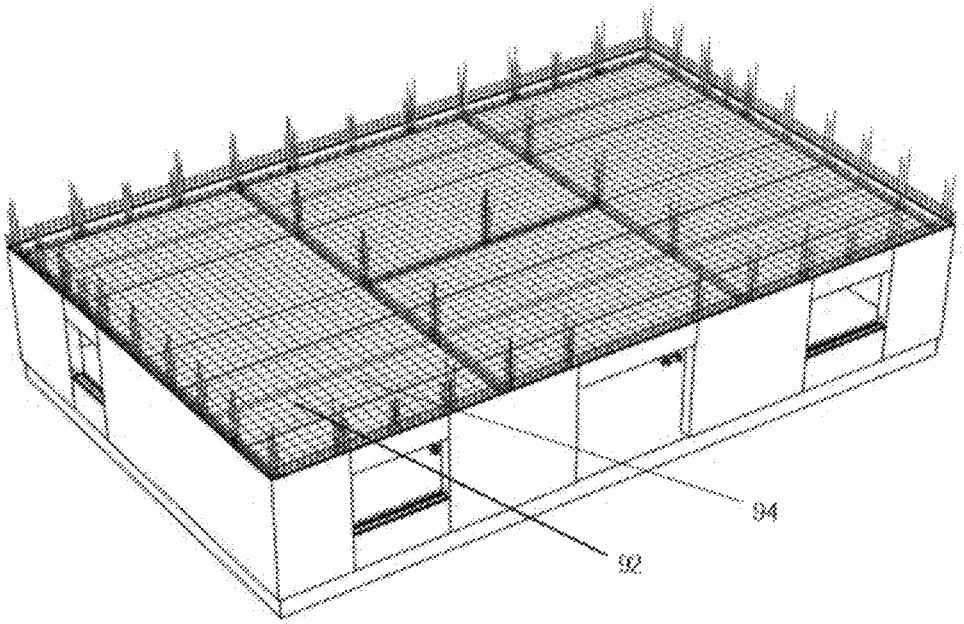
FIG. 103 shows a perspective view of an illustrative embodiment for installing rebar structures for the floor slab in the structure of FIG. 96.

Referring to FIG. 103, floor slab rebar structure 94 for floor slab 96 (FIG. 96) is formed and placed over concrete forms 92. Floor slab rebar structure 94 may be a wire mesh. As an alternative to casting floor slab 96 in-situ, the floor slab may be prefabricated and installed onsite after the other elements of structure 500 are cast.

Figure 104:
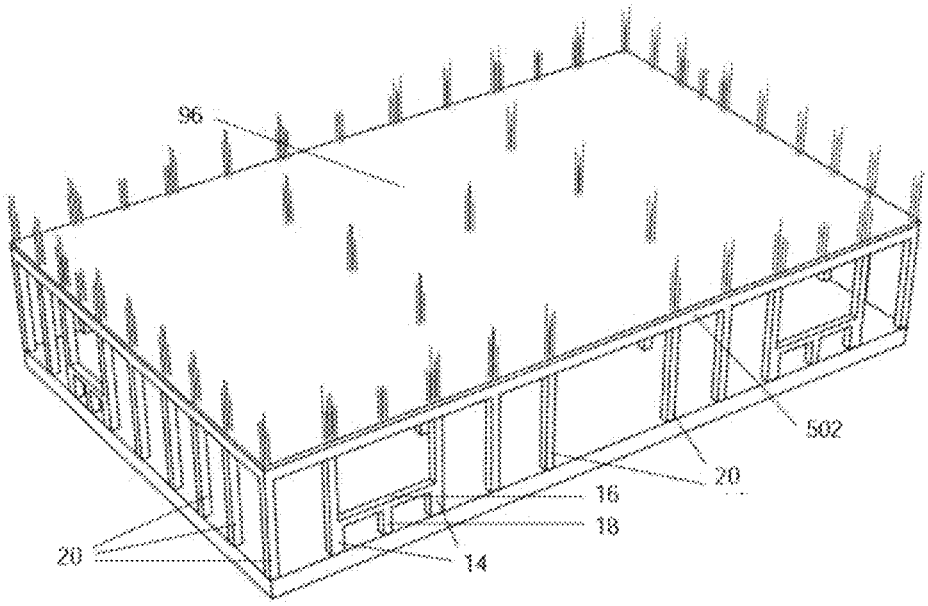
FIG. 104 shows a perspective view of an illustrative embodiment of a RC dense column frame structure for a story in a building.

Referring to FIG. 104, concrete is poured into the various molds to form a monolithic RC dense column structure 500 including window columns 14, window beams 16, short window columns 18, dense columns 20, and floor slab 96. To clearly illustrate RC dense column frame structure 500, prefabricated wall panels 74, 76, 82, and 84 (not shown for the sake of clarity). Concrete forms 86 (FIG. 99) can be removed after the concrete has dried to form structure 500.

Depending if an additional story will be formed, rebar structures 54, 56, and 58 may or may not protrude from floor slab 96. Rebar structures 54 and 58 may be vertically extended to form the next structure 500 for the next story in the building. Each rebar structure may be vertically extended by adding additional sections using rebar splice coupling sleeves, welding, or another means.

Figure 105:
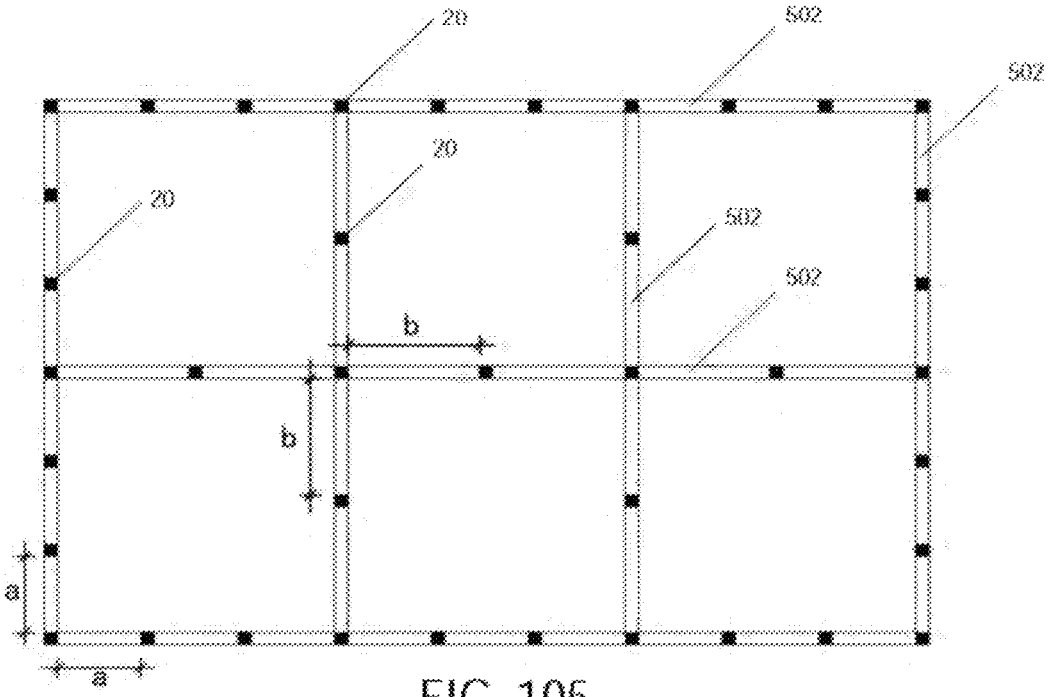
FIG. 105 shows a plan view of an illustrative embodiment of the ring beam and dense columns 20 of a RC dense column frame structure.

FIG. 105 shows a plan view of an illustrative embodiment of ring beam 502 and dense columns 20. Ring beam 502 is a continuous reinforced concrete beam that connects dense columns 20, window structures 22 (FIG. 99), and door structures 505 (FIG. 99) around the structure perimeter. Ring beam 502 may be straight or curved. Dense columns 20 are located at corners and intersections of ring beam 502. Peripheral dense columns 20 along the structure perimeter are separated by distance a, where in an embodiment $a \leq 1{,}250$ mm. The distance between any two window columns 14 (FIG. 99) that form window structure 22 or the distance between any dense columns 20 that form door structure 505 are not limited by distance a. Interior dense columns 20 within the structure perimeter are separated by a distance "b," which depend on the building height. Distance b is small for tall buildings and large for short buildings.

Figure 106:
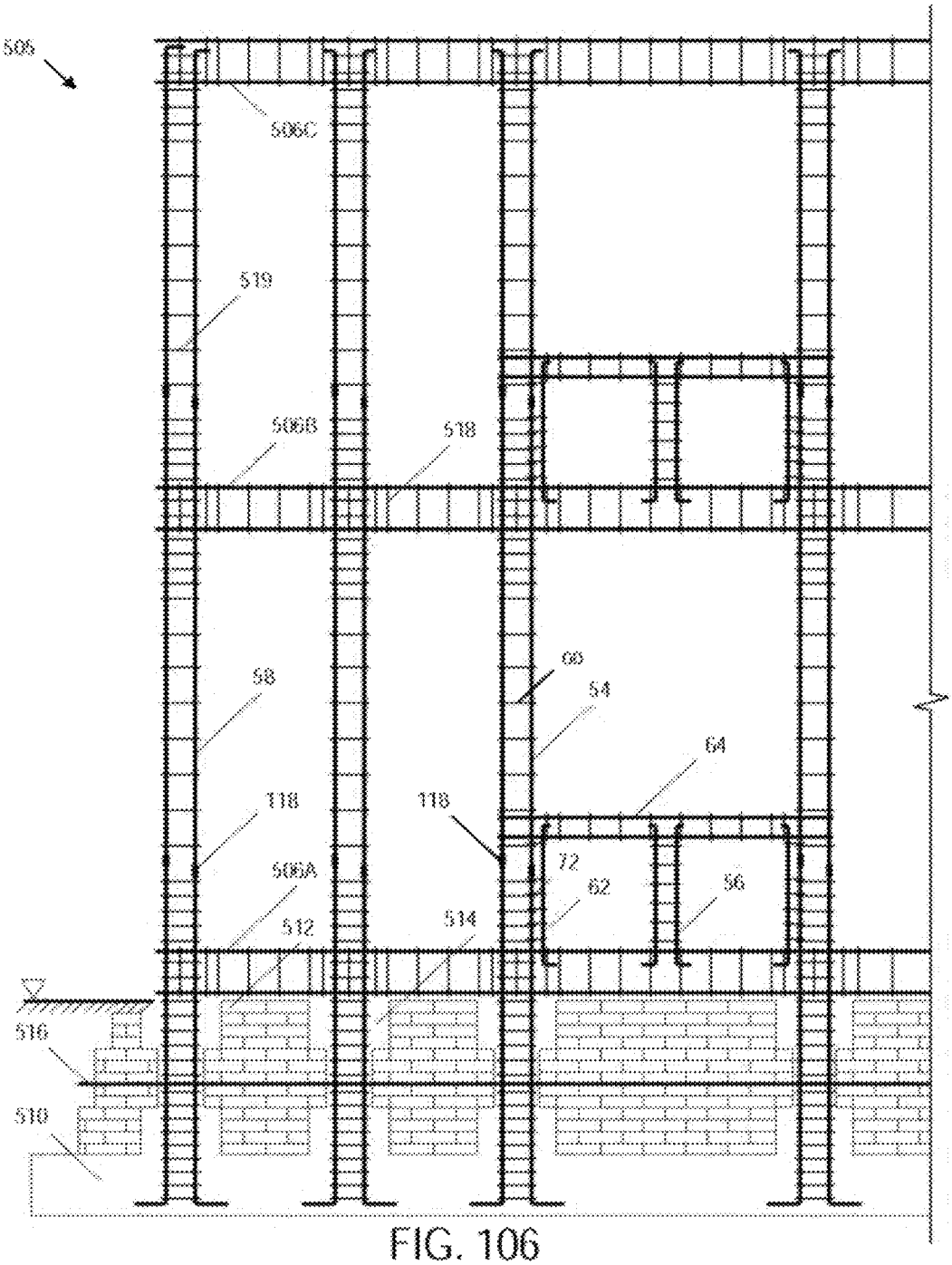
FIG. 106 shows a side view of an illustrative embodiment of rebar structures of multiple structures of FIG. 96 in a building.

FIG. 106 shows a side view of an illustrative embodiment of vertical rebar structures of multiple structures 500 (FIG. 96) for a multi-story building 505 where dense columns 20 (FIG. 96) are gravity loadbearing.

Window column rebar structures 54 and dense column rebar structures 58 extend into a foundation pad 510. In foundation pad 510, the ends of window column rebar structures 54 and dense column rebar structures 58 have bent or hooked ends to lock them to the concrete. Window column rebar structures 54 and dense column rebar structures 58 extend continuously from the bottom of foundation pad 510, through ring beam rebar structures 506A at the ground floor, ring beam rebar structures 506B at an intermediate floor, and into ring beam rebar structures 506C at the roof. In ring beam rebar structure 506C, window column rebar structures 54 and dense column rebar structures 58 have bent or hooked ends to lock them to the concrete. Window column rebar structures 54, dense column rebar structures 58, and ring beam rebar structures 506A, 506B, and 506C are tied by wires, welding, or another means. Window column rebar structures 54 and dense column rebar structures 58 may be made up of multiple sections connected by rebar splice coupling sleeves 118. Alternatively, the sections may be connected by lap joints, welding, or other conventional methods. Near the intersections of window column rebar structures 54 or dense column rebar structures 58 and ring beam rebar structures 506, the number of window column stirrups 68 or dense column stirrups 519 and ring beam stirrups 518 may be increased.

When the foundation includes brick foundation walls 512, columns 514 are cast around window rebar structures 54 and dense column rebar structures 58 and extend from foundation pad 510. Columns 514 have an interlocking pattern to join adjacent brick foundation walls 512. Rebars 516 pass through columns 514 and are tied by wire, welding, or other means to window rebar structures 54 and dense column rebar structures 58. This arrangement unifies brick foundation walls 512 and dense columns 20. As the distance between dense columns 20 is short, rebars 516 may be a continuous piece.

Short rebar cages 62 are tied by stirrups 72 to tall rebar structure 60 to form window column rebar structures 54. Where window beam rebar structures 64 and window column rebar structures 54 intersect, they may be tied by wires, welding, or another means. Short window column rebar structures 56 and short rebar cages 62 have bent or hooked ends in window beam rebar structures 64, ring beam rebar structure 506A at the ground floor, and floor ring beam rebar structure 506B at the intermediate floor to lock them into the concrete.

Figure 107:
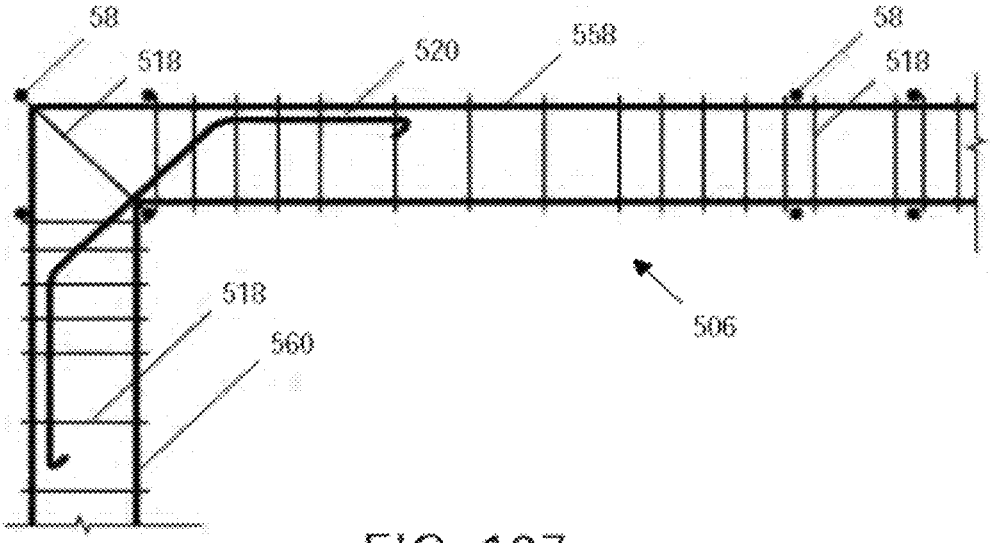
FIG. 107 shows a top view of an illustrative embodiment of a corner in the structure of FIG. 96.

FIG. 107 shows a top view of an illustrative embodiment of a corner of structure 500 (FIG. 96). A peripheral ring beam rebar structure 506 includes outer rebar 558 and inner rebar 560. Dense column rebar structures 58 may pass through peripheral ring beam rebar structure 506 from the inside or the outside of the ring beam rebar structure. Ring beam stirrups 518 are fixed to dense column rebar structures 58 by wires, welding, or another means. The number of ring beam stirrups 518 may increase near the intersections with dense column rebar structures 58 (and window column rebar structures 54) but the pitch of the stirrups is adjusted so the stirrups do not affect the pouring of concrete. The corner may be reinforced with a ring beam reinforcement rebar 520.

Figure 108:
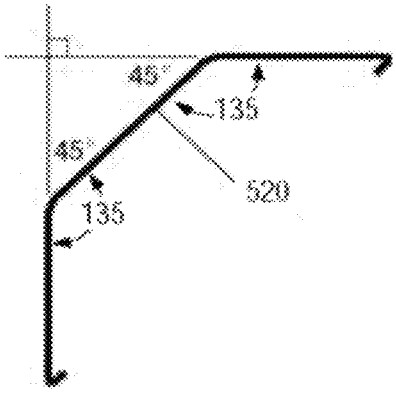
FIG. 108 shows a top view of an illustrative embodiment of a ring beam reinforcement rebar.

FIG. 108 shows a top view of an illustrative embodiment of ring beam reinforcement rebar 520. Ring beam reinforcement rebar 520 has two orthogonal end sections joined by a midsection angled at 135° relative to the end sections. Referring back to FIG. 107, the end sections of ring beam reinforcement rebar 520 are placed parallel to orthogonal sections of peripheral ring beam outer rebar 558, and the midsection of the ring beam reinforcement rebar passes through dense column rebar structure 58.

Figure 109:
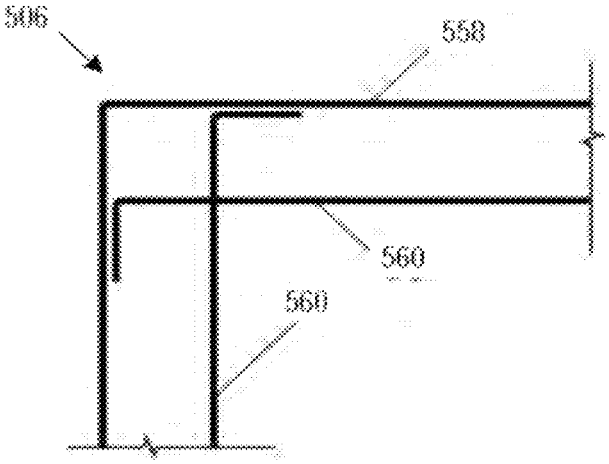
FIG. 109 shows a top view of an illustrative embodiment of a peripheral ring beam rebar structure.

FIG. 109 shows a top view of an illustrative embodiment of peripheral ring beam rebar structure 506. Instead of a continuous peripheral ring beam interior rebars 560, orthogonal peripheral ring beam interior rebars 560 with bent or hooked ends are used. Peripheral ring beam interior rebars 560 cross and are extended until their bent ends are near and parallel to peripheral ring beam exterior rebar 558. The bent ends of peripheral ring beam interior rebars 560 are tied by wire, welding, or another means to peripheral ring beam exterior rebar 560.

Figure 110:
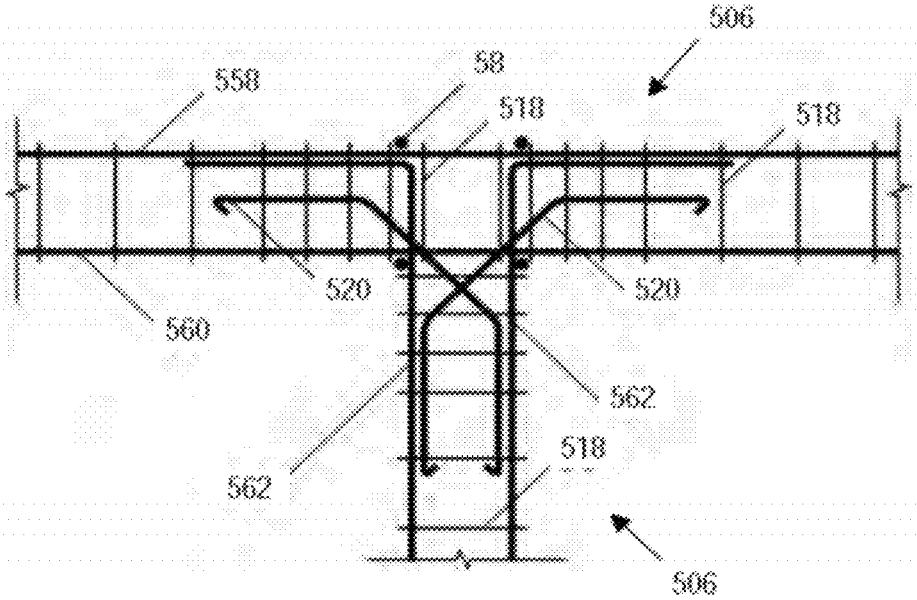
FIG. 110 shows a top view of an illustrative embodiment of a T-intersection in the structure of FIG. 96.

FIG. 110 shows a top view of an illustrative embodiment of a T-intersection of structure 500 (FIG. 96). The T-intersection includes a peripheral ring beam rebar structure 506 with exterior rebar 558 and interior rebar 560, and an interior ring beam rebar structure 506 with rebars 562. At the T-intersection, the ends of interior ring beam rebars 562 are bent in opposite direction to be parallel to peripheral ring beam exterior rebar 558. The bent ends of interior ring beam rebars 562 are fixed by wires, welding, or another means to peripheral ring beam exterior rebars 558.

Dense column rebar structure 58 may pass through T-intersection of ring beam rebar structures 506 from the inside or the outside of the T-intersection. Where dense column rebar structure 58 passes through the T-intersection, ring beam stirrups 518 are fixed to the dense column rebar structure by wires, welding, or another means. The number of ring beam stirrups 518 may be increased near the intersection with dense column rebar structure 58 but the pitch of the stirrups does not affect the pouring of concrete. The T-intersection may be reinforced with ring beam reinforcement rebars 520. In the interior ring beam rebar structure 506, ring beam reinforcement rebars 520 cross and then head off into opposite directions in the exterior ring beam rebar structure 506.

Figure 111:
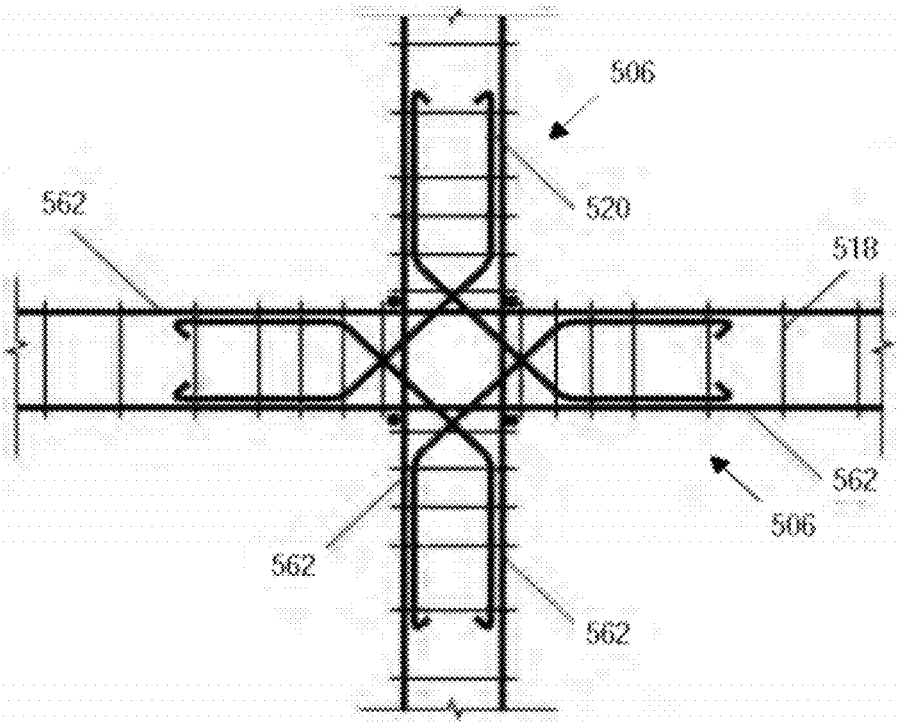
FIG. 111 shows a top view of an illustrative embodiment of a cross-shaped intersection in the structure of FIG. 96.

FIG. 111 shows a top view of an illustrative embodiment of a cross-shaped intersection of structure 500 (FIG. 96). The cross-shaped intersection includes two orthogonal interior ring beam rebar structures 506.

Dense column rebar structure 58 may pass through cross-shaped intersection of ring beam rebar structure 506 from the inside or the outside of the cross-shaped intersection. Where dense column rebar structure 58 passes through the cross-shape intersection, ring beam stirrups 518 are fixed to the dense column rebar structure by wires, welding, or another means. The number of ring beam stirrups 518 may be increased near the intersections with dense column rebar structure 58 but the pitch of the stirrups does not affect the pouring of concrete. The cross-shaped intersection may be reinforced with ring beam reinforcement rebars 520. Each ring beam reinforcement rebar 520 extend from one end of an interior ring beam rebar structure 506, crosses over a coincident ring beam reinforcement rebar, and head off into an adjacent end of the other interior ring beam rebar structure 506.

Figure 112:
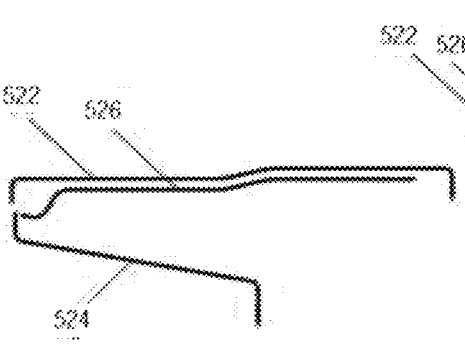
FIGS. 112 and 113 show side cross-sectional views of an illustrative embodiment of rebar structures for a cantilever beam extending from a dense column and a ring beam in the structure of FIG. 96.
Figure 113:
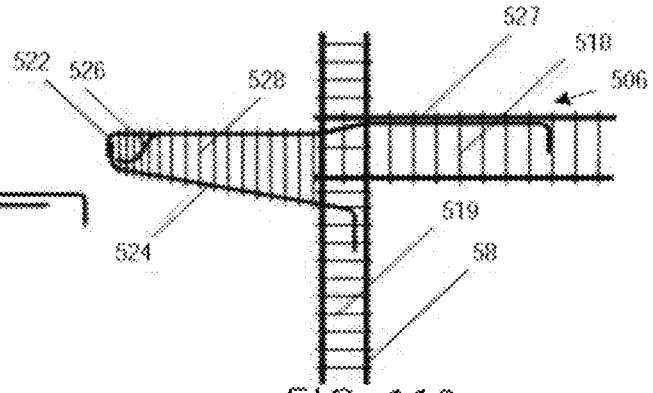

FIGS. 112 and 113 show side cross-sectional views of an illustrative embodiment of rebar structures for a cantilever beam extending from dense column 20 (FIG. 96) and ring beam 502 (FIG. 96). The rebar structure for the cantilever beam includes an upper rebar 522, a lower rebar 524, a reinforcement rebar 526, and stirrups 528. Cantilever beam upper rebar 522 extends through dense column rebar structure 58 and into peripheral ring beam rebar structure 506. Cantilever beam upper rebar 522 has two bent or hooked ends, and is fixed by wires, welding, or another means to an upper rebar 527 of peripheral ring beam rebar structure 506. Cantilever beam lower rebar 524 extends into dense column rebar structure 58 and has two bent or hooked ends. Cantilever beam reinforcement rebar 526 is located between upper rebar 522 and lower rebar 524 and also extends through dense column rebar structure 58 and into peripheral ring beam rebar structure 506. Cantilever beam stirrups 528 are tied by wires, welds, or another means to cantilever beam upper rebar 522, lower rebar 524, and reinforcement rebar 526.

Figure 114:
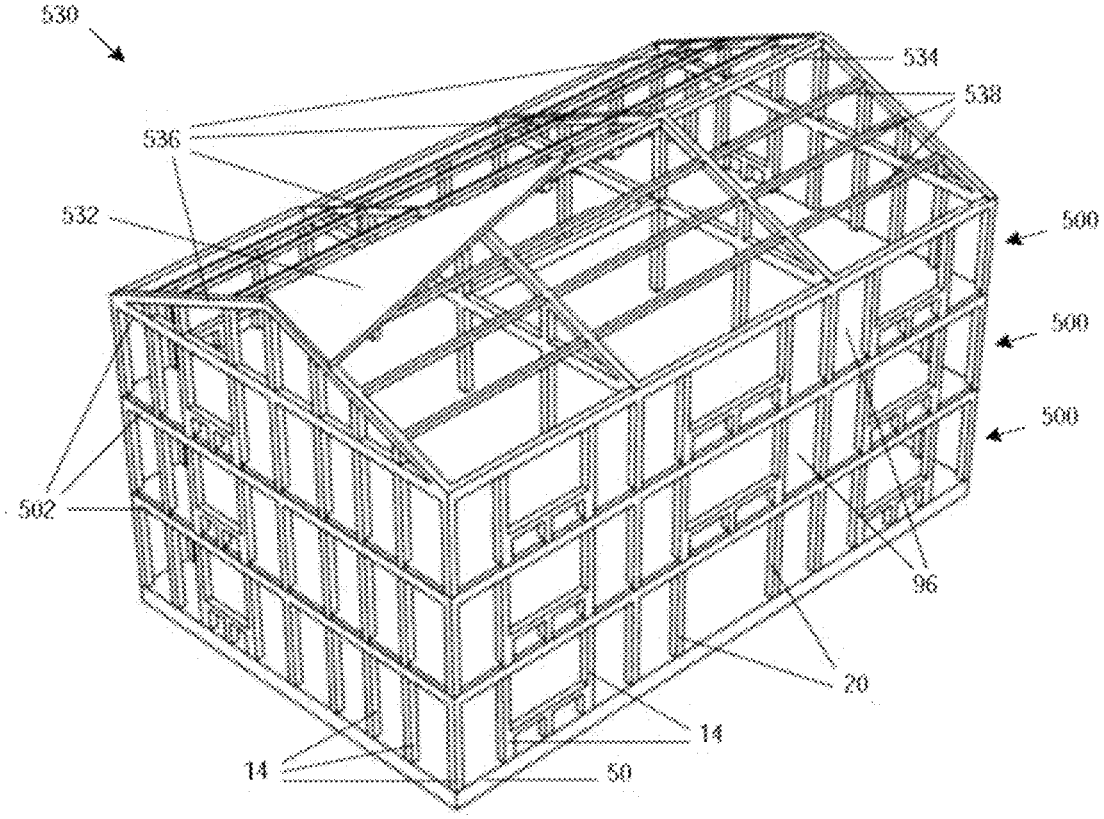
FIG. 114 shows a perspective view of an illustrative embodiment of a building having multiple structures of FIG. 96.

FIG. 114 shows a perspective view of an illustrative embodiment of a building 530 having multiple stories of structures 500 (FIG. 96). As described above, window columns 14 and dense columns 20 are RC columns located below ring beam 502. Window columns 14 and dense columns 20 are loadbearing and they are aligned with the same feature from the stories above and below. Window columns 14 and dense columns 20 are continuous from the top story down to foundation 50. Ring beam 502 is located on each story.

Building 530 includes a pitched roof 532 over an RC ridge beam 534, RC rafters 536, and RC purlins 538 all connected by dense columns 20 to a roof ring beam 502 and all monolithically cast in-situ. Dense columns 20 extend past roof ring beam 502 and intersect rafters 536. Purlins 538 are aligned with dense columns 20 at rafters 536 to quickly transfer the load of pitched roof 532 to the dense columns.

Figure 115:
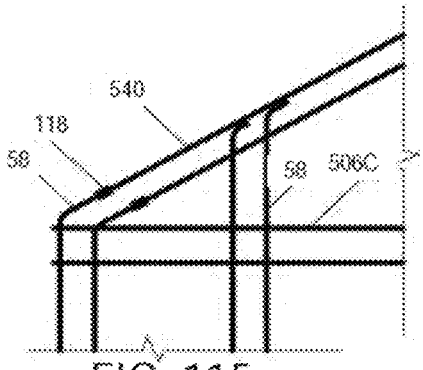
FIG. 115 shows a side cross-sectional view of an illustrative embodiment of rebar structures of a pitched roof of the building in FIG. 114.

FIG. 115 shows a side cross-sectional view of an illustrative embodiment of rebar structures of pitched roof 532 (FIG. 114). Rebar structure 540 for a roof rafter 536 (FIG. 114) is connected at one end by rebar splice coupling sleeves 118 to dense column rebar structure 58. Other dense column rebar structures 58 extend pass roof ring beam rebar structure 506C and have bent ends parallel and fixed by wires, welding, or another means to rafter rebar structure 540.

Figure 116:
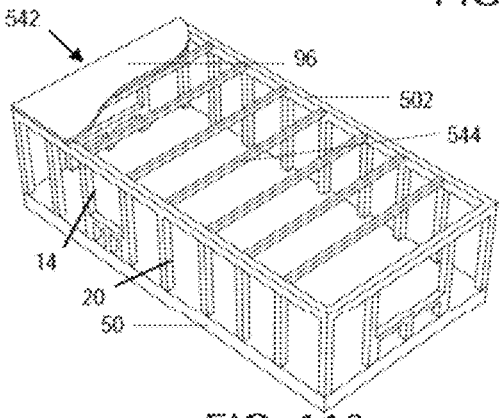
FIG. 116 shows a perspective view of an illustrative embodiment of a building with parallel dense beams spanning across a ring beam.

FIG. 116 shows a perspective view of an illustrative embodiment of a building 542 with parallel RC dense beams 544 spanning across two sections of ring beam 502 at opposite sides of building 542. Dense beams 544 may be aligned with window columns 14 and dense columns 20 under the two sections of ring beam 502.

Figure 117:
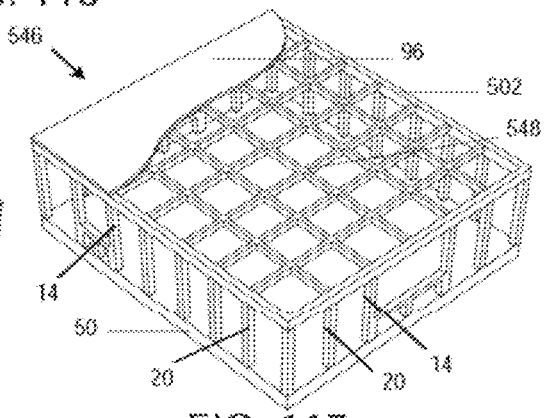
FIG. 117 shows a perspective view of an illustrative embodiment of a building with a grid of orthogonal dense beams spanning across a ring beam.

FIG. 117 shows a perspective view of an illustrative embodiment of a building 546 with a grid of orthogonal RC dense beams 548 spanning across four sections of ring beam 502 at the four sides of building 546. Dense beams 548 may be aligned with window columns 14 and dense columns 20 under the four sections of ring beam 502. The beams directly transfer the load from the floor slab to the dense columns.

Figure 118:
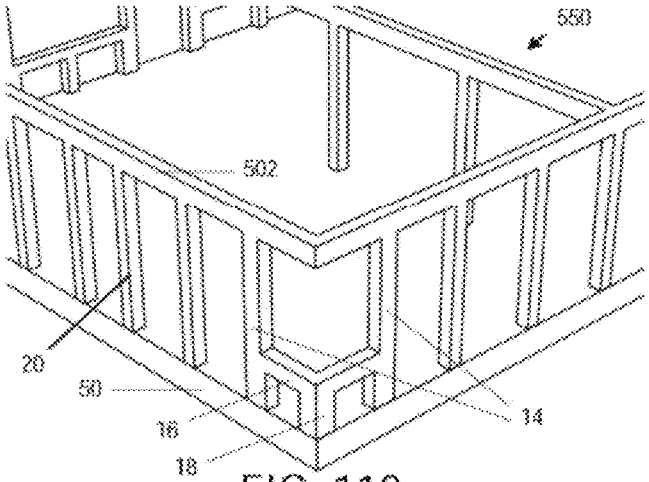
FIGS. 118 and 119 show perspective views of an illustrative embodiment of a building with a corner window.
Figure 119:
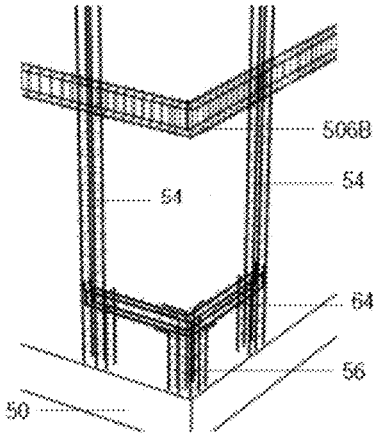

FIGS. 118 and 119 show perspective views of an illustrative embodiment of a building 550 with a corner window. In this example embodiment the size of the corner window is to be minimized, such as being smaller than the window provided by window structure 22 (FIG. 99). Window beam rebar structure 64 has bent or hooked ends that extend sufficiently into window column rebar structure 54. Short window column rebar structure 56 has bent or hooked ends that extend sufficiently into window beam rebar structure 64 and foundation 50. Short window column 18 may have an L-shaped cross section. Seismic load is transferred from window columns 14 to window beam 16, and from the window beam to short window column 18 to foundation 50. Window column 14 and short window column 18 may include additional rebars to support the additional seismic load created by the corner window configuration.

Figure 120:
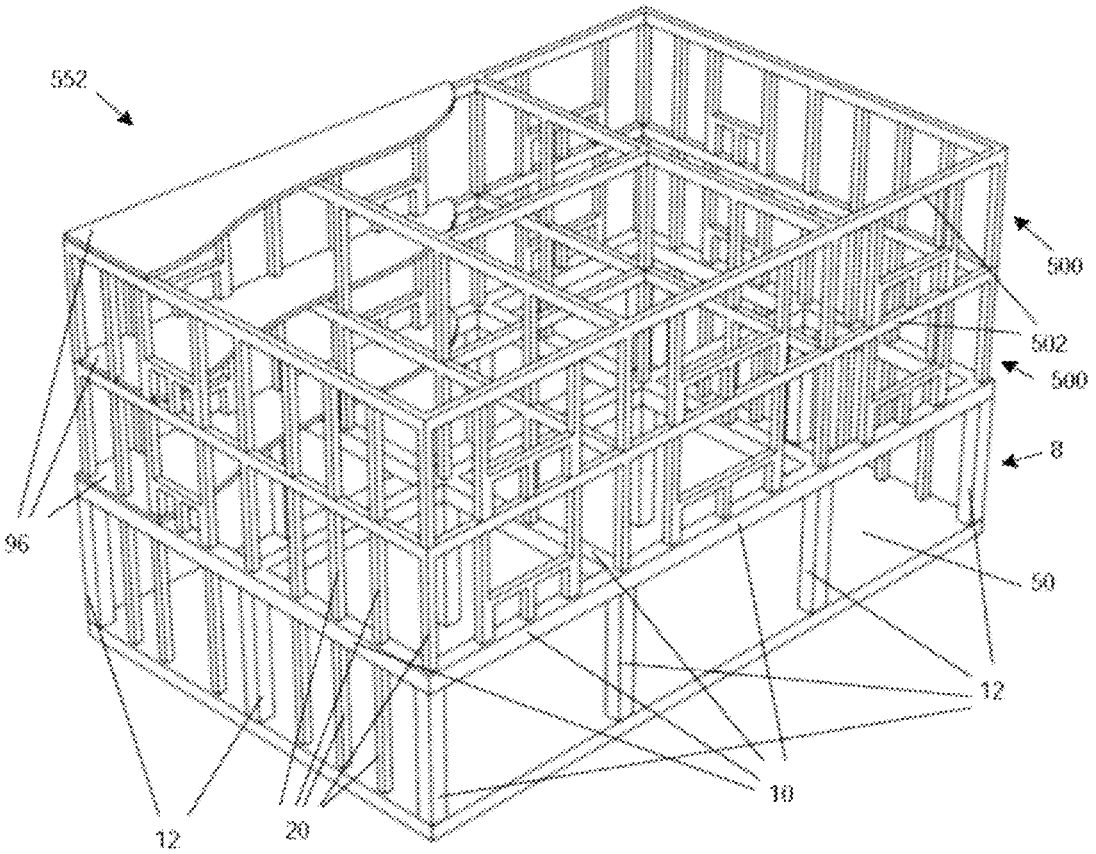
FIG. 120 shows a perspective view of an illustrative embodiment of a building combining the structures of FIGS. 2 and 96.

FIG. 120 shows a perspective view of an illustrative embodiment of a building 552 combining structures 8 and 500 shown without prefabricated wall panels. In building 552, the first story may be constructed using RC dense column frame structure 8 while the upper stories are constructed using RC dense column structures 500. Dense columns 20 in structure 8 may be continued in structures 500. Frame columns 12 may also be continued as dense columns 20 in structures 500. The combination of structures 8 and 500 may prevent the change in stiffness, improve seismic resistance and reduce costs through the use of dense columns 20 instead of frame columns 12. Building 552 is suitable for mixed use where the first story is commercial while the upper stories are residential. Using frame columns 12 without any dense columns 20 between the frame columns at the first story allows large display windows to be installed for commercial applications.

Figure 121:
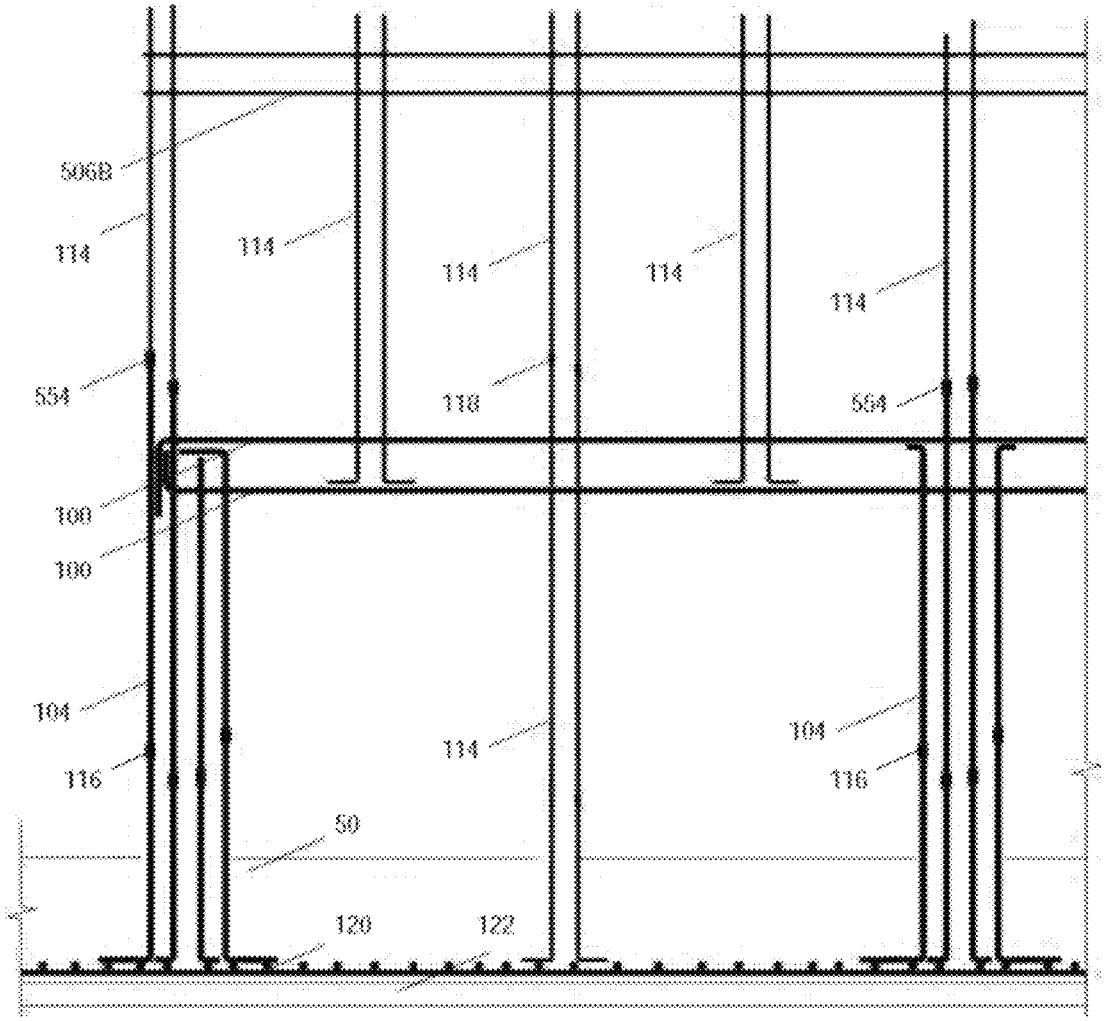
FIG. 121 shows a side cross-sectional view of an illustrative embodiment of rebar structures of the building of FIG. 120.

FIG. 121 shows a side cross-sectional view of an illustrative embodiment of rebar structures of building 552 (FIG. 120). Like frame column rebars 104, dense column rebars 114

(or window column rebars 106) in the first story have bent or hooked ends that are fixed by wire, welding, or another means to wire mesh 122 in foundation 50. Dense column rebars 114 (or window column rebars 106) then extend continuously upward, through frame beam rebars 100, any floor ring beam rebars 506B, and ultimately reaching the roof ring beam 506C (FIG. 99). Dense column rebars 114 that start in the second story have bent or hooked ends that are fixed by wires, welding, or another means to frame beam rebars 100. Dense column rebars 114 that continue from frame column rebars 104 are connected by rebar splice coupling sleeves 554.

Figure 122:
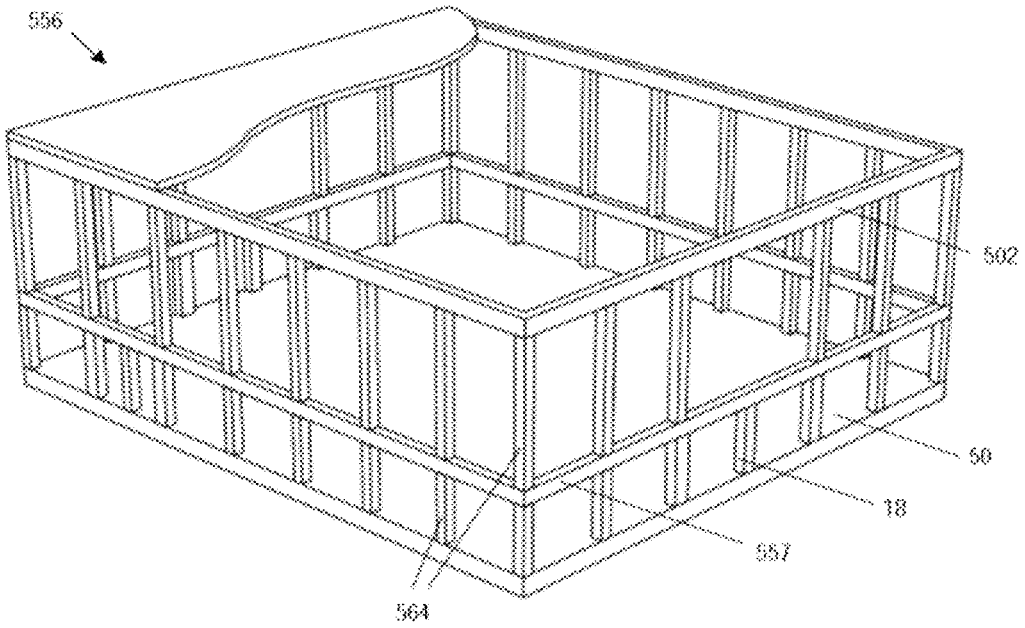
FIG. 122 shows a perspective view of an illustrative embodiment of a RC dense column structure.

FIG. 122 shows a perspective view of an illustrative embodiment of a RC dense column structure 556. Structure 556 is similar to structure 500 (FIG. 96) but a lintel beam 557 has been added around the midsection of the structure, thereby replacing any window beam 16 (FIG. 96). Upper and lower short dense columns 564 have also replaced window columns 14 and dense columns 20.

Figure 123:
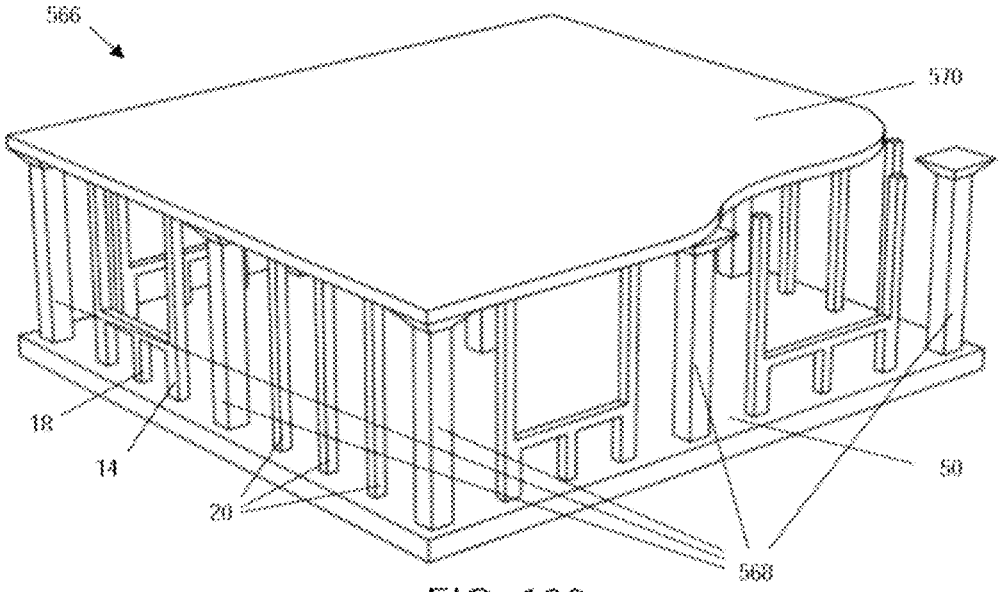
FIG. 123 shows a perspective view of an illustrative embodiment of a RC dense column structure, all arranged in accordance with at least some embodiments described herein.
Figure 112:
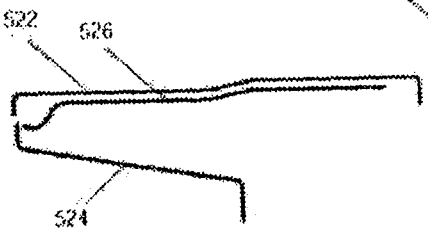
Figure 113:
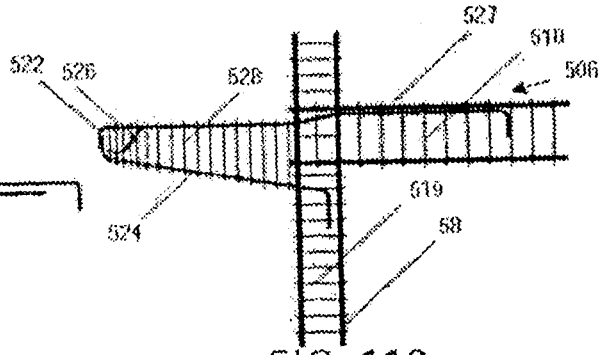
Figure 114:
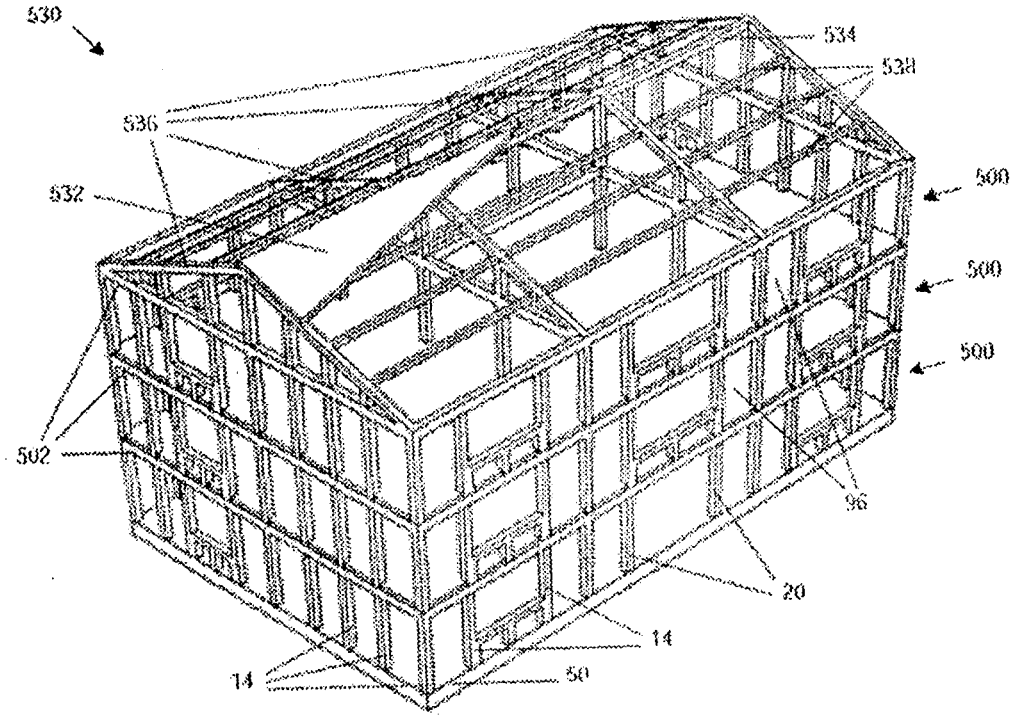

FIG. 123 shows a perspective view of an illustrative embodiment of a RC dense column structure 566. Structure 566 is similar to structure 500 (FIG. 96) but ring beam 502 is removed and columns 568 with capitals replace certain dense columns 20. A precast floor slab 570 is supported by columns 568.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

I Claim:

1. A monolithic reinforced concrete dense column structure to form part of a building, comprising:

a monolithic structure perimeter to form part of the building, comprising:

one or more groups of reinforced concrete dense columns along at least part of the structure perimeter;

one or more reinforced concrete window structures along at least part of the structure perimeter, each window structure comprising:

reinforced concrete window columns;

a reinforced concrete short window column between the window columns; and a reinforced concrete window beam between the window columns and over the short window column;

a reinforced concrete beam over the one or more groups of dense columns and the one or more window structures along the structure perimeter;

a grid of reinforced concrete frame beams including the beam over the dense columns;

reinforced concrete frame columns under frame beam intersections, the frame columns having a larger cross-section than the dense columns, wherein each group of dense columns is located between two frame columns and each window structure is located between two frame columns; and prefabricated wall panels along the structure perimeter, the prefabricated wall panels comprising molds that cast the one or more groups of dense columns, the one or more window structures, the beam, and the frame columns, wherein the prefabricated wall panels includes full-height prefabricated wall panels and less-than-full-height prefabricated wall panels fixed between the full-height prefabricated wall panels.

2. The structure of claim 1, wherein the full-height prefabricated wall panels each has a window column mold at its end adjoining the less-than-full-height prefabricated wall panels, dense column and frame column molds between its two ends, and a frame beam mold at its top.

3. The structure of claim 2, wherein:

the window column molds of the full-height prefabricated walls each comprises a top opening and a bottom opening; and the less-than-full-height prefabricated wall panels comprise lower and upper prefabricated wall panels, the lower prefabricated wall panel having window column molds at its two ends that open to the bottom openings of the window column molds of the adjoining full-height prefabricated walls, a short window column mold between its two ends, and a window beam mold at its top, and the upper prefabricated wall panel having a beam mold at its top and two protruding tabs that fit into the top openings of the window column molds of the adjoining full-height prefabricated walls.

4. The structure of claim 1, wherein the beam comprises a ring beam.

5. The structure of claim 1, further comprising:

other dense columns within the structure perimeter; and another beam over the other dense columns within the structure perimeter.

6. The structure of claim 1, further comprising:

shear walls within and not along the structure perimeter.

7. The structure of claim 1, wherein the frame columns comprises a cross-section selected from the group consisting of rectangular, L-shaped, T-shaped, and cross-shaped cross-sections.

8. The structure of claim 1, wherein a window structure is located at a corner of the structure so its window columns are located on both sides of the corner and its short window column is located at the corner.

9. The structure of claim 1, wherein each window structure further comprises:

window column rebar structures for the window columns, each window column rebar structure comprising a tall rebar cage and a short rebar cage fixed to the tall rebar cage;

a short window column rebar structure for the short window column, the short window column rebar structure being between the window column rebar structures; and a window beam rebar structure for the window beam, the window beam rebar structure being fixed at its ends to the window column rebar structures and near its middle to the short window column rebar structure.

10. A building, comprising:

first and second monolithic reinforced concrete dense column structures forming two stories of the building, each structure comprising:

a monolithic structure perimeter, comprising:

one or more groups of reinforced concrete dense columns along the structure perimeter;

one or more reinforced concrete window structures along the structure perimeter, each window structure comprising:

reinforced concrete window columns;

a reinforced concrete short window column between the window columns; and a reinforced concrete window beam between the window columns and over the short window column;

a reinforced concrete beam over the one or more groups of dense columns and the one or more window structures along the structure perimeter;

a grid of reinforced concrete frame beams including the beam over the dense columns;

reinforced concrete frame columns under frame beam intersections in the grid, the frame columns having a larger cross-section than the dense columns, wherein each group of dense columns is located between two frame columns and each window structure is located between two frame columns; and prefabricated wall panels with molds that cast the one or more groups of dense columns, the one or more window structures, the beam, and the frame columns, wherein the prefabricated wall panels includes full-height prefabricated wall panels and less-than-full-height prefabricated wall panels fixed between the full-height prefabricated wall panels.

11. The building of claim 10, wherein the dense columns of the two stories are aligned vertically, and vertical rebars for the dense columns of the two stories are continuously coupled.

12. The building of claim 10, wherein the dense columns of the two stories are not aligned vertically, and vertical rebars for the dense columns of the two stories are discontinuous.

13. The structure of claim 1, wherein at least one of the dense columns, the window columns, the short window column, the window beam, and the beam comprises a rectangular rebar cage with four vertical rebars connected to a rectangular stirrup.

14. The structure of claim 1, wherein at least one of the less-than-full-height prefabricated wall panels has a relief.

15. The structure of claim 1, wherein the frame column molds are flush with an exterior side of the prefabricated wall panel so the frame columns extend inward from the prefabricated wall panel.

16. The structure of claim 1, wherein a prefabricated wall panel has:

an L-shaped frame column mold to cast an L-shaped frame column; and a T-shaped frame column mold to cast a T-shaped frame column, the T-shaped frame column mold is flush with an exterior side of the prefabricated wall panel so the T-shaped frame column extends inward from the prefabricated wall panel.

17. The structure of claim 1, wherein a prefabricated wall panel has a frame column mold and a column capital mold to cast a column capital atop a frame column, the column capital has a trapezoidal shape, a rectangular shape, a cylindrical shape, or a combination of the trapezoidal shape and the rectangular or the cylindrical shape.

18. The structure of claim 1, wherein one of the prefabricated wall panels has foam boards arranged vertically along the length of the prefabricated wall panel wherein spaces between adjacent foam boards define molds for the reinforced concrete dense columns.

19. The structure of claim 3, wherein the lower and the upper prefabricated wall panels are straight.

* * * * *

UNITED STATES PATENT AND TRADEMARK OFFICE

CERTIFICATE OF CORRECTION

PATENT NO. : 8,863,445 B2
APPLICATION NO. : 13/202988
DATED : October 21, 2014
INVENTOR(S) : Zhong It is certified that error appears in the above-identified patent and that said Letters Patent is hereby corrected as shown below:

In the Drawings

Delete Drawing Sheet 56, and replace with Drawing Sheet 56. (See Attached Sheet)

In the Specification

In Column 4, Line 56, delete “shows” and insert -- show --, therefor.

In Column 16, Line 47, delete “mesh fabric” and insert -- fabric mesh --, therefor.

In Column 17, Line 65, delete “mesh fabric” and insert -- fabric mesh --, therefor.

In Column 21, Line 31, delete “pane” and insert -- panel --, therefor.

In Column 21, Line 47, delete “pane” and insert -- panel --, therefor.

In Column 25, Line 2, delete “wood” and insert -- wooden --, therefor.

In Column 26, Line 22, delete “window columns 16” and insert -- window columns 14 --, therefor.

In Column 28, Lines 62-63, delete “exterior rebar 560.” and insert -- exterior rebar 558. --, therefor.

In Column 31, Line 3, delete “wire mesh 122” and insert -- wire mesh 210 --, therefor.

Signed and Sealed this
Fourteenth Day of April, 2015

Michelle K. Lee

Michelle K. Lee
*Director of the United States Patent and Trademark Office*